US006792633B1

(12) United States Patent
Ito

(10) Patent No.: US 6,792,633 B1
(45) Date of Patent: Sep. 21, 2004

(54) STRETCHER

(75) Inventor: Tsunetaro Ito, Nagano (JP)

(73) Assignee: Takano Co., Ltd. (JP)

( * ) Notice: Subject to any disclaimer, the term of this patent is extended or adjusted under 35 U.S.C. 154(b) by 54 days.

(21) Appl. No.: 09/685,820

(22) Filed: Oct. 10, 2000

(30) Foreign Application Priority Data

| | | |
|---|---|---|
| Oct. 12, 1999 | (JP) | 11-290171 |
| Oct. 12, 1999 | (JP) | 11-290307 |
| Feb. 25, 2000 | (JP) | 2000-050355 |
| Feb. 25, 2000 | (JP) | 2000-050357 |
| Feb. 25, 2000 | (JP) | 2000-050358 |
| Feb. 25, 2000 | (JP) | 2000-050360 |
| Feb. 25, 2000 | (JP) | 2000-100104 |

(51) Int. Cl.[7] ..... A61G 1/017; A61G 7/16; A47C 17/17; A47C 17/18

(52) U.S. Cl. ..... 5/618; 5/86.1

(58) Field of Search ..... 5/618, 617, 616, 5/613, 600, 86.1, 81.1 R, 424, 428, 430; 280/250.1; 297/DIG. 4

(56) References Cited

U.S. PATENT DOCUMENTS

| | | | | |
|---|---|---|---|---|
| 443,197 | A | * 12/1890 | Pynchon | 297/365 |
| 683,032 | A | * 9/1901 | Franklin | 297/360 |
| 1,437,060 | A | * 11/1922 | Koken | 297/76 |
| 2,074,653 | A | * 3/1937 | Larsen | 297/372 |
| 2,130,754 | A | * 9/1938 | Cornell et al. | 297/78 |
| 2,136,088 | A | * 11/1938 | Stevens, Sr. | 5/429 |
| 2,383,340 | A | * 8/1945 | Pezzano | 297/DIG. 4 X |
| 2,587,068 | A | * 2/1952 | Sanders | 5/86.1 |
| 2,694,437 | A | * 11/1954 | Glaser | 280/657 |
| 2,786,214 | A | * 3/1957 | Armstrong | 5/430 |
| 3,147,039 | A | * 9/1964 | Smith et al. | 297/90 |
| 3,215,469 | A | * 11/1965 | Wamsley | 297/344.18 |
| 3,284,126 | A | * 11/1966 | Piazza | 5/614 X |
| 3,936,893 | A | * 2/1976 | Anderson et al. | 5/86.1 |
| 4,046,418 | A | * 9/1977 | Smith et al. | 297/118 |
| 4,119,342 | A | * 10/1978 | Jones | 297/80 |

(List continued on next page.)

FOREIGN PATENT DOCUMENTS

| | | | |
|---|---|---|---|
| GB | 1006957 | * 10/1965 | 5/430 |
| JP | 05-0358128 U | 5/1993 | |
| JP | 1052459 | 2/1998 | A61G/1/02 |

OTHER PUBLICATIONS

English Abstract of Japanese Patent laid–open No. 10–52459.

Cover page of International Publication No. WO 99/30662.

*Primary Examiner*—Robert G. Santos

(74) *Attorney, Agent, or Firm*—Webb Ziesenheim Logsdon Orkin & Hanson, P.C.

(57) ABSTRACT

A stretcher capable of transforming into a stretcher configuration and a wheelchair configuration, which increases the rigidity of its frame structure to facilitate retention of a posture of a patient, enhancing safety and is superior in the operability such that transformation is enabled by one operation. A frame of the stretcher is divided into at least four portions, i.e., an above knee portion (4) constituting a seat portion supporting a femoral region of a patient, a lumbar portion (3) included in a backrest supporting an upper portion of a body of the patient, an armrest portion (6) constituting an armrest, and a below knee portion (5) capable of supporting a lower limb region. The frames constituting the above knee portion (4), the lumbar portion (3), the armrest portion (6) and the below knee portion (5) are rotatably coupled with each other, and the positional relationship between these portions is changed to enable transformation into a stretcher configuration in which a flat mat surface area including the armrest is formed and a wheelchair configuration in which the mat is bent and the armrest is raised up. The patient can be mounted to be moved in either posture of the stretcher configuration or the wheelchair configuration.

27 Claims, 54 Drawing Sheets

U.S. PATENT DOCUMENTS 4,186,456 A * 2/1980 Huempfner ..... 5/428
4,285,541 A * 8/1981 Onishi ..... 297/84
4,632,450 A * 12/1986 Holdt ..... 297/84
4,691,962 A * 9/1987 Holdt ..... 297/84
4,795,214 A * 1/1989 Holdt ..... 297/440.2
4,912,787 A * 4/1990 Bradcovich ..... 5/601
4,949,408 A * 8/1990 Trkla ..... 5/86.1
4,974,905 A * 12/1990 Davis ..... 297/377
5,333,887 A * 8/1994 Luther ..... 280/250.1
5,547,245 A * 8/1996 Knouse ..... 297/85
5,659,910 A * 8/1997 Weiss ..... 5/618
6,154,899 A * 12/2000 Brooke et al. ..... 5/81.1 R
6,185,769 B1 * 2/2001 Larisey, Jr. et al. ..... 5/618 X
6,272,702 B1 * 8/2001 Uchida et al. ..... 5/600
6,499,163 B1 * 12/2002 Stensby ..... 5/618
6,584,629 B2 * 7/2003 Tsuji et al. ..... 5/618
2001/0029629 A1 * 10/2001 Tsuji et al. ..... 5/618
2003/0093863 A1 * 5/2003 Grove ..... 5/618

* cited by examiner

STRETCHER

FIELD OF THE INVENTION

The present invention relates to a stretcher which can be also used as a wheelchair. More particularly, the present invention relates to a frame coupling structure in a stretcher which can change its configuration to a wheelchair, a mechanism for supporting a head or a back of a patient, a lever device which is gripped when pushing by hand for movement, a support structure of a safety bar, and others.

BACKGROUND OF THE INVENTION

There is a stretcher having a back portion which can be raised in accordance with a posture of a stretcher user such as a person in need of nursing case or a patient who finds it difficult to sit up or move by him/herself (they are generically referred to as a "patient" in this specification), or a stretcher which can be transformed into a wheelchair by raising a back portion and bending a leg portion downwards (Japanese patent application laid-open No. 52459-1998). Such a stretcher can be transformed into a wheelchair after transferring a patient who is in a recumbent position from a bed to the stretcher so that the patient can be moved in a sitting posture.

This type of stretcher, however, has various problems such as described below.

As a first problem, there is one concerning a frame coupling structure. That is, a frame of a conventional stretcher is assembled so as to be capable of being bent at parts corresponding to a lumbar or knees by coupling a plurality of pipes by pin and others so that they can swivel without restraint. For example, a right pipe on an upper body side and a right pipe on a lower body side are coupled with a left pipe on the upper body side and a left pipe on the lower body side respectively by different pins so as to be capable of swiveling without restraint. When the frame is constituted by separately coupling the right and left pipes with each other so as to be capable of swiveling in this manner, the torsion is generated in the frame, leading to the insufficient rigidity. Further, since a hole is directly formed to the pipe to insert a pin therethrough, the hole tends to be enlarged due to long-term use so that a bent portion may rattle, which is inferior in the durability.

Moreover, an armrest for preventing a patient from falling off and facilitating a comfortable posture for the patient is needed when the stretcher is transformed into a wheelchair. This requires a troublesome operation such as going to the trouble to attach after transformation into the wheelchair the armrest as an additional member which has been detached in the stretcher configuration or lifting up and fixing the armrest which has been kept down in the stretcher mode, thus resulting in the bad usability. In addition, when transferring a patient from the stretcher to a bed or from the bed to the stretcher, the strength which can withstand a weight of the patient is needed since the weight is also applied to the armrest portion. However, the conventional frame structure is a one-column support structure or a cantilever support structure, and hence stagger may be caused or the sufficient strength may not be obtained.

A second problem relates to stability of a patient during use in the wheelchair configuration. That is, since the patient may not be able to maintain the posture by him/herself, it is necessary to secure stability by firmly supporting the patient's body or head in order to prevent the off balance or tumble of the patient when using the stretcher in the wheelchair configuration. However, in the conventional structure, since the inclination of a seat or a backrest is fixed when transformed into the wheelchair or no mechanism for supporting the body is provided, the patient may tumble down when he/she bends forward if a preferred position as a wheelchair is taken.

A third problem lies in that support of a head of a patient is not taken into consideration in particular in the conventional stretcher. For example, a patient is obliged to keep his/her head low in a flat stretcher consisting of one solid timber mat. This posture increases a blood flow to the head or brings a patient a sense of insecurity that he/she may slide off to the head portion side. Such a trouble may give a sense of discomfort or insecurity to a patient even if the time required for movement is short. Additionally, although a pillow is put on the stretcher in order to appropriately hold the head portion in some cases, the pillow may move to cause the head to slide off or the pillow may be lost, which is inconvenient. If the pillow is fixed to the mat, however, the pillow can be an obstacle for transferring a patient from the bed, which is not preferable. On the other hand, a stretcher having a head support portion provided thereto has been developed, but the head support portion is only partitioned from a portion supporting a part from neck down for the convenience sake, and a patient must take a uniform posture irrespective of his/her physical constitution or symptom. Such a problem is also common to the stretcher which can be transformed into a wheelchair as well as a general stretcher. When it is used as a stretcher, a mat forming a single plane must support the head of a patient. Further, when it is used as a wheelchair, it is hard for the patient to lean his/her head to take a comfortable posture.

A fourth problem relates to movement of a stretcher or transfer of a patent on the stretcher. That is, in a nursing-care system for transferring a patient from a bed to a stretcher or from the stretcher to the bed in a recumbent position, it is considered that, for example, a tool called a transfer bar is used to facilitate transfer of the patient (international patent publication No. WO99/30662).

When transferring a patient from a bed and the like to a stretcher by utilizing this transfer bar, a bracket must be set on the opposite side which is not in contact with the bed of the stretcher so that the transfer bar is rotatably supported. Here, since the bracket for supporting the transfer bar protrudes above the stretcher, it may be an obstacle for allowance or medical attention to a patient or may give annoyance when the bracket is attached. It is desired that the bracket can be detachable with respect to the stretcher.

If the bracket is detached each time, however, attachment and detachment take time, and a place for accommodating the removed bracket is also required. Further, the bracket removed from the stretcher may be lost in some cases. Additionally, when pushing and moving the stretcher, since the stretcher has such a structure as that a frame which is as tall as or lower than a mat surface must be grabbed, a nursing personnel or a caregiver must stoop to push and pull the stretcher, thereby resulting in a burden on the lumbar and the like.

A fifth problem concerns a safety bar provided in order to prevent a patient from falling off. That is, the safety bar must be detachable for transfer, but detaching the safety bar each time for transfer is troublesome and inconvenient. Moreover, storage of the removed safety bar is troublesome and it may be lost. Although a structure such that the safety bar is moved up and down to be retracted can be considered, no fluctuation is made at positions of the safety bar and its support structure in their widthwise directions in this case. Therefore, the safety bar protruding in the side direction from the mat becomes an obstacle to form a gap between the safety bar and the bed and the like when the stretcher is pulled alongside the bed and the like.

SUMMARY OF THE INVENTION

It is, therefore, an object of the present invention to provide a stretcher which has the high frame rigidity and which is superior in the durability. It is another object of the present invention to provide a stretcher which can be transformed into a wheelchair from the stretcher and vice versa by one operation and which can expand a mat surface area in the stretcher configuration. It is still another object of the present invention to provide a stretcher which is superior in stably maintaining the posture of a patient when used as a wheelchair. It is yet another object of the present invention to provide a stretcher which can maintain a head of a patient in an appropriate posture. It is a further object of the present invention to provide a stretcher by which a nursing personnel or a caregiver can take a comfortable posture when he/she pushes and moves the stretcher. It is a still further object of the present invention to provide a stretcher having a bracket supporting a transfer bar. It is a yet another object of the present invention to provide a stretcher by which a safety bar can be set to the side of a mat according to need and retracted to a position which can not be an obstacle for transfer of a patient.

To achieve this aim, the present invention provides a stretcher comprising a cart and a frame which is mounted thereon and supports a mat for putting a patient thereon, wherein the frame is divided into at least four portions, i.e., an above knee portion constituting a seat for supporting a femoral region of a patient, a lumbar portion constituting a backrest for supporting an upper part of a patient's body, an armrest portion constituting an armrest and a below knee portion capable of supporting a lower limb region; the above knee portion, the lumbar portion, the armrest portion and the below knee portion are rotatably coupled with each other; changing the positional relationship of these portions enables transformation into a stretcher configuration in which a flat mat surface are including the armrest portion and the below knee portion is formed and a wheelchair configuration in which the mat is bent and the armrest is raised; and a patient can be mounted to be moved in both the stretcher configuration and the wheelchair configuration. Therefore, it is possible to perform transformation into the stretcher configuration in which an operation for rotating the divided frames rotatably coupled with each other changes an angle of the armrest portion and the above knee portion relative to the lumbar portion, an angle of the above knee portion and the below knee portion and an angle of the below knee portion and the armrest portion, respectively, so that these portions can be arranged on a straight line to form a flat mat surface and into the wheelchair configuration in which the frames are bent and separated from each other to form the seat, the backrest, the armrest and others. In addition, the armrest and a part of supporting calf parts of legs can be used in the wheelchair configuration and they are also used in the stretcher portion, resulting in expanding the mat surface area and improving the usability as a stretcher.

Here, the frame couples a middle part of the lumbar portion and a middle part of the below knee portion with the cart so as to be capable of oscillating without restraint. As seen in a side view, there is constituted a four-node rotation linkage of a parallelogram with a coupled portion between the lumbar portion and the armrest portion, a coupled portion between the armrest portion and the below knee portion, a coupled portion between the below knee portion and the cart, and a coupled portion between the cart and the lumbar portion as four peaks. It is preferable that rotating the lumbar portion around the coupled portion relative to the cart so as to be reclined rearwards crushes the parallelogram so that the four respective portions are arranged on the same plane and, on the other hand, rotating the lumbar portion so as to be drawn up restores the parallelogram so that the armrest portion is upheaved. In this case, when the lumbar portion is tried to be reclined to enter the stretcher mode, the armrest portion is pulled down and the above knee portion is upheaved. At the same time, when the below knee portion is reclined rearwards, the above knee portion, the below knee portion and the lumbar portion constituting the backrest, including the armrest portion, are straightly arranged on a line connecting the two coupled portions relative to the cart and the frame, thereby forming a flat mat surface area. Meanwhile, when entering the wheelchair mode, by only pulling up the lumbar portion, the parallelogram is restored, and the lumbar portion is upheaved substantially horizontally. Therefore, pulling up or attaching the armrest portion does not have to be carried out, in addition to the operation for raising the lumbar portion, and it is possible to transform into the wheelchair.

Further, in the stretcher according to the present invention, the right and left coupled portions of the frames are constituted by one core material piercing one coupled portion and the other coupled portion associated with the former portion and a sleeve which is rotatably fitted into the core material and has the frame fixed thereto. Rotating the sleeve around the core material causes the frame to be bent. Thus, by rotating the sleeve to which the right and left frames are fixed around the core material, the lumbar portion, the above knee portion, the below knee portion and the armrest portion can be bent at the respective coupled portions so that each portion can be pulled up or reclined. Thus, the frames can smoothly transform without involving distortion between the right and left frames. Additionally, since the sleeve comes into contact with the core material on a large surface area, the sleeve is free from a problem of deformation or an enlarged diameter caused due to long-term use, which is superior in the durability without unsteadiness in the coupled portions. That is, the rigidity and the durability of the frame can be improved while assuring the smooth bending operation at each coupled portion.

As to the coupled portions of the frames, it is determined that a value of a total length of all the sleeves fitted in the core material is substantially equal to a value of an entire length of the core material, and it is preferable that a flange member for preventing the sleeve from coming off is attached to the end surface of the core material. In this case, when assembling the frame, by only fitting the sleeve to the core material and then attaching the flange portions to both ends of the core member, a plurality of frame materials can be rotatably coupled with each other without the sleeve coming off. Therefore, the productivity can be improved and the cost can be suppressed. Moreover, the sleeve can be supported by the flange member so that it does not come off the core material. The sleeve can be positioned in the axial direction by only attaching the flange member, thus avoiding unsteadiness in the sleeve.

Further, it is preferable that the frame of the stretcher according to the present invention is provided with a lock mechanism with the four-node rotation linkage of the parallelogram as a fixed link. In this case, changeover to the stretcher configuration or the wheelchair configuration can be enabled by upheaving or reclining the lumbar portion by utilizing deformation of the four-node rotation linkage in the unlocked state of the lock mechanism. When the lock mechanism is locked, the link is fixed in the form at that moment, which avoids deformation of the frame. In other words, the frame can be fixed with an arbitrary shape/angle by using the lock mechanism.

Here, it is preferable that a plurality of the lock mechanisms are provided and they are attached at installation angles different from each other. Although the rigidity of the lock mechanism for fixing the angle of the frame tends to be weak when the lock mechanism is fully extended, providing the plurality of the lock mechanisms at different attachment angles can prevent all the lock mechanisms from being fully extended at the same time. Further, the sufficient rigidity for constantly locking the frame can be assured irrespective of the angle of the frame.

In addition, the stretcher according to the present invention includes an angle adjustment mechanism which can incline the entire frame with respect to the cart between the frame and the cart. In this case, by changing an inclination angle of the entire frame with respect to the cart by using the angle adjustment mechanism, the entire frame can be inclined, and the seat, the backrest and the like can be reclined without changing an angle between the seat and the backrest and the like in the wheelchair configuration. Therefore, the posture of a patient can be stably maintained while preventing the patient from tumbling forward or collapsing his/her posture. Furthermore, by returning the angle of the frame to the horizontal state, or by inclining it to the front lower side, a patient's action to get on and off can be facilitated.

Here, the angle adjustment mechanism preferably includes: a support member which is provided between the frame and the cart to support the frame and coupled with the cart so as to be capable of oscillating without restraint; and a tilt angle variable mechanism which can fix the support member capable of oscillating to the cart at an arbitrary position. In this case, by releasing restriction of the support member by the tilt angle variable mechanism, the support member can be swiveled around the support axis between the support member and the cart in an arbitrary direction so that the entire frame can be tilted. Thus, by fixing the support member by the tilt angle variable mechanism at a maximum tilt position or an arbitrary tilt position up to the maximum tilt position, e.g., a slightly retroverted position, that tilting can maintain the tilt angle of the entire frame constant.

In addition, it is preferable that the angle adjustment mechanism is a gas spring with a lock mechanism. In this case, when unlocking the support member by releasing the lock mechanism of the tilt angle variable mechanism, since the force for pushing back the support member to its original position is imparted by an accumulated gas pressure of a gas spring at the time of backward tilting of the frame, it is possible to return the entire frame to its original position even if a patient is in a sitting position. Locking of the tilt angle variable mechanism can maintain that tilt.

Further, in the stretcher according to the present invention, it is preferable that a portion for supporting the frame of the cart and the lock mechanism are arranged against both the right and left sides of the cart and a bag accommodating space is formed between the frame and the cart. In this case, a tray or a basket can be set in the bag accommodating space so that nursing care goods can be mounted to be carried.

Moreover, in the stretcher according to the present invention, a headrest is provided at a portion of the frame for supporting a head of a patient. With this structure, the patient's head can be maintained in an appropriate posture at a preferable height in the stretcher. Therefore, the patient can take a comfortable posture such that his/her head can be held in a state which does not burden his/her body in either a recumbent posture or a sitting posture.

Here, the headrest required for the stretcher becomes flat when transferring a patient so as not to be an obstacle for transfer. On the other hand, when a patient lies face up on the stretcher or sits on the stretcher in the wheelchair mode, it is preferable that the height or the angle of the headrest can be finely adjusted in accordance with a posture, a symptom or a physical construction of each patient. Therefore, the present inventor considered that the height and the angle of the headrest can be easily and rapidly adjusted and a head of each patient having a different physical construction or symptom can be supported at a preferable position. In order to meet such a demand, the headrest of the stretcher according to the present invention is adjustably attached to the frame by a first bracket fixed to the frame, a second bracket fixed to the headrest in such a manner that at least a part of it overlaps on the first bracket, and coupling means which pierces the first and second brackets and allows or prohibits relative rotation of both brackets; a through hole of any one bracket which the coupling means pierces is determined as a long hole elongated in a direction vertical to the frame so that the headrest can move close to or away from the frame within a stroke range of the long hole; a shoulder portion is formed to one of the first or second bracket; and a restriction pin which comes into contact with the shoulder portion only when the headrest moves close to the frame to avoid relative rotation between the first and second brackets is provided to the other.

Therefore, the headrest is retracted to a position which is flush with or parallel with the mat surface (this position will be referred to as a "headrest retracted position" hereunder) to be fixed when a patient transfers and, on the other hand, the coupling means is loosened to be movable so that the height of the headrest can be adjusted within a range of the long hole. Further, when the headrest is moved close to or away from the frame to change its height from the headrest retracted position, the restriction pin of one bracket which has been in contact with the shoulder portion of the other bracket moves away from that shoulder portion. Thus, restriction to the relative rotation between the first and second brackets can be canceled to enable tilting. Accordingly, by adjusting the height and the tilt and fastening the coupling means when desired height and tilt are obtained, the headrest can be fixed in a preferable state in accordance with a posture or a symptom of a patient and a head of the patient can be maintained in an appropriate posture.

Moreover, when the restriction pin is brought into contact with the shoulder portion of one bracket, the headrest can be positioned to the headrest retracted position. Therefore, when a patient again transfers from the stretcher to the bed, the headrest can be easily and rapidly returned to its original state flush with or parallel with the headrest retracted position by only lowering the headrest. Consequently, this can not be an obstacle for transfer of a patient.

In addition, it is preferable that at least a pair of friction plates are provided between the first and second brackets. In this case, since a contact area can be enlarged to increase the friction by using the brackets and the friction plates, the headrest can be further assuredly fixed.

Furthermore, it is preferable that at least one of a left side portion or a right side portion of the headrest can be bent toward a head of the patient. In this case, a direction or a position of a patient's head on the headrest can be maintained in one direction or at a fixed position in the stretcher configuration, and his/her head can be fixed, thereby taking a posture in accordance with a symptom and the like of the patient. Also, in the wheelchair configuration, it is possible to take a comfortable posture by holding his/her head without being tilted.

The headrest according to the present invention divides a region requiring deformation of a core material of a support member supporting a load or at least a support surface of the support member itself and couples the divided core materials or support members with each other by a flexible mechanism, the flexible mechanism comprising: a fixed side member having a plurality of overlapping plates arranged in parallel at intervals; a tilted side member having a plurality of overlapping plates which alternately overlap on the overlapping plates of the fixed side member; a coupling shaft which pierces a overlapping position of each overlapping plate of the fixed side member and the tilted side member to fasten the overlapping plates; and impetus giving means for giving an impetus to the overlapping plates in an overlapping direction. The tilted side member rotates around the coupling shaft to give an angle to a part of the core material and the frictional force at the contact part of both types of the overlapping plates is utilized to maintain that angle so that a shape of the support surface is retained.

In case of this headrest mechanism, the frictional force generated in an overlapping area of the overlapping plates becomes a resistance force for the mutual movement of the divided support members coupled with each other through the overlapping plates and serves as a holding force for maintaining the mechanism for supporting a head at a fixed angle. Therefore, applying an external force above the holding force can incline the support member to a desired angle to deform a shape of the support surface of the headrest. Further, this deformation can be maintained by eliminating the external force at that position unless the external force above the holding force again acts. Since the overlapping plates are constantly fastened by the coupling shaft and also pushed by the impetus giving means, reduction in the frictional force due to slack can be avoided.

Additionally, it is preferable that the impetus giving means takes a form of, e.g., a spring member arranged on the same axis as the coupling shaft. As a result, the impetus giving means can be a flexible mechanism formed integrally with the coupling shaft, and a desired frictional force can be obtained from the overlapping plates. It is to be noted that a helical compression spring or a coned disc spring can be preferably used as the spring member.

Moreover, it is preferable that an impetus of the impetus giving means can be adjustable and the frictional force at the overlapping portion of the overlapping plates is variable. In such a case, by changing the frictional force by adjusting the impetus, a nursing personnel, a caregiver or a patient himself/herself can obtain a flexural strength usable for him/herself in accordance with the state of the patient, e.g., a symptom, a weight or a physical construction. In addition, the headrest can be firmly fixed in an arbitrary shape by fastening using this adjusting means. In this case, if means for adjusting the impetus is exposed to the outside, a user can arbitrarily adjust the impetus according to need to obtain a force required for deformation of the support member with a desired strength.

Here, it is preferable that a part of plural overlapping plates of the headrest is supported by the fixed side member or the tilted side member so as to be capable of slightly moving in the overlapping direction. In such a case, since a gap can be adjusted when alternately inserting and superimposing the overlapping plates of the fixed side member and those of the tilted side member, an overlapping operation during assembling can be facilitated.

It is preferable for the headrest to have such a shape as that its width is narrowed toward a parietal region. In this case, a handle portion can be grabbed while maintaining a body support function of the headrest, and the handle portion can be accommodated in a headrest side portion, thereby minimizing the stretcher when the handle is not used.

The frame of the stretcher according to the present invention comprises: a bracket portion capable of taking up a sheet on which a patient is lying and rotatably supporting a transfer bar for transferring the patient from a bed to the stretcher together with the sheet in a recumbent state; rotating shaft portion having an L shape for supporting the bracket portion; and a displacement fixing means which rotatably couples the shaft portion with the frame on the same axis and fixes them so as not to rotate by fitting at a predetermined rotating position. By rotating the L-shaped shaft portion by using the displacement fixing means so that the bracket portion is switched between a bar support position at which the bracket portion is set upright and a transfer bar can be supported and a retracted position at which the bracket portion is turned down and which does not obstruct a patient to get on and off the stretcher, and the bracket portion can be fixed at each position.

Therefore, when transferring a patient from a bed to the stretcher while keeping the recumbent position, upheaving the bracket portion to be fixed at the bar support position can take up a sheet spread under the patient by attaching the transfer bar to the bracket portion. At this time, the patient can be pulled together with the sheet to be transferred to the stretcher. Further, when moving the patient in the stretcher mode or the wheelchair mode, the bracket portion can be retracted at a position under the mat surface so as not be an obstacle by fixing the bracket portion at a retracted position (this retracted position will be distinguished from the headrest retracted position and referred to as a "bracket retracted position" in this specification), and no annoying feeling can be given. Also, since the bracket portion remains attached to the lever device when the bracket portion is not used, loss of the bracket portion or any damage to the bracket portion after removed can be avoided.

Furthermore, the frame of the stretcher according to the present invention comprises: a lever portion which is gripped by a nursing personnel or a caregiver when pushing the stretcher by hand; and displacement fixing means which rotatably couples the lever portion with the frame on the same axis and fixes them by fitting at a predetermined rotational position so as not to allow rotation. By rotating the lever portion by the displacement fixing means, and changeover is made between a handle position at which the lever portion is upheaved and the nursing personnel or the caregiver can grab the lever portion when pushing the stretcher by hand and a retracted position at which the lever portion is moved down so as not to obstruct a patient to get on and off the stretcher, and the lever portion can be fixed at each position.

In this case, when the lever portion is raised to be fixed at the handle position, the nursing personnel or the caregiver can grab the raised lever portion to push the stretcher. Therefore, since the nursing personnel or the caregiver can push or pull the stretcher in a comfortable posture without his/her body bent forward, which facilitates movement. When the lever portion is fixed at the lever retracted position, since the lever portion becomes lower than the mat surface, it is possible to prevent the lever portion from being an obstacle for a patient to get on and off the stretcher.

Moreover, it is preferable that the lever portion is provided with a bracket portion capable of taking up a sheet on which a patient is lying and rotatably supporting the transfer bar for transferring the patient from a bed to the stretcher together with the sheet in the recumbent state. In this case, since the transfer bar can be supported by the bracket portion, the sheet on which the patient is lying can be taken up to transfer the patient from the bed to the stretcher. In addition, since the bracket portion remains attached to the lever portion even if the bracket portion is not used, which can avoid loss of the bracket portion or any damage to the bracket portion after removal.

Additionally, in the stretcher according to the present invention, second displacement means which rotatably couples the lever portion with the bracket portion on the same axis and fixes them by fitting at a predetermined rotational position so as not to allow rotation is provided between the lever portion and the bracket portion. The bracket portion can be placed at a bar support position at which the transfer bar can be supported by rotating the bracket portion with respect to the lever portion by using the second displacement fixing means when the lever portion is positioned at the handle position, and the bracket portion can be placed at a retracted position by rotating the bracket portion with respect to the lever portion by using the second displacement fixing means when the lever portion is positioned at the retracted position, thereby fixing the bracket portion at each position.

In such a case, the bracket portion can be placed at the bar support position to use the transfer bar by setting upright the lever portion at the handle position and rotating the bracket portion. Further, when accommodating the bracket portion and the lever portion, the bracket portion and the lever portion are rotated to place the lever portion at the lever retracted position. As a result, the bracket portion can be retracted facedown, and hence the lever portion and the bracket portion do not protrude above the mat as well as the side of the same. Therefore, the stretcher can be appressed against the bed and the like to transfer a patient.

Moreover, it is preferable that a grip portion is formed at an end of the lever portion or an end of the bracket portion. In this case, since a nursing personnel or a caregiver can hold the grip portion to push the stretcher, the stretcher can be easily pushed with easy gripping and facilitated application of a force.

Here, the displacement fixing means provided between the frame and the lever portion or the bracket portion or between the lever portion and the bracket portion comprises: impetus giving means which can move a first member and a second member close to or away from each other at the same axis, couples them so as to enable relative rotation and gives an impetus in a direction for moving the first member and the second member close to each other; a plurality of notches formed at an end surface of on one of the first member and the second member; and an engagement protrusion formed to the other of the first member and the second member to be fitted to each notch. Fitting the engagement protrusion in the notch restricts the relative rotation of the first member and the second member and, on the other hand, releasing fitting formed between the notch and the engagement protrusion allows the relative rotation of the first member and the second member.

Therefore, when the engagement protrusion is selectively fitted to the notch, the first member and the second member are coupled with each other so as not to rotate in the circumferential direction. When the first member is pulled away from the second member, engagement is canceled to allow the relative rotation of the first member and the second member. The notch is preferably formed on the inner side of the first member or the second member to prevent clothes or fingers of a user from being caught when the engagement protrusion is fitted to the notch. The present invention is not, however, restricted to this structure, and the notch may reach the peripheral surface of one of the first member and the second member and a cover may be put on the notch from the outside. In such a case, since the cover is put on the notch from the outside, clothes or fingers of a user can be likewise prevented from being accidentally caught between the notch and the engagement protrusion.

In addition, in the stretcher according to the present invention, a bracket is provided on the side part of the armrest portion of the frame; to the bracket is rotatably attached a safety bar which can rotate between a use position at which the safety bar is raised above the mat to prevent a patient from falling off and a retracted position at which the safety bar is retracted below the mat so as not to disturb transfer of a patient; and fixing means for disabling rotation of the safety bar at the use position is provided between the bracket and the safety bar. Consequently, when it is required to prevent a patient from falling off, the safety bar can be set by only rotating it. Furthermore, when the safety bar is unnecessary, it can be retracted below the mat, which can not be an obstacle. Additionally, the safety bar raised above the mat can be fixed so as not to rotate by the fixing means, and the safety bar can not turn the other way round to the retracted position thereof even if an external force is applied. Therefore, a patient can be prevented from falling off. Since the safety bar is integrally provided to the side part of the frame, which can eliminate such a problem as that the safety bar may be lost when removed.

As the fixing means for the safety bar, a pushing pin which is engaged with a concave portion formed to one of the safety bar and the bracket and a concave portion formed to the other and constantly given an impetus is preferred. In this case, engagement between the concave portion and the pushing pin can be released by only pulling the pin, thereby enabling rotation of the safety bar. When the safety bar is rotated and a position of the pushing pin is matched with that of the concave portion, the pushing pin is automatically inserted to be so locked as not to be rotated. At this time, if a shallow recession to which an end of the push-put pin can be slightly inserted is formed on the opposed side of the concave portion, the safety bar at the retracted position does not become staggery, and the pushing pin is automatically moved away from the recession to be rotatable without restraint when trying to rotate the safety bar.

An offset is given to the rotating shaft portion of the safety bar supported by the bracket. With this offset, the safety bar set at the use position is raised up on the outer side so as to project from the side portion of the stretcher, and the safety bar placed at the retracted position is retracted toward the inner side from the side portion of the stretcher. The safety bar in this case is retracted so as to be hidden under the mat so that the stretcher can be appressed against the bed and the like without a gap therebetween. On the other hand, when the safety bar is used, since it is stood up so as to project toward the outer side from the mat, the mat surface can be widely used.

In addition, the safety bar is set in such a manner that either the brackets or the rotating shaft portions of the safety bar fitted in the brackets are opposed to each other and the other members are arranged in the back-to-back direction, and the safety bar is supported in the fixed state disabling movement in the axial direction after fitting the safety bar to the bracket. Therefore, the safety bar is allowed to only rotate and does not move in the axial direction.

It is preferable that the safety bar is assembled in the frame by attaching the bracket to the frame after the bracket is fitted to the rotating shaft portion of the safety bar. According to this method, it is possible to prevent the safety bar from moving in the axial direction after assembling irrespective of a special assembling method or members.

BRIEF DESCRIPTION OF THE DRAWINGS

FIG. 17 is a side view of the state that the stretcher is transformed into a wheelchair configuration;

FIG. 18 is a side view showing the state during transformation of the frame from the wheelchair configuration to the stretcher configuration;

FIG. 19 is a side view showing the stretcher configuration of the frame;

FIG. 20 is a plane view showing the stretcher configuration of the frame;

FIG. 21 is a plane view showing the cart supporting the frame;

FIG. 22 is a side view showing the cart supporting the frame;

FIG. 23 is a side view showing a modification of the cart supporting the frame;

FIG. 24 is a plane view showing a modification of the cart supporting the frame;

DETAILED DESCRIPTION OF THE EMBODIMENTS

Figure 1:
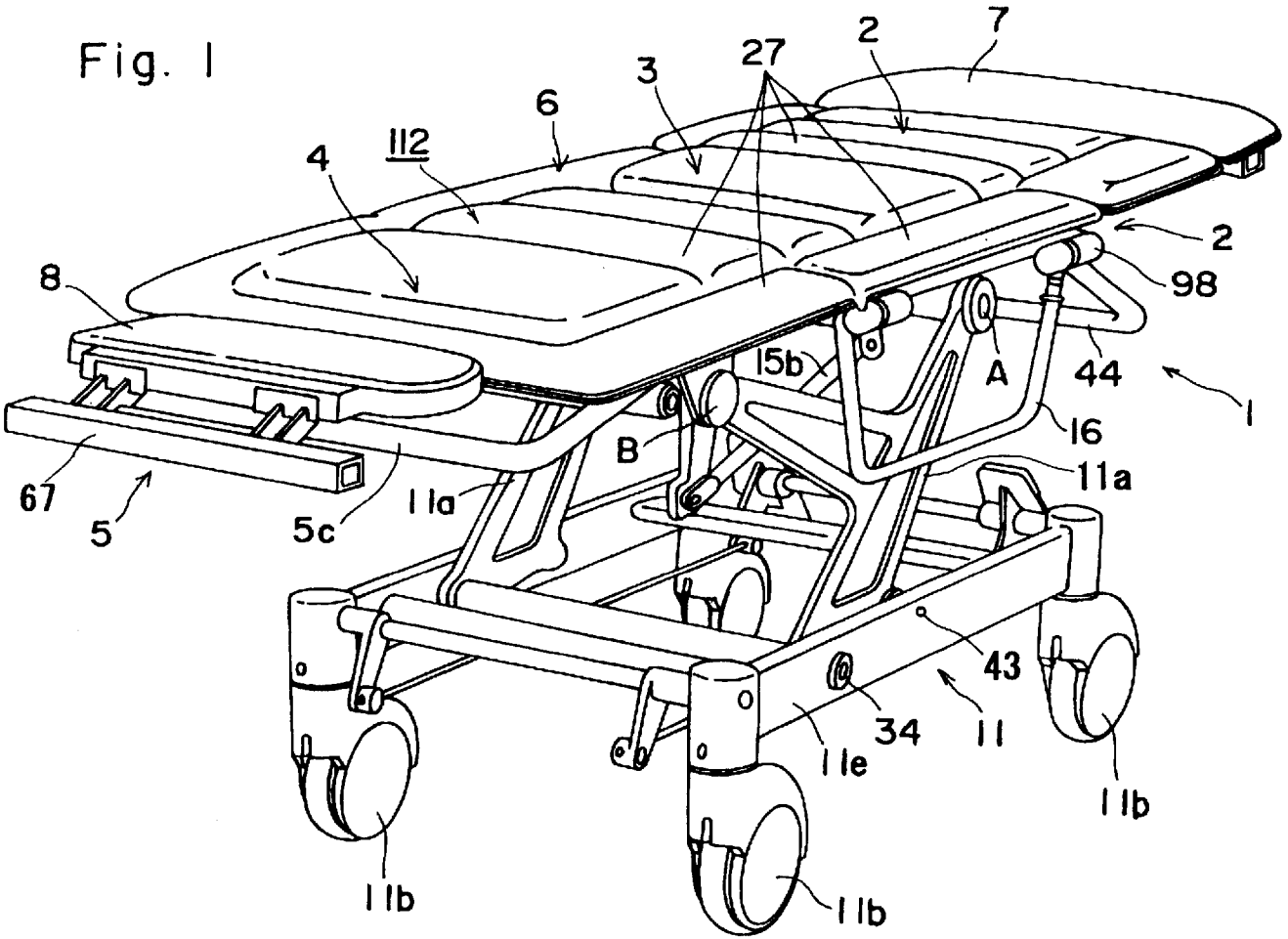
FIG. 1 is a perspective view showing an embodiment of a stretcher according to the present invention in a stretcher configuration.

The structure of the present invention will now be described in detail hereinafter based on an illustrative embodiment.

FIGS. 1 to 44 show an embodiment of a stretcher according to the present invention. The stretcher of this embodiment can be transformed into a stretcher configuration having a mat 27 being flat and a wheelchair configuration having the mat 27 being bent so that a patient can be mounted thereon to be moved in either the recumbent state or the sitting state. In this embodiment, in order to enable transformation, a framework is constituted by a frame 1 consisting of pipes assembled in the bendable manner as shown in FIG. 10, and the mat 27 is attached thereon. Although the frame 1 is not restricted to a specific material, the frame 1 consisting of, for example, a light alloy can provide a strength required for the stretcher and reduce the weight thereof. It is to be noted that the frame 1 is not necessarily restricted to the pipes and may be constituted by links.

The mat 27 has a structure such that, for example, a cushion material is supported by a core material and both materials are covered with a covering material. Here, although the mat 27 constitutes one surface in the stretcher configuration, it is divided into three portions, i.e., forming a backrest, a seat and an armrest, and a part of legs (portion supporting calves of a below knee portion 5). In this embodiment, the mat 27 is constituted by covering the triparted core material and the cushion material with one covering material so as to be coupled with each other in the bendable manner. Here, portions corresponding to the backrest (a back portion 2 and a lumbar portion 3) and the seat (an above knee portion 4) are sewed together, and the armrest (an armrest portion 6) and a portion supporting a the calves of the below knee portion 5 are, separated from the lumbar portion 3 and the above knee portion 4 to be sewed together, thereby forming a bendable U shape. It is to be noted that the frame 1 is mounted on a cart 11 having four casters 11*b*.

As shown in, e.g., FIG. 10, the frame 1 is divided into the backrest consisting of the back portion 2 and the lumbar portion 3, the above knee portion 4 constituting the seat, the below knee portion 5 and the armrest portion 6 and bendable at a plurality of coupling positions 12, 13 and 14 constituting turning pairs. Further, since the length of a node of the frame 1 at a sliding position of a sleeve 29 and a U-shaped pipe 4*a* constituting a sliding pair can be changed, the frame 1 can be transformed from the wheelchair configuration into the stretcher configuration or vice versa.

Figure 25:
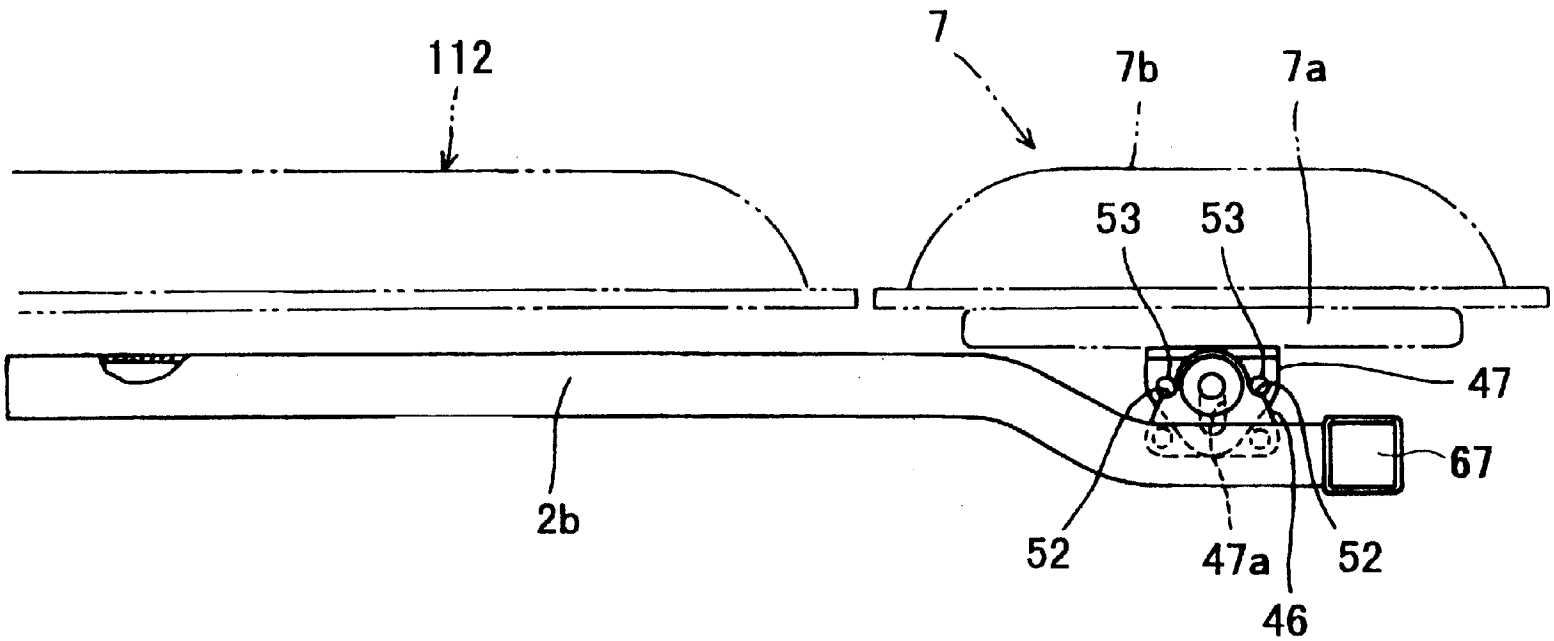
FIG. 25 is a side view showing a circumference of a headrest of the stretcher.

As mainly shown in FIG. 10 and FIG. 25, the back portion 2 is constituted by each vertical pipe having a telescopic type extendable structure consisting of two pipes 2*a* and 2*b* to which a headrest 7 is attached, and a two plates 2*d* for transversely connecting the respective pipes 2*a* and 2*b*. The lumbar portion 3 is constituted by two vertical pipes 3*a* and a transverse pipe 3*b* for connecting these vertical pipes 3*a*. The above knee portion 4 is made up of the U-shaped pipe 4*a* bent in the U shape. The below knee portion 5 is constituted by each vertical pipe having a telescopic type extendable structure consisting of two expandable pipes 5*a* and 5*b* to which a footrest 8 can be attached by a hinge and the like in the collapsible manner, two transverse pipes 5*d* for transversely connecting the respective pipes 5*a* and 5*b*, a sleeve 28, and a U-shaped pipe 5*c* which supports the pipe 5*a* from the lower side and is fixed on a sleeve 56 arranged on the same axis as the sleeve 28. In the lower frame structure, the pipes 2*a* and 2*b* supporting the headrest 7 and the pipes 5*a* and 5*b* supporting the footrest 8 both have the telescopic type extendable structure, and positions of the headrest 7 and the footrest 8 can be adjusted by extension of each pipe. Respective positioning devices 106 and 107 are provided between the two extendable pipes 2*a* and 2*b* and between the pipes 5*a* and 5*b* so that extension of the respective pipes 2*a*, 2*b* and 5*a*, 5*b* is fixed at arbitrary positions. The respective positioning devices 106 and 107 have such a structure as that, for example, a plurality of friction plates attached to one pipe and a plurality of friction plates attached to the other pipe are alternately superimposed each other and fastening screws 108 and 109 piercing these plates sandwich these plates, thereby fixing them by using the frictional force. Incidentally, as shown in FIGS. 17 to 20, in the frame 1, the vertical pipe supporting the headrest of the back portion 2 does not have the telescopic type extendable structure but may be constituted by one straight U-shaped vertical pipe 2*e*, and the vertical pipe 2*e* and the pipe 3*a* of the lumbar portion 3 may be fixed to the same sleeve 33 by welding and the like. Similarly, the pipe supporting the footrest 8 of the below knee portion 5 does not have the telescopic type extendable structure but may be constituted by one straight U-shaped vertical pipe 5*e*, and the pipe 5*e* may be fixed to the sleeve 28 by welding and the like. This only simplifies the frame structure but does not substantially change the present invention. It is to be noted that illustration of the mat 27 is omitted in FIGS. 17 to 20 for facilitating explanation of the frame.

The armrest portion 6 is made up of vertical pipes 6*a* each of which is provided to the right and left sides. Brackets 9 and 10 are fixed to the transverse pipe 3*b* of the lumbar portion 3 and the U-shaped pipe 5*c* of the below knee portion 5. By rotatably connecting the brackets 9 and 10 to a support member 11 a of the cart 11, the entire frame 1 can be supported on the cart 1. The backrest (constituted by the back portion 2 and the lumbar portion 3) and the armrest portion 6 are connected at a first coupling position 12 in the bendable manner. Additionally, the lumbar portion 3 and the above knee portion 4 are coupled at a second coupling position 13 in the bendable manner. Furthermore, the vertical pipe 6*a* of the armrest portion 6 and the U-shaped pipe 5*c* of the below knee portion 5 are coupled by a joint as the fourth coupling position 14 in the bendable manner. Moreover, a safety bar 16 for preventing falling off is attached to the vertical pipe 6*a* of the armrest portion 6 so as to be capable of rotating around a rotating shaft parallel with the pipe 6*a* in the vertical direction.

According to the frame 1 having the above-described structure, it is assumed that a center of oscillation of the lumbar portion 3 relative to We a support member 11*a* forming a part of the cart 11 is determined as a supporting point A and a center of oscillation of the U-shaped pipe 5*c* of the below knee portion 5 relative to the support member 11*a* is determined as a supporting point B. Then, the frame 1 can oscillate around the supporting points A and B to be transformed into the wheelchair configuration. That is, a four-node rotation linkage of a parallelogram is formed using the first coupling position 12 of the lumbar portion 3 and the armrest portion 6, the fourth coupling position 14 of the armrest portion 6 and the below knee portion 5, a coupling position B of the below knee portion 5 and the cart 11, and a coupling position A of the cart 11 and the lumbar portion 3 as four peaks. When the lumbar portion 3 is rotated around the coupling positions A and B as the supporting points rearnvards so as to be reclined, the parallelogram is crushed and the four coupling positions 12, 14, A and B are arranged on the same plane. On the other hand, when the lumbar portion 3 is rotated frontward so as to be drawn up, the parallelogram is recovered and the armrest portion 6 is lifted up. Further, there are provided first and second lock devices 15*a* and 15*b* as lock mechanisms which fix an angle/a state of the frame to be maintained in a fixed shape with the parallel four-node rotation linkage as a fixed linkage.

Figure 11:
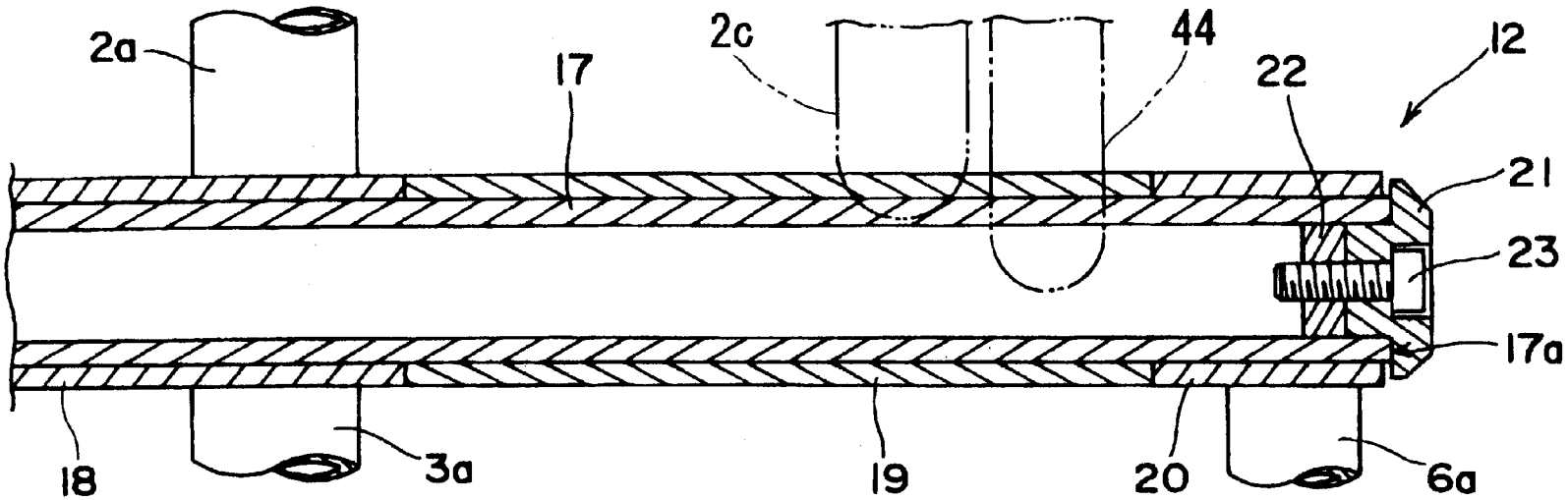
FIG. 11 is a cross-sectional view showing an enlarged frame coupling structure according to the present invention.
Figure 12:
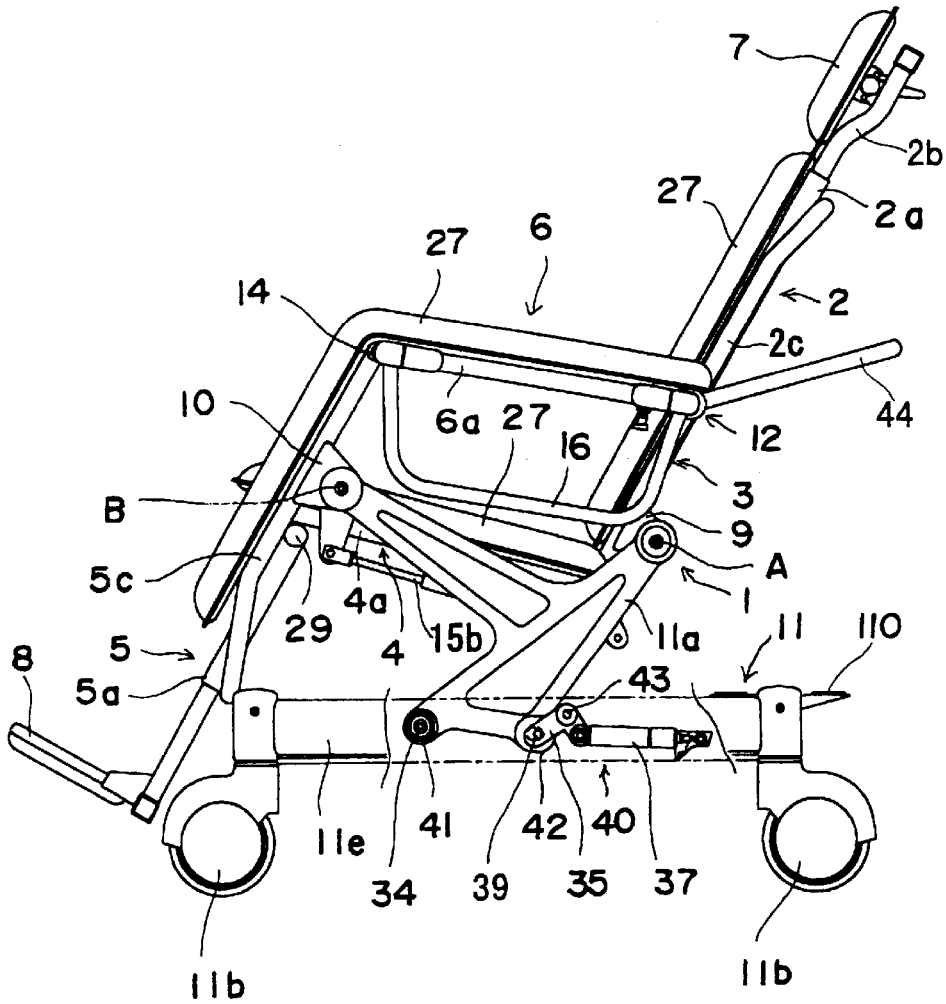
FIG. 12 is a side view showing a state where the frame is transformed in to the wheelchair configuration and tilted rearwards.

The coupling structure of the frame 1 constructed as described above will now be explained in detail based on an example of the first coupling position 12 shown in FIG. 11.

At the first coupling position 12, one first sleeve 18, two second sleeves 19 and two third sleeves 20 are provided on the same axis as one core material 17. Further, the first sleeve 18 is provided in the center of the core material 17, and the second sleeves 19 are provided on both sides of the first sleeve 18. Also, the third sleeves 20 are arranged on both sides of the second sleeves 19. The back portion 2 and the lumbar portion 3 are fixed to the first sleeve 18; a pipe 2*c* to which a push handle 44 is attached when used in the wheelchair mode and which forms a part of the back portion 2 is fixed to the second sleeve 19; and a vertical pipe 6*a* of the armrest portion 6 is fixed to the third sleeve 20. Here, the pipes 2*c* and 2*a* are welded at the upper ends and form the back portion 2 as a whole. A total length of all the sleeves 18 to 20 is substantially equal to the entire length of the core material 17. In this embodiment, a total length of all the sleeves 18 to 20 is slightly shorter than the entire length of the core material 17 to smooth rotations of the sleeves 18 to 20. It is to be noted that the pipes 2*a*, 2*c*, 3*a* and the handle 44 may be fixed to one sleeve coupling the sleeves 18 and 19 at predetermined angles in some cases.

The core material 17 is composed of, for example, a pipe (which will be referred to as a core pipe hereinafter), and flange members 21 for preventing the sleeves 18 to 20 from coming off are attached to both end surfaces 17*a* of the core material 17. That is, a nut 22 is plug-welded to the inner peripheral surface of the end portion of the core pipe 17. After fitting the flange member 21 to the end surface 17*a* of the core pipe 17, when a bolt 23 is inserted into the flange member 21 to be fastened to the nut 22, the flange member 21 is fixed. The flange member 21 is molded so as to have a diameter slightly larger than that of the core pipe 17 and functions as a stopper for preventing the sleeves 17 to 20 from coming off.

Since the sleeves 18 to 20 are rotatably fitted to the core pipe 17, the right and left pipes 2*a* and 3*a* of the backrest which are arranged in alignment with the sleeve 18 to be integrated by welding, the pipe 2*c* on the sleeve 19 which is welded to the pipe 2*a*, and the pipe 6*a* of the armrest portion 6 rotate around the core pipe 17. Consequently, the backrest consisting of the back portion 2 and the lumbar portion 3 and the armrest portion 6 can be bent on the same axis. Here, since the sleeves 18 to 20 are designed to rotate around the core pipe 17, the backrest and the armrest can be smoothly bent. Moreover, since the sleeves 18 to 20 come into contact with the core pipe 17 in a wide area, expansion of the diameter or deformation hardly occurs even if the bending operation is repeatedly carried out, and unsteadiness in the joint is rarely produced, thereby being superior in the durability. In addition, the core pipe 17 pierces the first coupling position 12 to couple the right pipes 2*a*, 3*a* and 6*a* with the left pipes 2*a*, 3*a* and 6*a*, and the torsional rigidity of the first coupling position 12 can be increased to avoid deformation of the frame 1 such as twisting. In particular, the core pipe 17 having a relatively large diameter can be used, the rigidity required for the frame 1 can be readily assured. Although description of the frame coupling structure is mainly given on an application which can be transformed into the wheelchair and the stretcher, the frame coupling structure can be also applied to the frame structure of the stretcher or the wheelchair which does not transform.

The second coupling position 13 and the third coupling position 14 have the structure similar to that of the first coupling position 12 and can be bent. That is, although not shown, one core pipe also pierces the right and left coupling positions of the frame 1 in the second coupling position 13, and a sleeve 24 to which the pipe 3*a* of the lumbar portion 3 is fixed and a sleeve 25 to which the U-shaped pipe 4*a* of the above knee portion 4 is fixed are rotatably fitted to this core pipe. Therefore, as similar to the first coupling position 12, bending is smoothly carried out at the second coupling position 13, the durability and the rigidity are also excellent. Further, to the one end of the core pipe is also rotatably fitted a sleeve 26 to which a first lock device 15*a* is rotatably attached. Additionally, the sleeve 26 having an extended portion 26*a* for rotatably attaching a second lock device 15*b* is fixed to the other end of the core pipe so as not to rotate by utilizing, e.g., fitting of a hexagon socket and a hexagon shaft portion relative to the core pipe. The core pipe and the sleeve 24 are integrated with each other by, e.g., a vis piercing in a radial direction to cause the sleeve 24 and the sleeve 26 having the extended portion 26*a* to which the second lock device 15*b* is attached to integrally rotate through the core pipe.

Sleeves 28 and 29 of the below knee portion 5 and a sleeve 56 are, as similar to the first and second coupling positions 12 and 13, rotatably fitted to the core pipe to constitute a third coupling position 30. A pipe 5*a* is fixed to the sleeve 28 by welding and the like and can be upwardly bent with respect to the U-shaped pipe 5*c*. Additionally, the U-shaped pipe 5*c* is welded to the sleeve 56 to support the pipe 5*a* through the core pipe. It is to be noted that an end of a U-shaped pipe 4*a* of the above knee portion 4 forming the seat is mounted to the sleeve 29 to constitute a sliding pair, thereby supporting the U-shaped pipe 4*a*.

Figure 8:
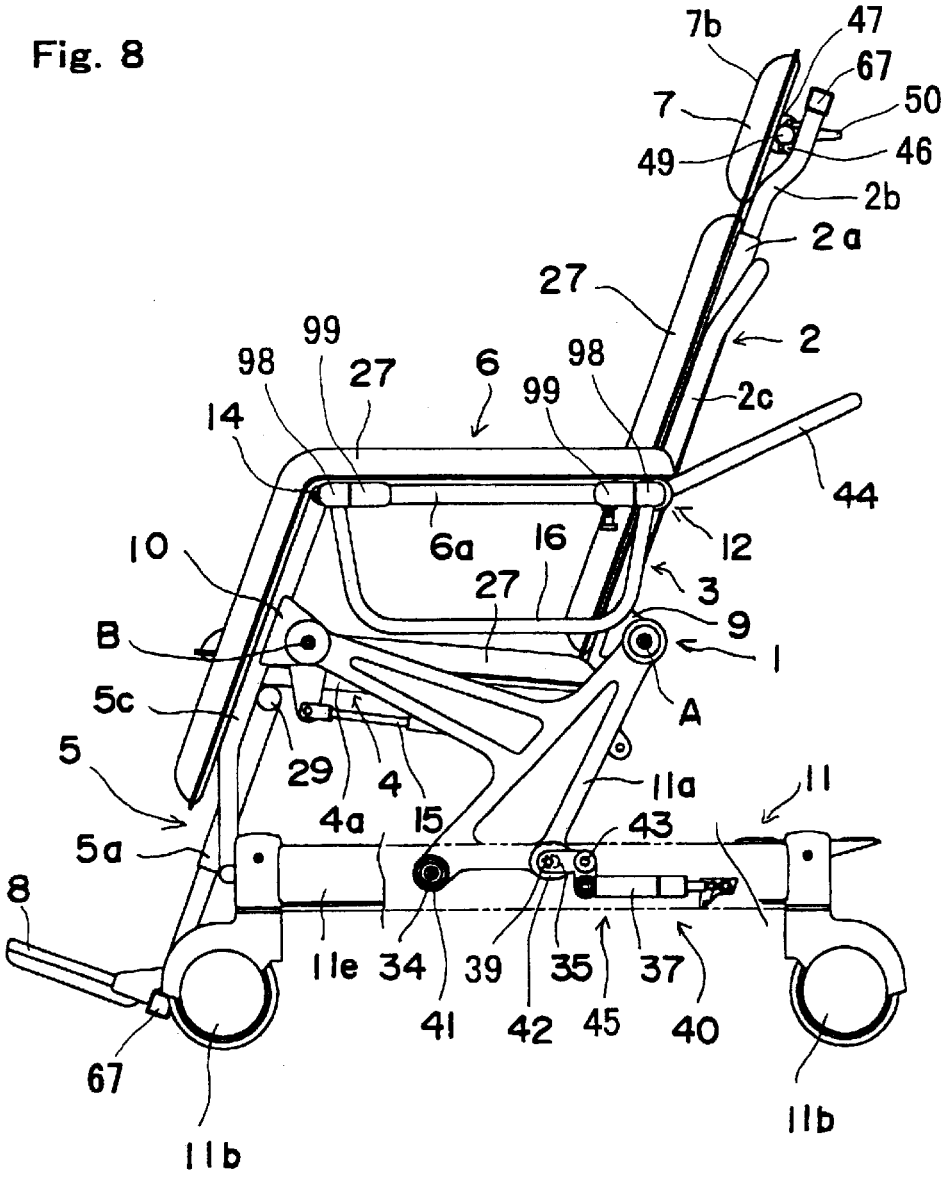
FIG. 8 is a side view showing the frame transformed into a wheelchair configuration.

The frame 1 having the above-described structure is mounted on the cart 11 so as to be capable of being inclined while maintaining the frame shape. For example, as shown in FIG. 8, the frame 1 is mounted on the cart 11 through an angle adjustment mechanism 40 made up of a support member 11*a* attached to the cart 11 so as to be capable of oscillating and an tilt angle variable mechanism 45 which can fix the support member 11*a* to the cart 11 at an arbitrary position. The support member 11*a* is coupled with the two brackets 9 and 10 of the frame 1 to constitute one node of a four-node rotation linkage having two supporting points A and B formed on both ends thereof, and inclining the support member 11*a* tilts one node of the four-node rotation linkage to further tilt the frame 1 as a whole.

Figure 16:
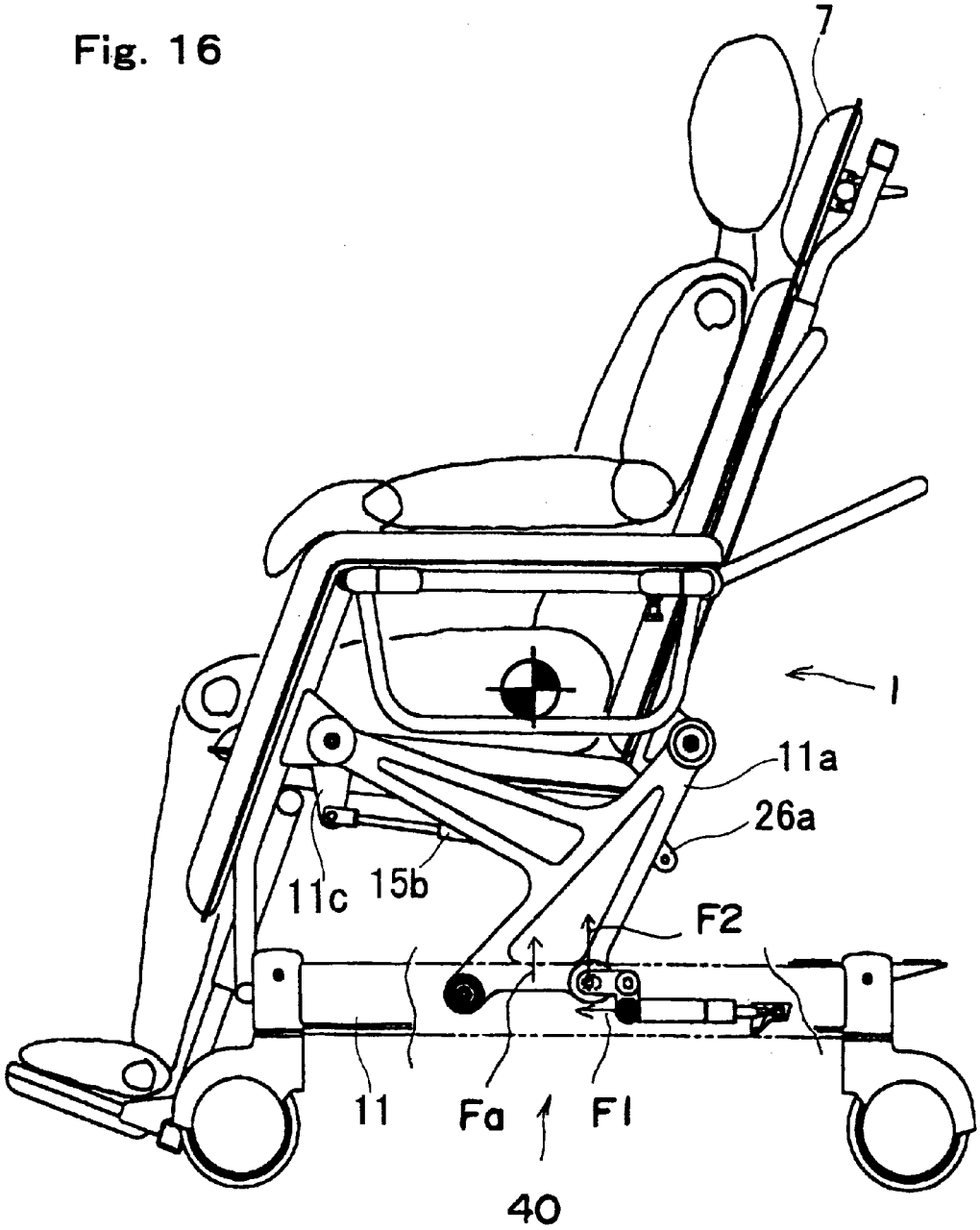
FIG. 16 is a side view of the frame showing the positional relationship between a front side support position and a rear side support position of the angle adjustment mechanism.

In this embodiment, the angle adjustment mechanism 40, as shown in FIGS. 12 to 16 in detail, couples a support position 41 of the support member 11*a* on the lower front side with a side member 11*e* of the cart 11 by a support shaft 34 so as to be capable of oscillating and supports a support position 42 of a support member 11*a* on the lower rear side by the angle variable mechanism 45 so that the support member 11*a* having the support shaft 34 as its center can oscillate in the front-and-back direction. Here, as shown in FIG. 16, the front support position 41 and the rear support position 42 are arranged in such a manner that a center of gravity of a patient is placed between these positions and his/her weight can act.

The angle variable mechanism 45 includes: a long hole 38 which is formed at the rear support position 42 of the sup port member 11*a* and long from side to side; a crank lever 35 which is attached to the inner side of a side member 11*e* of the cart 11 through a shaft 43 so as to be capable of oscillating; a coupling pin 39 which is fixed to one end of the crank lever 35 and pierces the long hole 38 to couple the crank lever 35 with the support member 11*a*; and an actuator with a lock mechanism 37 which is attached to the side member lie of the cart 11 and the other end of the crank lever 35 so as to be capable of oscillating, e.g., a gas spring with a hydraulic lock mechanism.

A gas spring with the lock mechanism 37 is a cylinder device having gas sealed therein. When movement of the sealed fluid is allowed, the gas spring enters the unlocking state in which it can be expanded and contracted. Also, when movement of the sealed fluid is prohibited, the gas spring enters the locking state in which it can not be expanded and contracted. A valve which opens/closes a passage along which the sealed fluid moves can be opened/closed by pushing a pin 37*b* by a lever 37*e*. The lever 37*e* is connected to a non-illustrated tilt lever which is arranged in the vicinity of the push handle 44 through a control cable (not shown). That is, the lever 37*e* is activated by the operation of the non-illustrated tilt lever to open/close the valve so that the gas spring with the lock mechanism 37 can be locked or unlocked. Moreover, the gas spring with the lock mechanism 37 functions as a gas spring for generating a reaction force in an expanding direction by a pressure of the sealed gas in the expansion/contraction enabled state. A bracket 37*c* which supports a rod 37*a* of the gas spring and holds the lever 37*e* for operating the pin 37*b* is attached to the side member 11*e* of the cart 11 by a bolt 37*d*.

Figure 13:
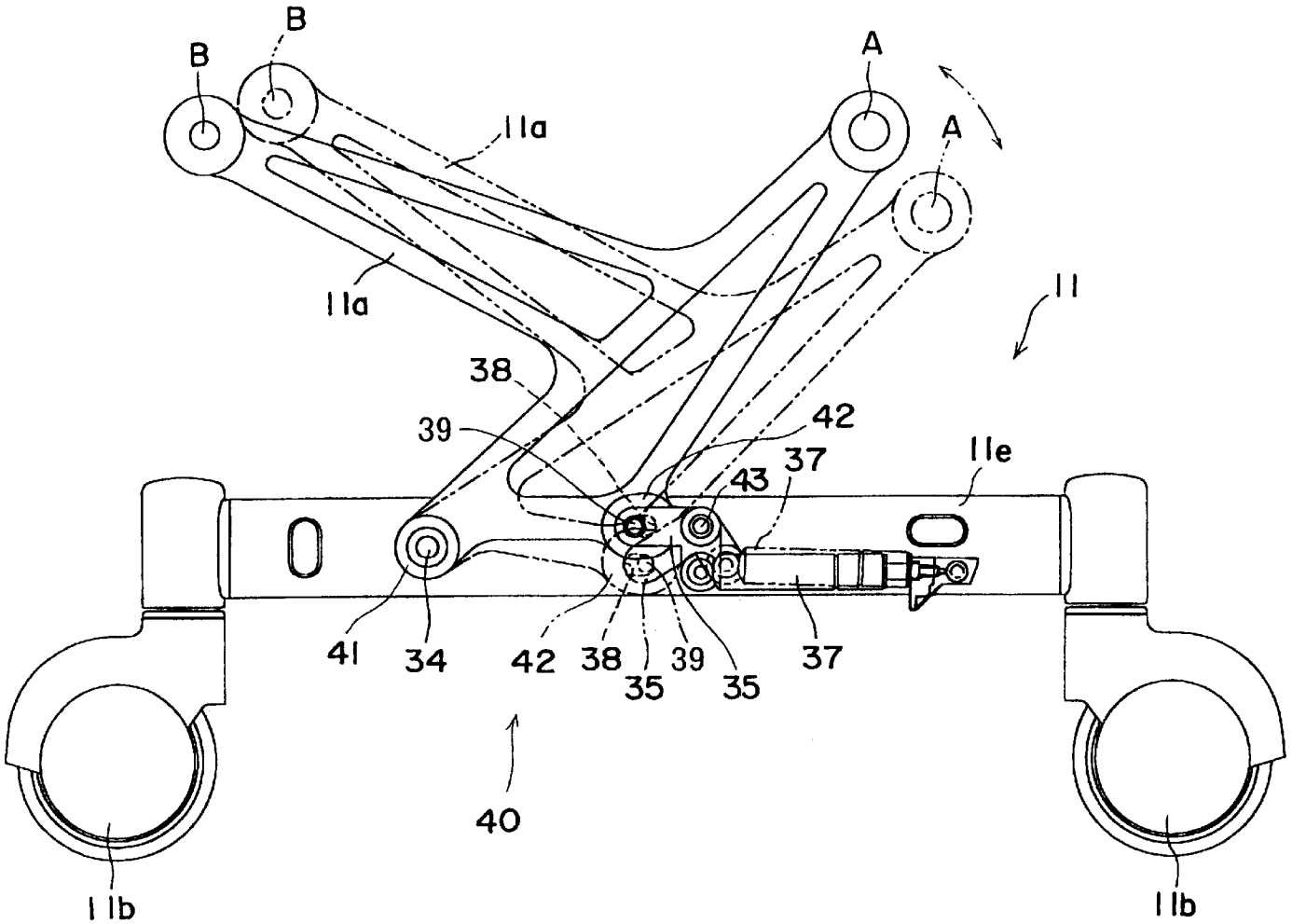
FIG. 13 is a side view showing the state that an angle adjustment mechanism is attached to a cart.
Figure 14:
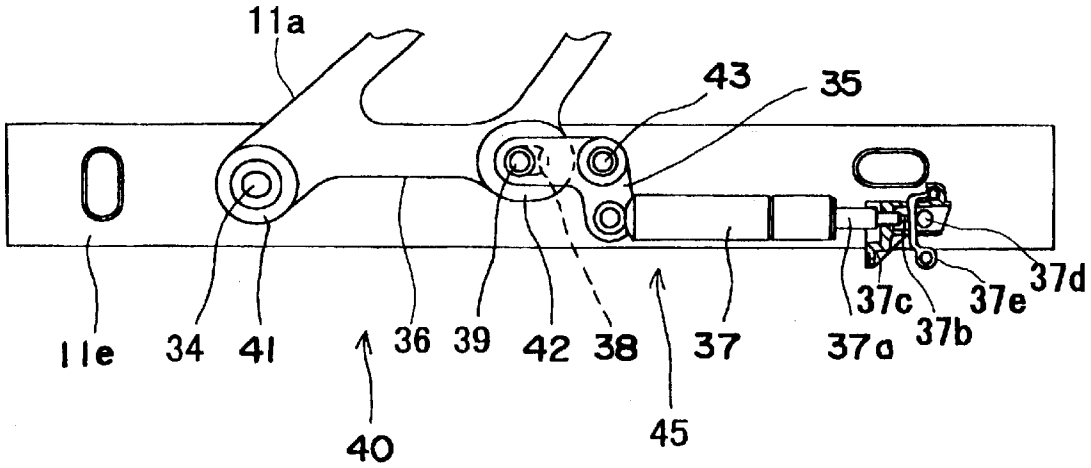
FIG. 14 is a side view showing the angle adjustment mechanism.
Figure 15:
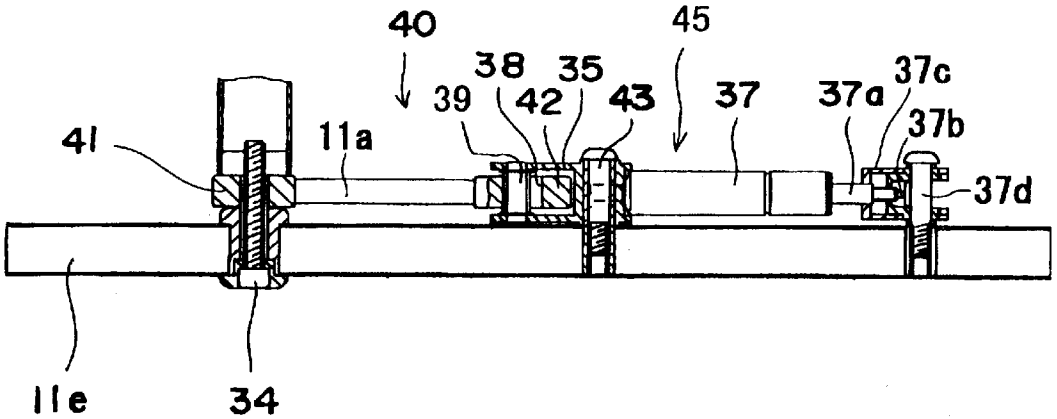
FIG. 15 is a cross-sectional view of the angle adjustment mechanism seen from above.

Therefore, the crank lever 35 oscillates by expanding/contracting the gas spring with the lock mechanism 37 to move the rear support position 42 of the support member 11*a* in the vertical direction so that the support member 11*a* oscillates around the supporting shaft 34 in the front-and-back direction. In the example of FIG. 13, the support member 11*a* oscillates from the horizontal state in such a manner that a point A is lowered while a point B is moved up. That is, when the frame 1 is transformed into the wheelchair configuration, it can be slightly tilted rearwards without changing the shape of the frame 1. Therefore, the stability of a body of a user sitting on the stretcher in the wheelchair mode is improved. In addition, since a user can sit so as to put his/her full weight on the stretcher, he/she can further relax.

Figure 21:
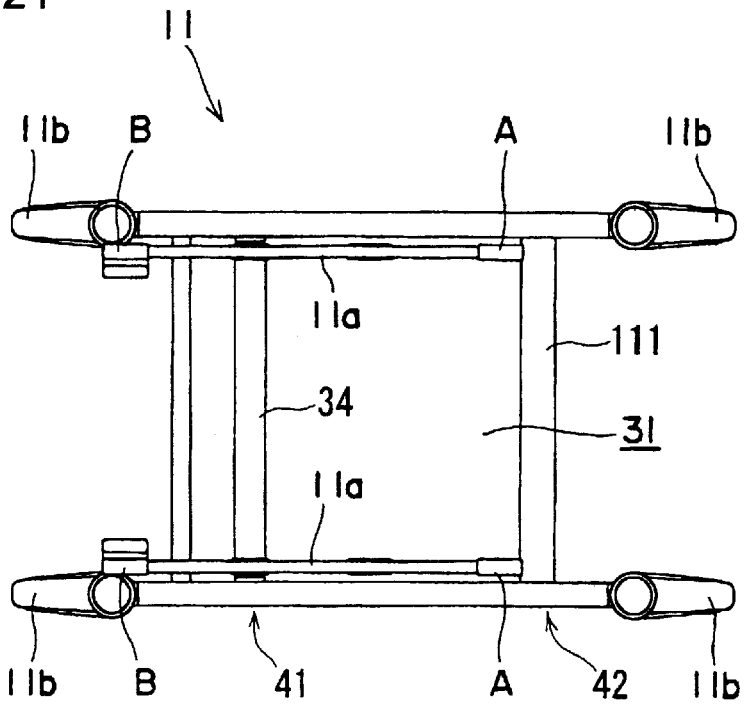
Figure 22:
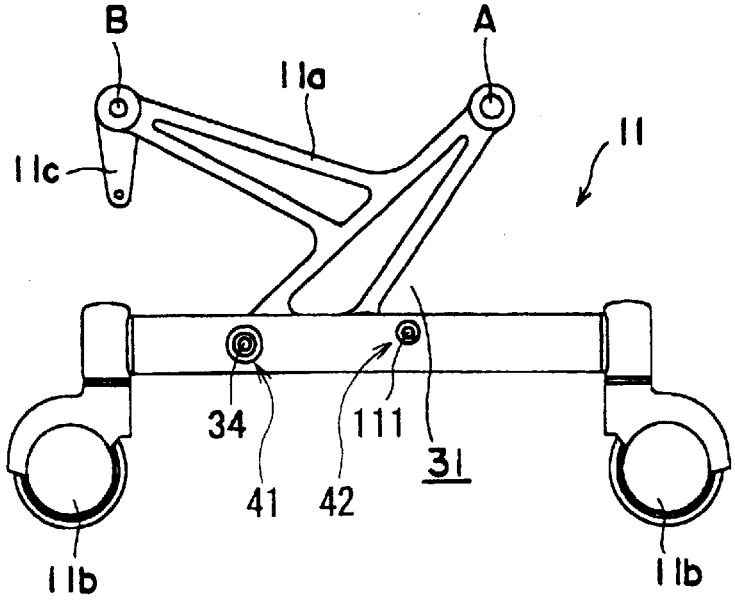
Figure 23:
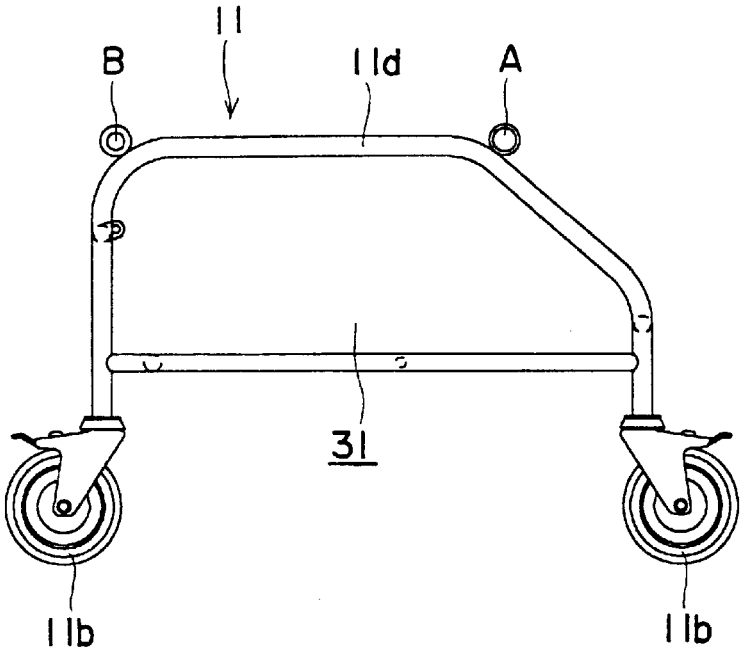
Figure 24:
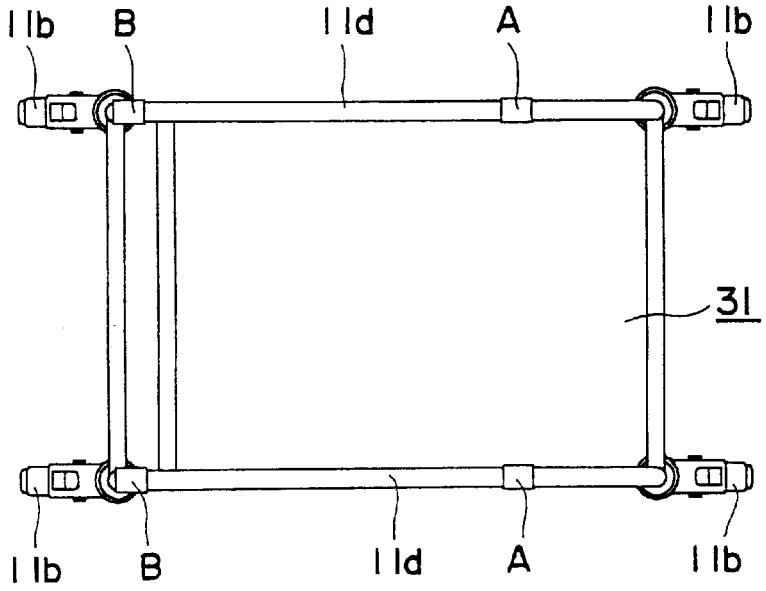

It is to be noted that this frame is not necessarily supported on the cart 11 so as to be capable of inclining. For example, as shown in FIGS. 21 to 22, when the front support position 41 of the support member 11*a* is coupled by the support shaft 34 and the rear support position 42 is also coupled with the cart 11 by a fixing shaft 111, the support member 11*a* can be fixed to the cart 11 to support the frame 1 as a part of the cart 11. In this case, the frame 1 only transforms with the supporting points A and B which are coupling points between the cart 11 and the frame 1 as its center, and the frame 1 does not incline toward the cart 11 as it is without transformation. Moreover, the conformation of the cart 11 is not restricted that shown in the drawings, and the frame may be supported by the cart 11 constituted by a pipe frame lid which also functions as the support member as shown in FIGS. 23 and 24, for example. In this example, the brackets 9 and 10 of the frame 1 are rotatably coupled with the annular supporting points A and B on the pipe frame 11*d*, and the frame 1 is supported so as to allow transformation.

Figure 9:
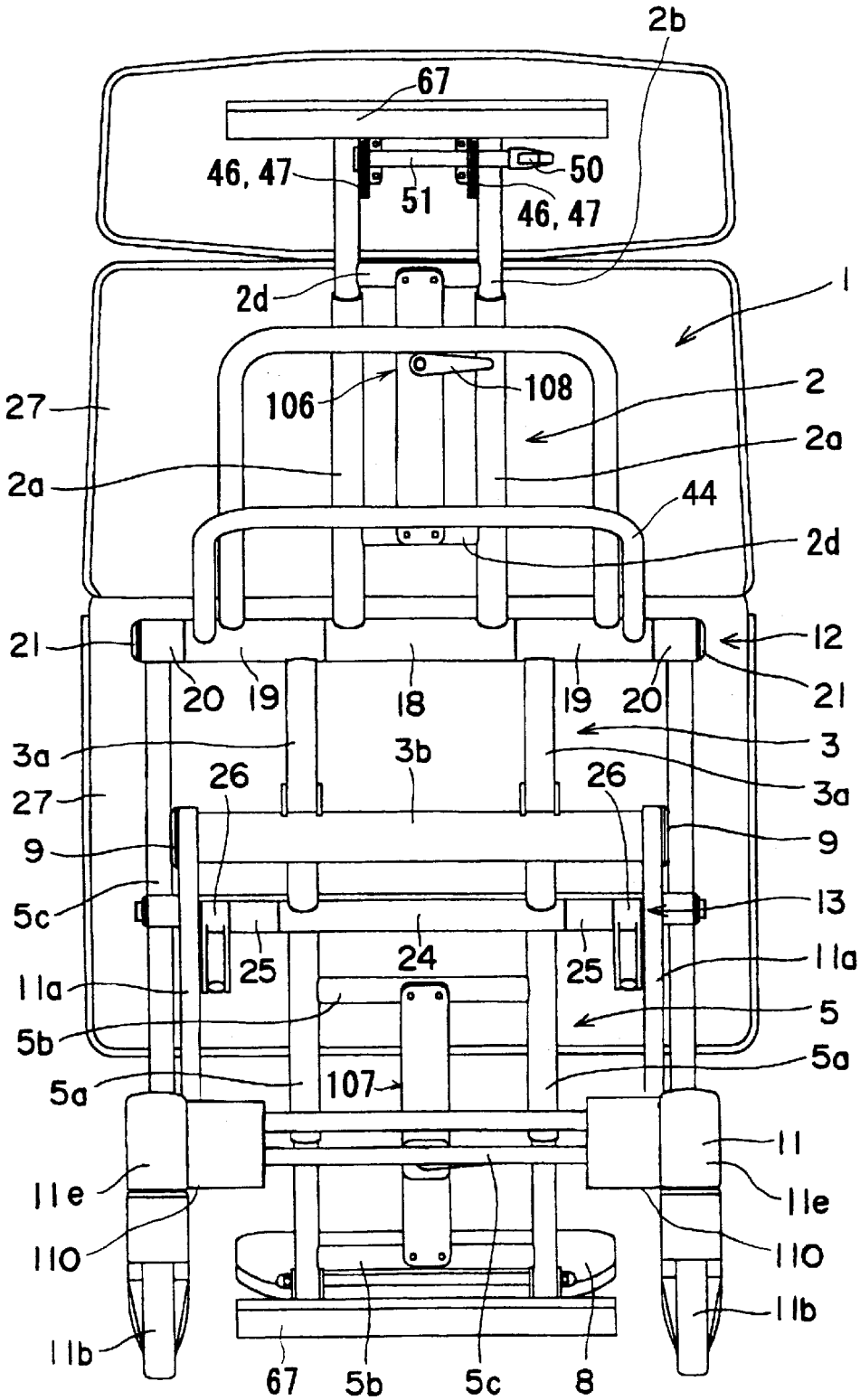
FIG. 9 is a rear view of the stretcher transformed in a wheelchair configuration.
Figure 10:
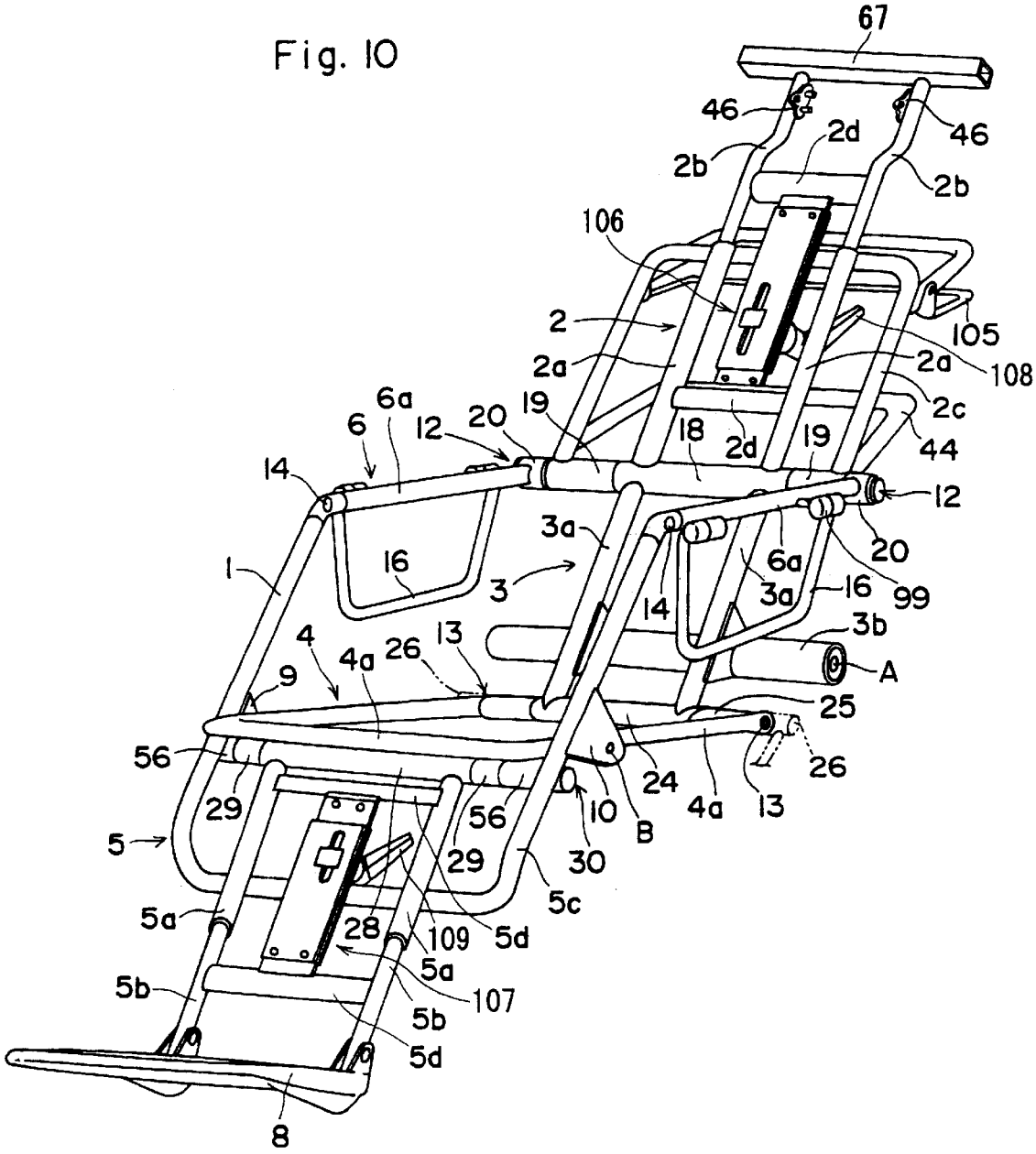
FIG. 10 is a perspective view showing an example of a frame structure of the stretcher.

The support members 11*a* are, as shown in FIG. 9, provided to the right and left sides of the cart 11. The first and second lock devices 15*a* and 15*b* are also arranged on the right and left sides of the cart 11. Therefore, a space between the above knee portion 4, the lumbar portion 3 and the cart 11 serves as a bag accommodating space 31. When a non-illustrated tray or basket and the like is set in the bag accommodating space 31, extra clothes or nursing care goods can be mounted therein to be carried.

The first and second lock devices 15*a* and 15*b* provided on the right and left sides of the frame 1 are set with different attachment angles. This attachment state will be described mainly with reference to FIGS. 17 to 20 showing only the frame 1 and the cart 11 for convenience sake. For example, the end of the second lock device 15*b* is rotatably A attached to an extended portion 11*c* formed to the support member 11*a*, and a base end of the same is rotatably attached to the extended portion 26*a* formed to a the sleeve 26 which integrally rotates with the sleeve 24 at the second coupling position 13. Further, the end of the first lock device 15*a* is rotatably fixed to the extended portion 26*a* formed to a the sleeve 26 which can rotate with respect to the sleeve 24 of the second coupling position 13, and a base end of the same is fixed to a bracket 36 rotatably attached to the cart 11. That is, the second lock device 15*b* is substantially horizontally attached, while the first lock device 15*a* is substantially vertically attached. In this manner, by distributing the first and second lock devices 15*a* and 15*b* on the right and left sides and largely differentiating the attachment angles of the first and second lock devices 15*a* and 15*b*, the two lock devices 15*a* and 15*b* are not fully expanded at the same time even if an angle of the frame 1 is changed. When any one, for example, the first lock device 15*a* is fully expanded, the other, e.g., the second lock device 1*b*, can be necessarily contracted to some measure. One lock device may be enough, but providing two lock devices 15*a* and 15*b* can further improve the reliability of the frame 1 relative to locking. Also, the two lock devices 15*a* and 15*b* rarely develop troubles at the same time, thereby improving the reliability with respect to failures.

As the first and second lock devices 15*a* and 15*b*, in this embodiment, a so-called mechanical lock device which is well known is generally used. Although the structure is not illustrated, movement of the rod is restricted to perform positioning by tightening a coil spring wound around the rod. Tightening and releasing of the coil are effected by the lever operation through a wire of a control cable. With the lever operation, movements of the two lock devices 15*a* and 15*b* are simultaneously restricted or extension/contraction thereof is allowed.

Figure 2:
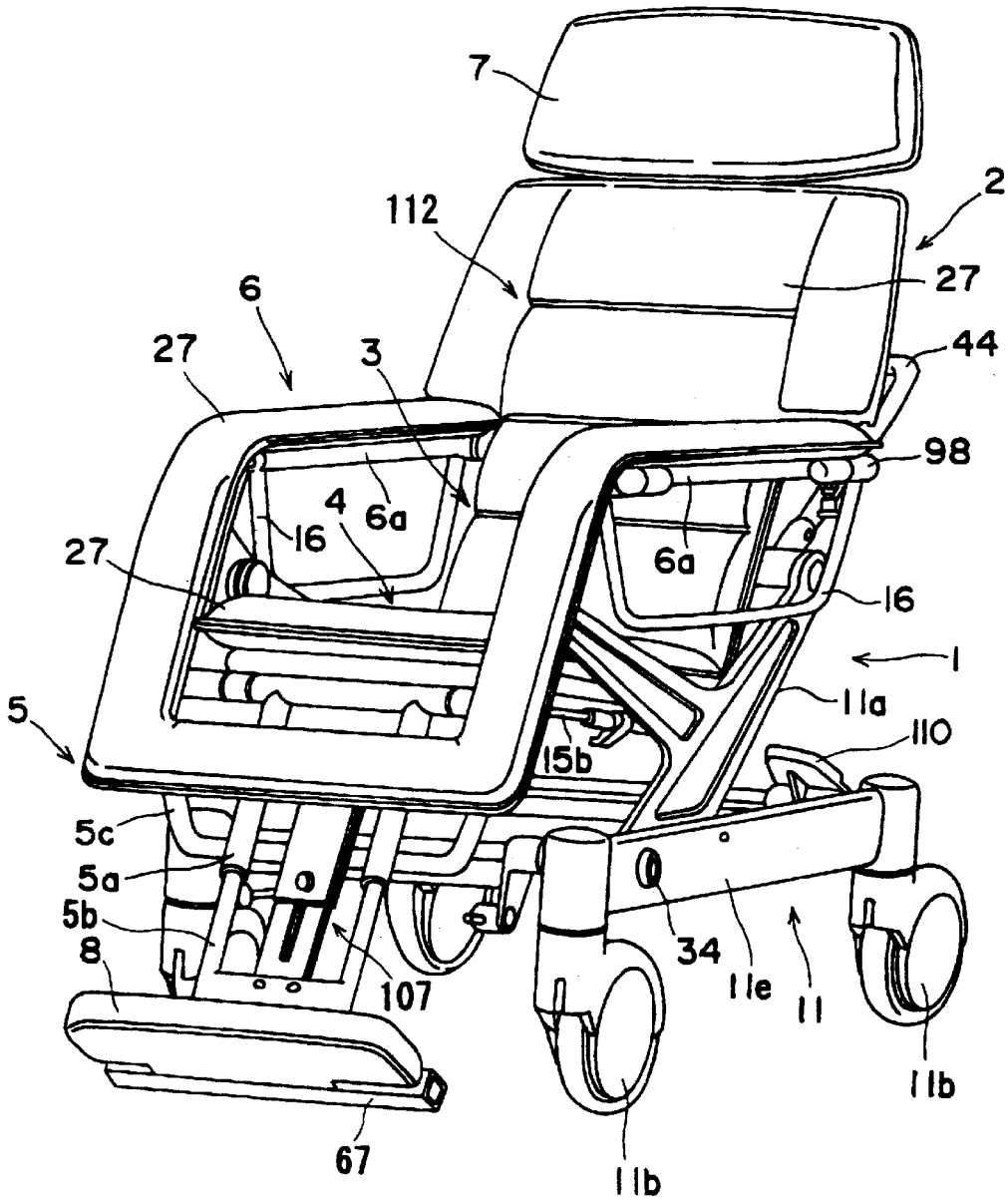
FIG. 2 is a perspective view showing the stretcher in a wheelchair configuration.
Figure 17:
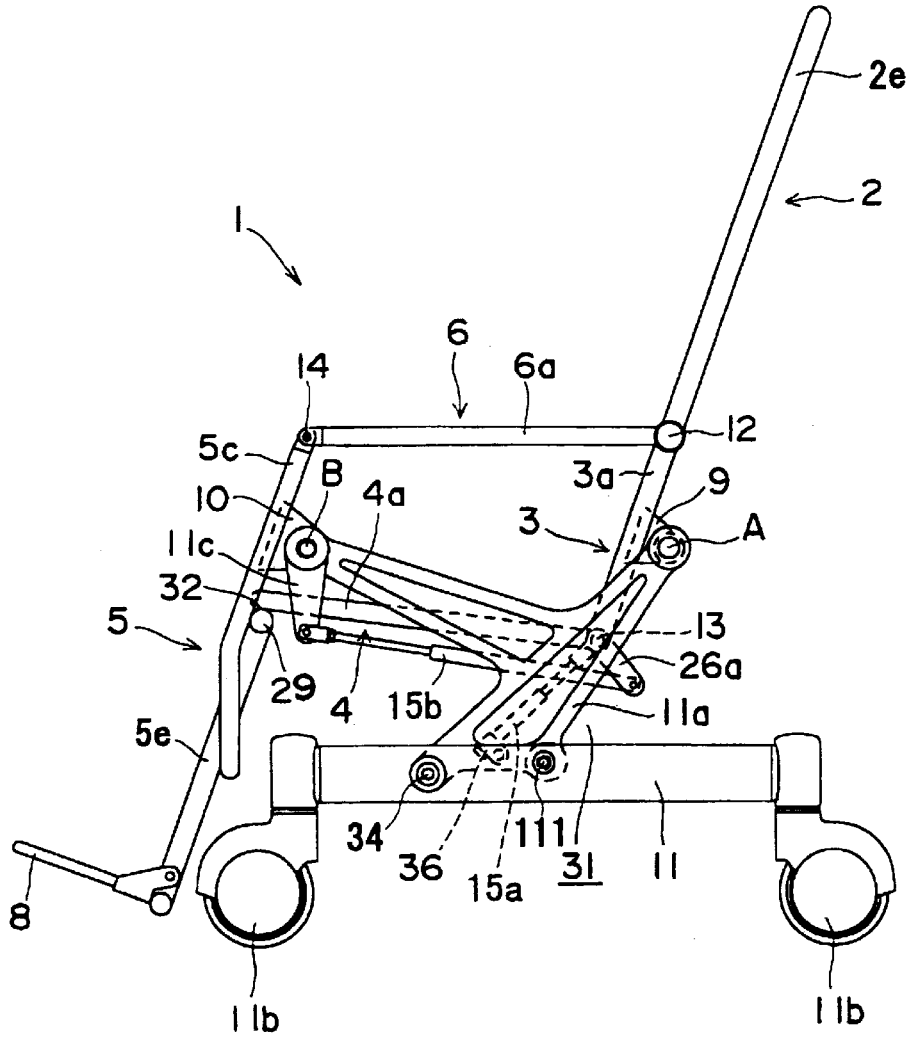
FIGS. 17 to 24 show embodiments of the stretcher in which an attachment position of the frame with respect to the cart is fixed.

According to the stretcher having the above-described configuration, transformation from the stretcher configuration to the wheelchair configuration or vice versa can be completed by one operation as follows. Fixation of the first and second lock devices 15*a* and 15*b* are first released, and the lumbar portion 3 of the frame 1 is then pulled up around the supporting point A. As a result, the first coupling point 12 can rotate around the supporting point A and the fourth coupling point 14 can rotate around the supporting point B so that the armrest portion 6 is lifted up and the below knee portion 4 is tilted. At the same time, a portion below the supporting point A of the lumbar portion 3 is pulled down rearwards, and a portion under the supporting point B of the below knee portion 4 which is similarly pulled down rearwards is slid on the sleeve 28, thereby lowering the entire above knee portion 4. That is, the crushed four-node rotation linkage is restored into a parallelogram, and the above knee portion 4 which serves as the seat, the armrest portion 6, and the back portion 2 and the lumbar portion 3 which function as the backrest are formed to constitute the wheelchair having the armrest such as shown in FIGS. 2 and 17. The first and second lock devices 15*a* and 15*b* maintain the wheelchair configuration with the four-node rotation linkage as a fixed linkage.

Figure 18:
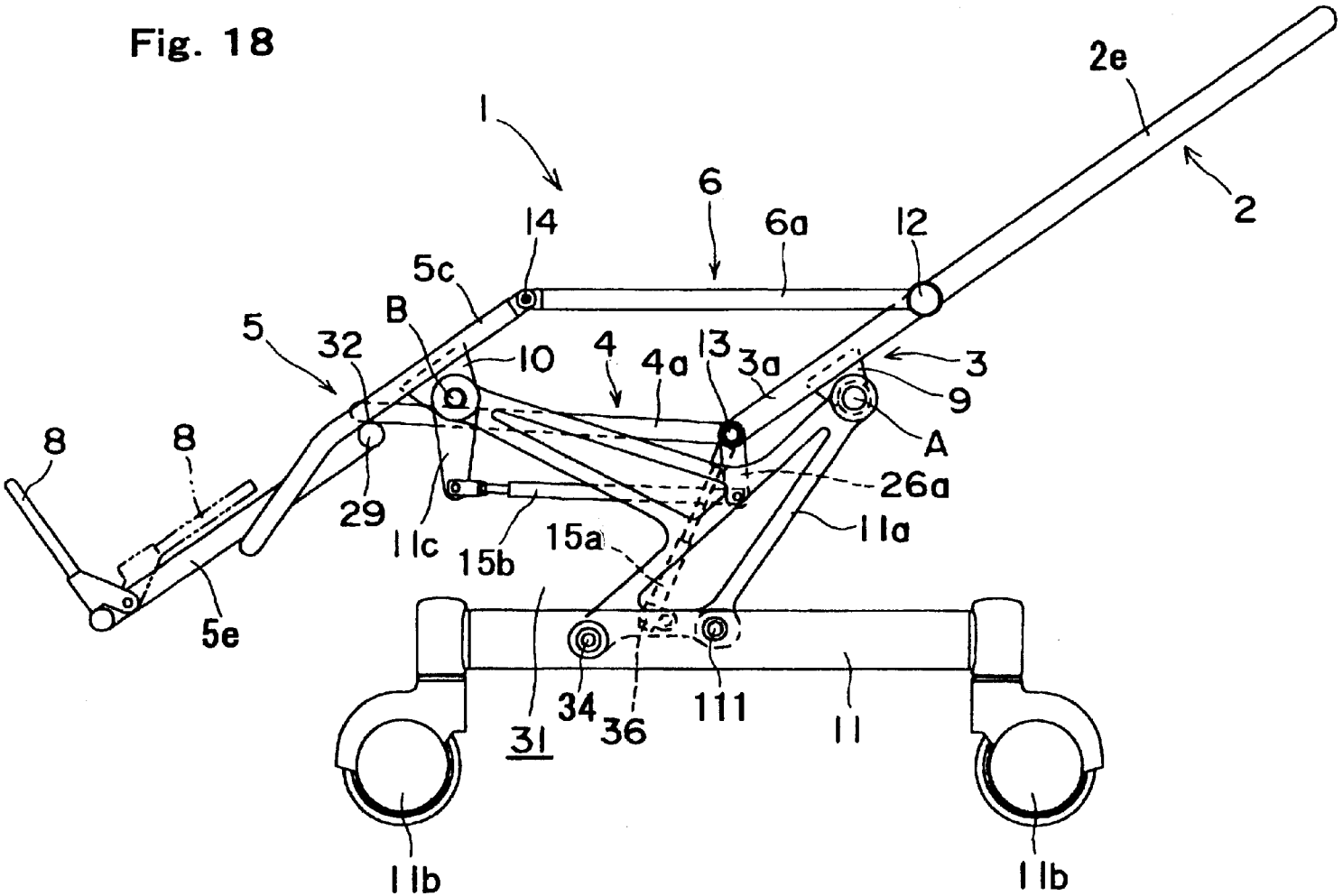
Figure 19:
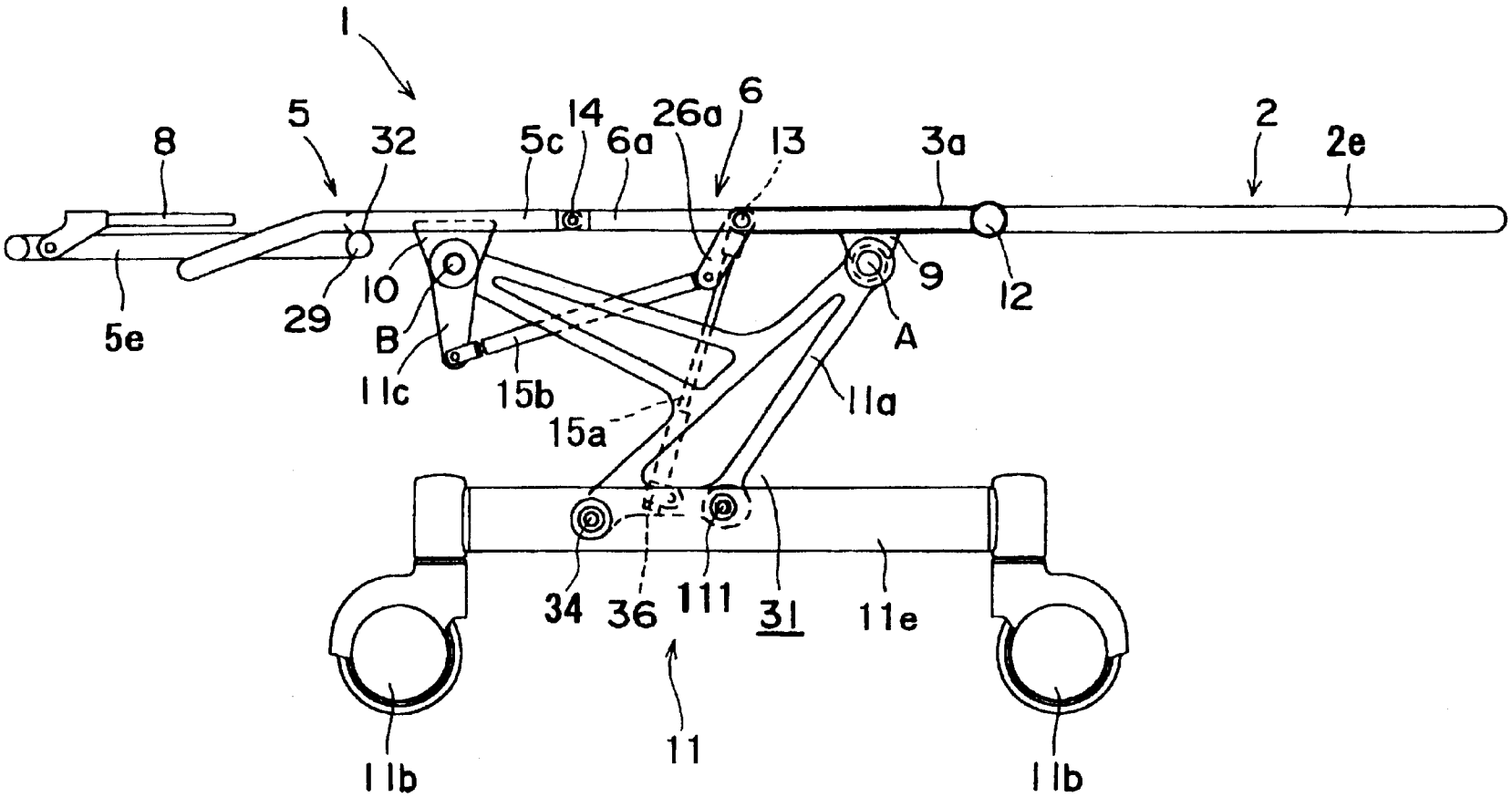

When changing into the stretcher, the two lock devices 15*a* and 15*b* are released, and the back portion 2 is thereafter reclined as shown in FIG. 18. Then, the first coupling position 12 rotates around the supporting position A and the third coupling position 14 rotates around the supporting position B so that they are obliquely moved to the lower rear side. At the same time, the part of the lumbar portion 3 below the supporting point A moves up while being pushed out frontward so that the U-shaped pipe 4*a* constituting the above knee portion (the seat portion) 4 is slid on the sleeve 28 to be lifted up. Therefore, the four-node rotation linkage of the parallelogram is crushed, and the below knee portion 5, the above knee portion 4, the lumbar portion 3 and the back portion 2 are horizontally arranged on a straight line when seen from the side part as shown in FIG. 19. Simultaneously, the vertical pipe 6*a* constituting the armrest portion 6 between the first and fourth third coupling points positions 12 and 14 is obliquely moved down to be horizontally arranged on a straight line together with the U-shaped pipe 5*c* so that the vertical pipe 6*a* overlaps on the lumbar portion 3 and the above knee portion 4. Accordingly, the armrest portions 6 are placed on both sides of the lumbar portion 3 and the above knee portion 4, and the a mat surface 112 of the stretcher can be widely used.

Figure 20:
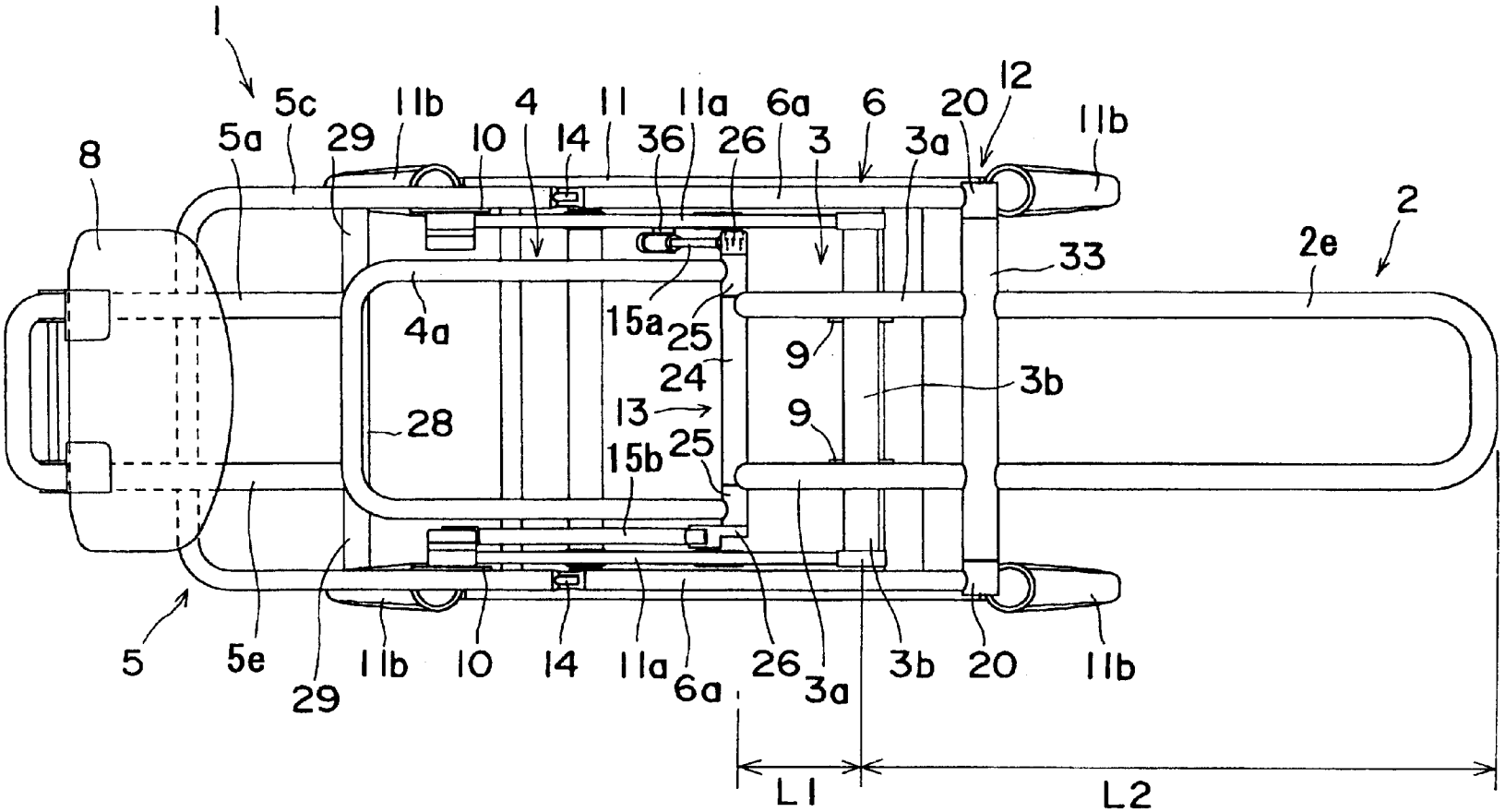

Here, as shown in, e.g., FIG. 20, assuming that a distance from the supporting point A to the second coupling position 13 is Li and a distance from the supporting point A to the end of the back portion 2 is L2, a ratio of the distances L1 and L2 is, e.g., 1:5. When raising the lumbar portion 3 and the back portion 2 forward, the end position of the back portion 2 is usually clutched to be lifted up. Since the distance L2 is approximately five times as longer as the distance L1, the lumbar portion 3 and the back portion 2 can be raised with an extremely light force by applying the principle of leverage even if a patient is lying on the stretcher.

When the backrest consisting of the lumbar portion 3 and the back portion 2 is raised to a given angle and the lumbar portion 3 is bent with respect to the above knee portion 4, the second coupling position 13 is lower than the positions of the points A and B, and the lumbar portion 3 and the above knee portion 4 are tilted. Therefore, a body of a patient lying on the stretcher is bent so as to fall toward the second coupling position 13 from the horizontally stretched state, and his/her weight acts on a direction for lowering the second coupling position 13. Thus, after raising the lumbar portion 3 and the back portion 2 to a given height, the lumbar portion 3 and the back portion 2 can be upheaved with a further light force.

After oscillating the lumbar portion 3 and the back portion 2 to a desired angle, the angle of the frame 1 can be fixed, i.e., the frame 1 can be locked by restricting expansion/contraction of the two lock devices 15*a* and 15*b* by the lever operation.

In the wheelchair conformation shown in FIG. 8 or 17, the second lock device 15*b* is substantially fully expanded. When the lock device 15*b* is fully expanded, it is hard to obtain the large rigidity with respect to locking of the frame 1. On the other hand, when the second lock device 15*a* is contracted, the large rigidity can be easily obtained with respect to locking of the frame 1. In the wheelchair conformation shown in FIG. 8 and others, although the second lock device 15*b* is expanded, the first lock device 15*a* is contracted, and the rigidity sufficient for locking the frame 1 can be hence obtained. Similarly, in the stretcher conformation shown in FIG. 1 or FIG. 19, although the first lock device 15*a* is expanded, the second lock device 15*b* is contracted, and the rigidity sufficient for locking the frame 1 can be obtained. That is, changing the attachment angles of the two lock devices 15*a* and 15*b* can constantly obtain the sufficient locking rigidity.

In the wheelchair configuration, after unlocking the gas spring with the lock mechanism 37 by operating the tilt lever, the push handle 44 is held to push frontward or pull rearward the rear portion 2 of the frame 1. As a result, the support member 11*a* supporting the frame 1 is tilted around the support shaft 34, and the tilt angle can be changed in that state without varying a shape of the frame 1. Now, when the entire frame 1 is inclined rearward from the horizontal state shown in FIG. 6, the rear support position 42 of the support member 11*a* moves down around the support shaft 34. That is, the support member 11*a*, as shown in FIG. 13, oscillates the crank lever 35 while pushing and contracting the gas spring with the lock mechanism 37 so that the support member 11*a* rotates around the support shaft 34 to be tilted rearward.

At this time, when the gas spring with the lock mechanism 37 is locked, the crank lever 35 can not oscillate and movement of the rear support position 42 is hence disabled. That is, when movement of the rear support position 42 is locked, the support member 11*a* is fixed to retain the tilt angle of the frame 1. In this state, since the entire frame 1 is tilted rearward in such a manner that it slightly settles down, a patient can sit back, thereby improving the stability for holding the patient. Further, since the patient can sit back, he/she can sit in a comfortable posture in a relaxed manner as if his/her body is wrapped.

Figure 6:
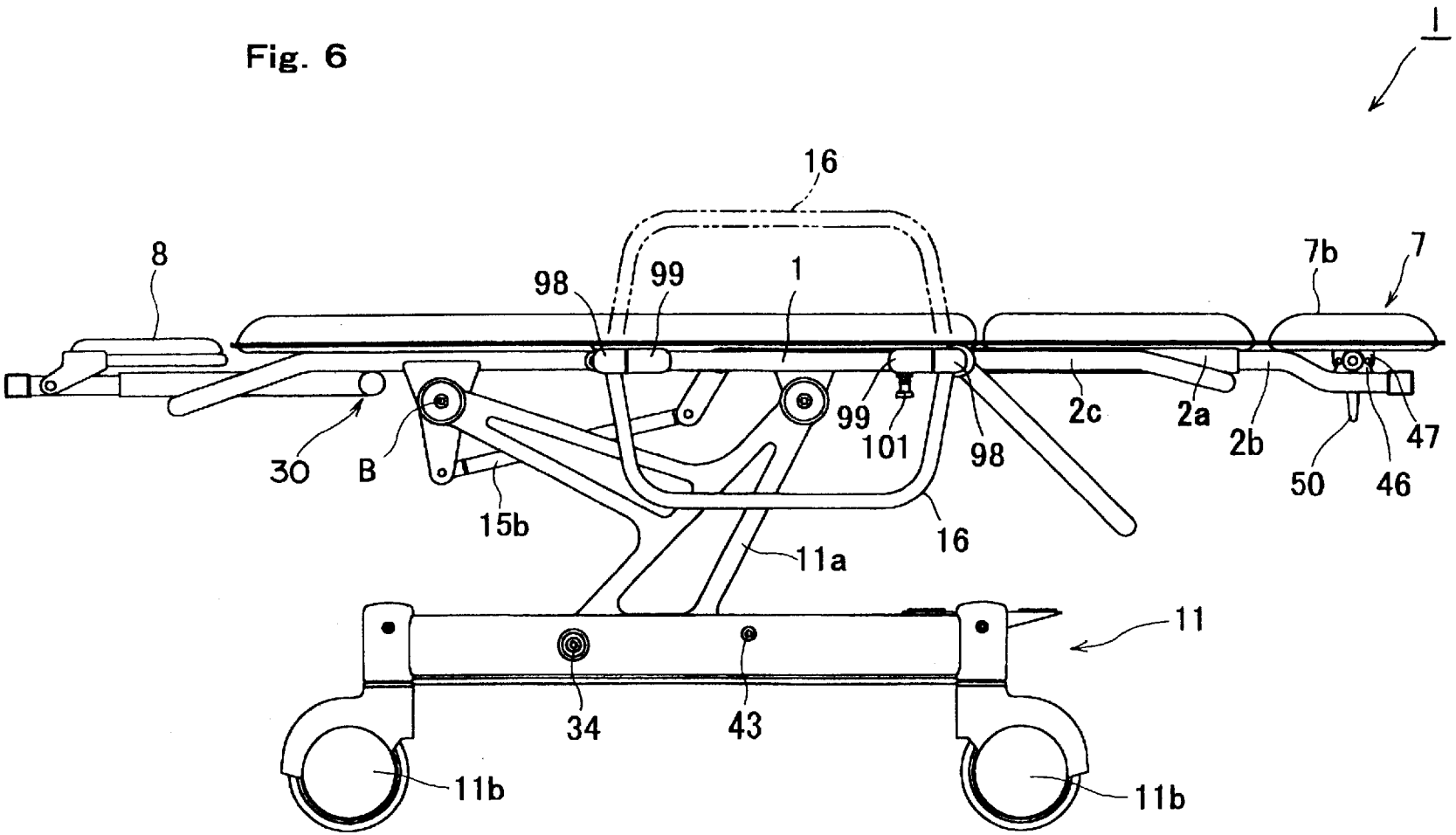
FIG. 6 is a side view showing the stretcher configuration.
Figure 7:
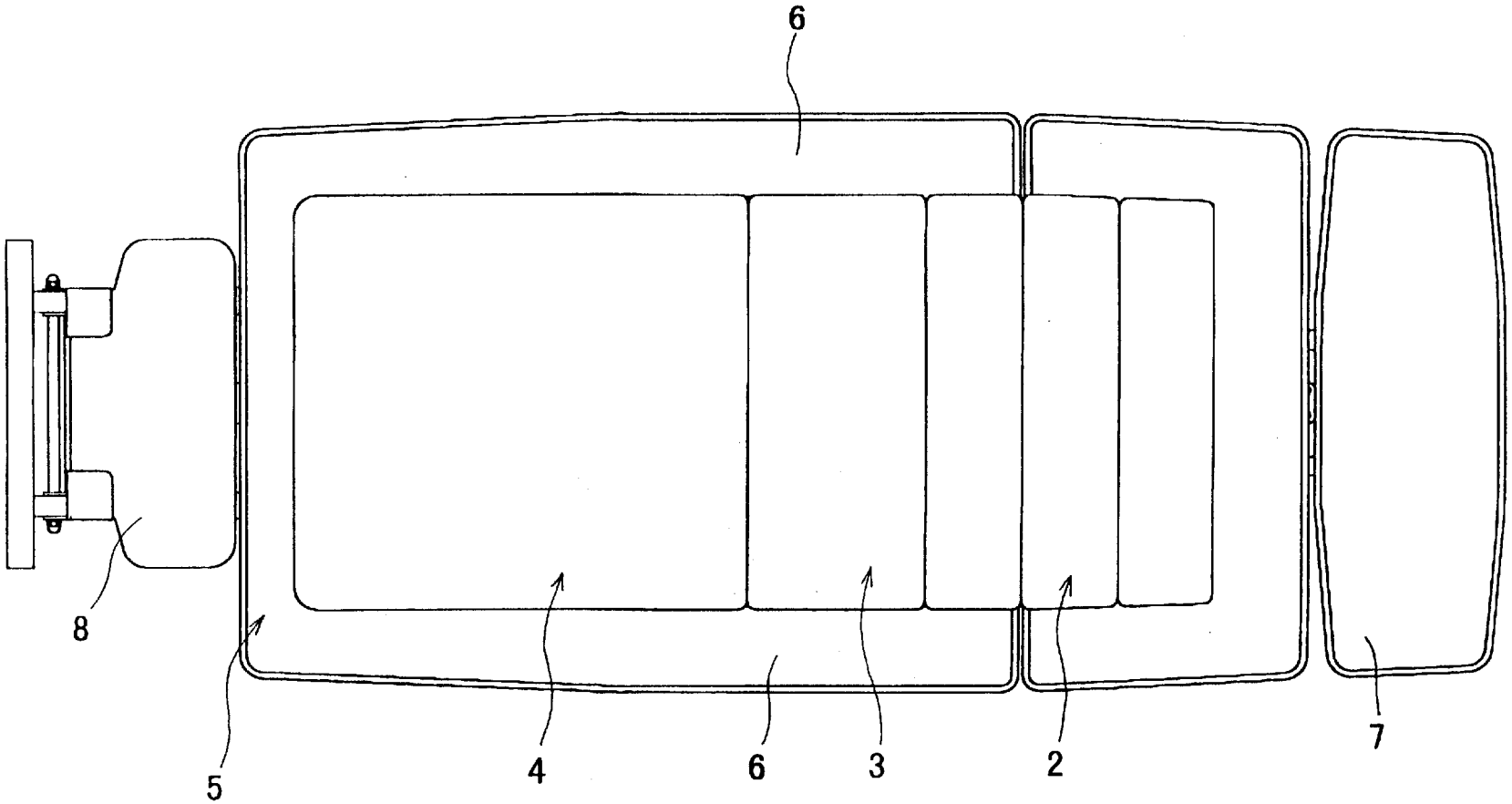
FIG. 7 is a plane view of the stretcher configuration.

When restoring the tilt of the frame 1, the gas spring with the lock mechanism 37 is unlocked by operation the tilt lever to lift up the frame 1 frontward. The rear support position 42 of the support member 11*a* can then freely move, and the frame 1 can hence rotate around the support shaft 34 to be raised forward. As a result, as shown in FIG. 6, the entire frame 1 returns to the horizontal state. In this state, a patient can easily get on and off the wheelchair.

Figure 3:
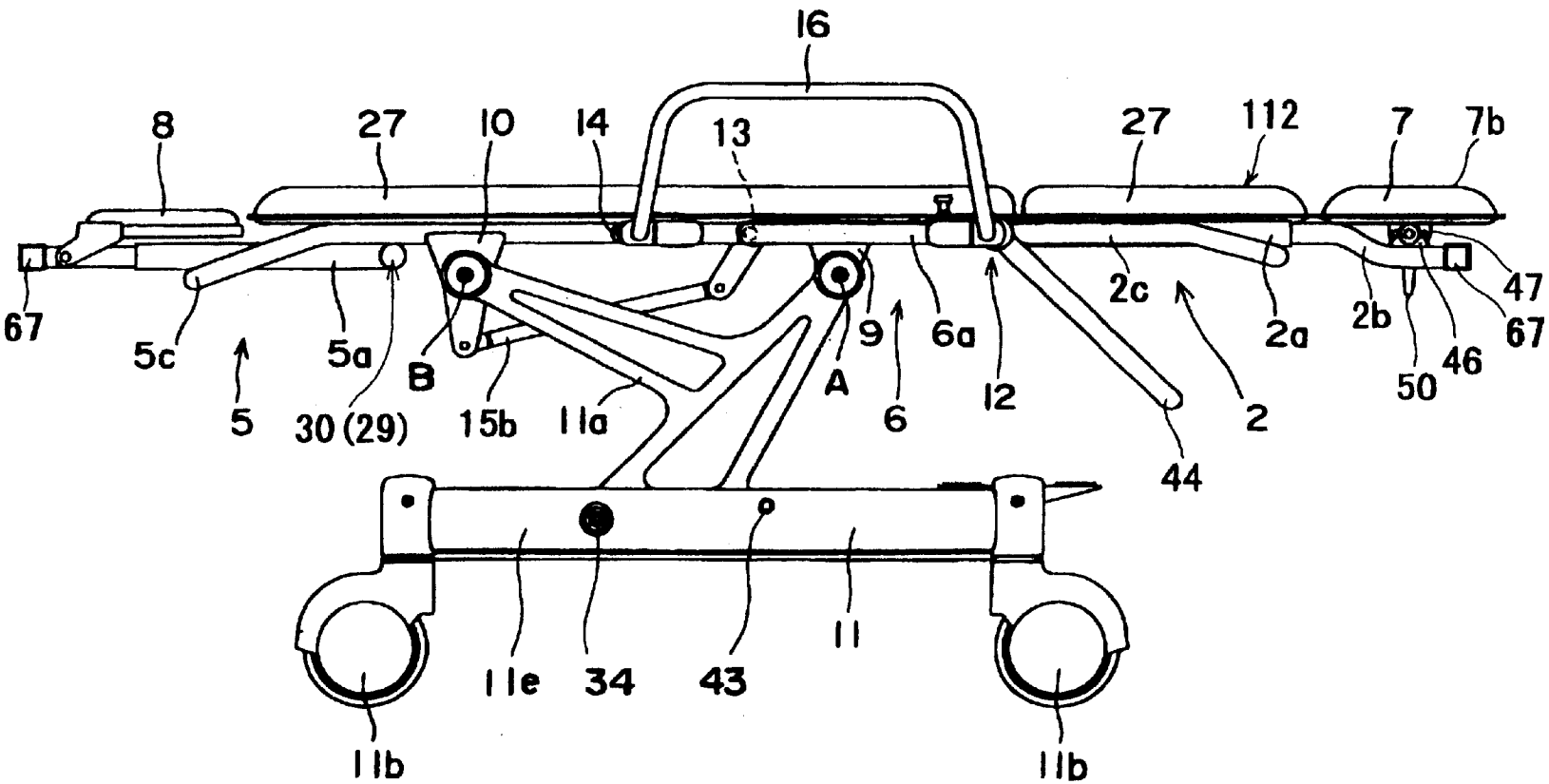
FIG. 3 is a side view of the stretcher configuration.

After locking the gas spring with the lock mechanism 37, when the lumbar portion 3 and the back portion 2 of the frame 1 are inclined rearward, the mat surface, as shown in FIG. 3, returns to the flat and horizontal stretcher mode. Here, the cart 11 can be fixed by stepping on a brake pedal 110 and stopped by applying the brake on casters 11*b*.

Incidentally, in this embodiment, the influence of a weight of a patient on the tilt operation is canceled by two gas springs with the lock mechanism 37 provided on the right and left sides of the cart 11. Giving the concrete description based on FIG. 16, if a weight of a patient is set to, e.g., 60 kg, a ratio of a distance from the shaft 43 which is an oscillation center of the crank lever 35 to a coupling portion of the gas spring with the lock mechanism 37 and a distance from the shaft 43 to the coupling pin 39 is 0.7:1. Therefore, if a reaction force of the gas spring with the lock mechanism 37 is assumed as F1, a force of F2 for lifting up the coupling pin 39 can be expressed as F2=0.7×F1.

On the other hand, positions of the front support position 41, i.e., the support shaft 34 and the rear support position 42, i.e., the coupling pin 39 are designed in such a manner that a weight of a patient acts on the center between the front support position 41 and the rear support position 42 when the patient sits in the standard manner. That is, a force Fa for supporting the patient acts on a position of a distance which is a half of the distance from the support shaft 34 to the coupling pin 39. Accordingly, since the force F2 acts on the support shaft 34 at a position which is two times distanced away as compared with the force Fa, the force Fa can be expressed as Fa=0.5×F2=0.35×F1.

Now, it is assumed that a weight of a patient is 60 kg. By attaching a total of two gas springs with the lock mechanism 37 for generating the reaction force of 85 kg on the right and left sides, the reaction force F1=85×2=170 kg can be produced. Therefore, the force F2=170×0.7=119 kg is obtained, and the weight can be supported by the force Fa=119×0.5=59.5 kg. That is, when the two gas springs with the lock mechanism 37 for generating the reaction force of 85 kg are used, the force Fa whose magnitude is substantially equal to that of the weight of a patient can be generated to support the patient. Therefore, the weight of a patient rarely has an influence on the tilt operation.

Subsequently, description will be given as to the support mechanism of the headrest 7.

Figure 26:
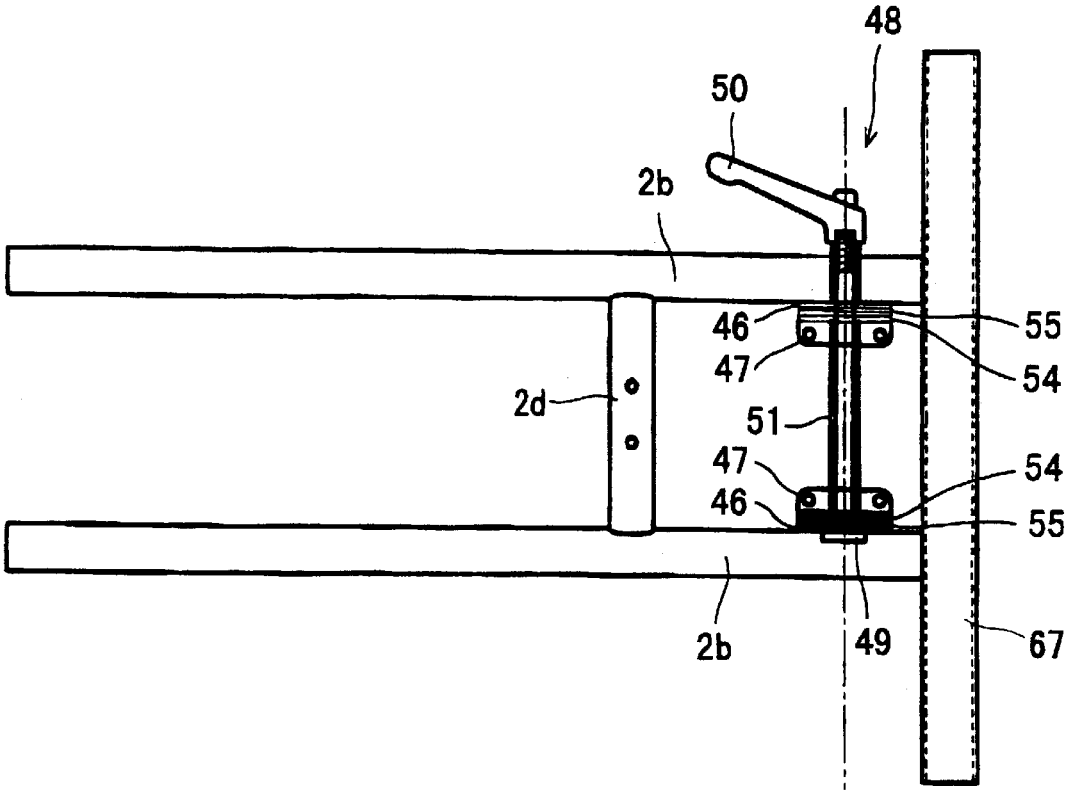
FIG. 26 is a plane view showing a structure of a circumference of the headrest illustrated in FIG. 25.
Figure 27:
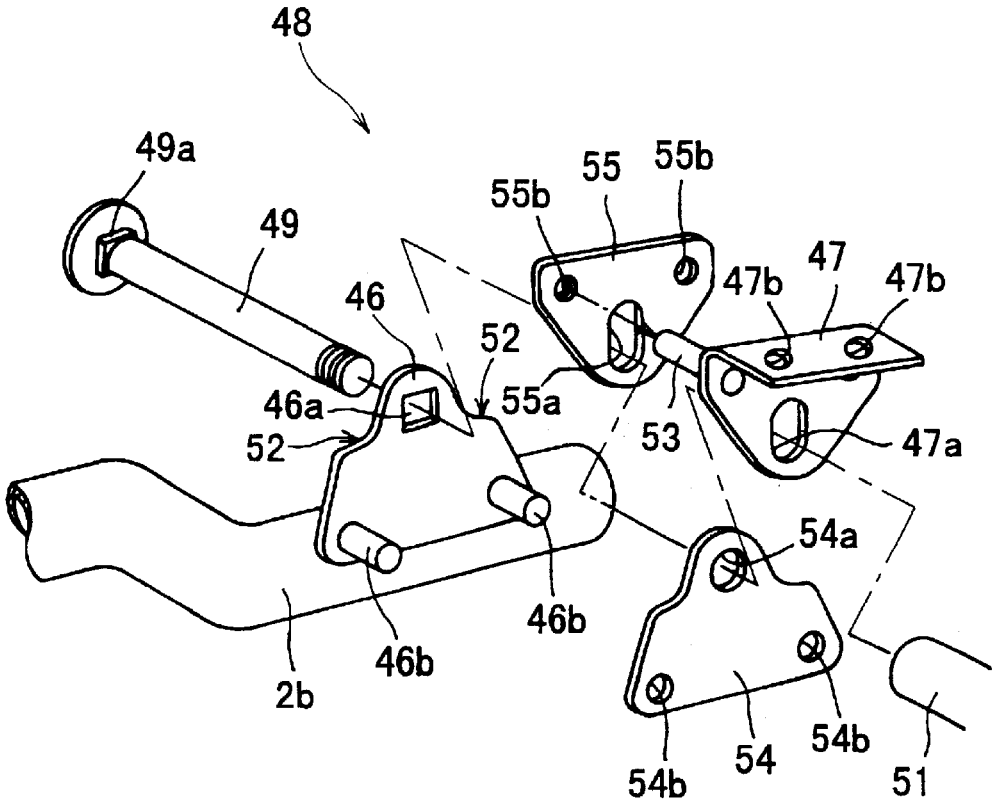
FIG. 27 is an exploded perspective view showing the structure of a circumference of the bracket on a head side of a support bolt.

The stretcher of this embodiment includes the headrest 7 at a part of the pipe 2*b* which constitutes the back portion 2 of the frame 1 and on which a head of a patient can be mounted as shown in FIG. 3 and FIGS. 25 to 32. This headrest 7 is, as shown in FIG. 25, mainly made up of: a base 7*a* consisting of, e.g., a plate material, a plastic board or a steel plate; a cushion portion 7*b* supported on this base 7*a*; and a cover for covering these members. Moreover, the headrest 7 of this embodiment is attached to the pipe 2*b* of the back portion 2 in such a manner that its height and tilt can be adjusted. For example, as shown in FIG. 27, by providing a first bracket 46 which is attached to the pipe 2*b* by welding and the like, a second bracket 47 attached to the back side of the base 7*a* for the headrest 7 by a vis and the like, and coupling means 48 which pierces both overlapping brackets 46 and 47 and fixes them by fastening, the height and tilt of the headrest 7 can be adjusted. As shown in FIG. 25, it is formed in such a manner that the height of the cushion portion 7*b* of the headrest 7 placed at the lowermost position and that of the mat 27 transformed into the stretcher are equal. It is to be noted that the heights of the headrest 7 and the mat 27 do not have to be equal in some cases and the height of the headrest 7 can be changed in accordance with use conditions. For example, the cushion portion 7*b* of the headrest 7 can be set higher than the mat 27.

In addition, the pipe 2*b* to which the headrest 7 is attached is, as shown in FIGS. 3 and 25, bent such that the part of the pipe 2*b* to which the headrest 7 is attached in the stretcher mode is lower than the pipe 2*a*. A clearance generated by this structure can form a space in which the headrest 7, the first bracket 46, the second bracket 47 and others can be accommodated, and the mat 27 can be mounted at a height equal to that of the headrest 7.

Figure 28:
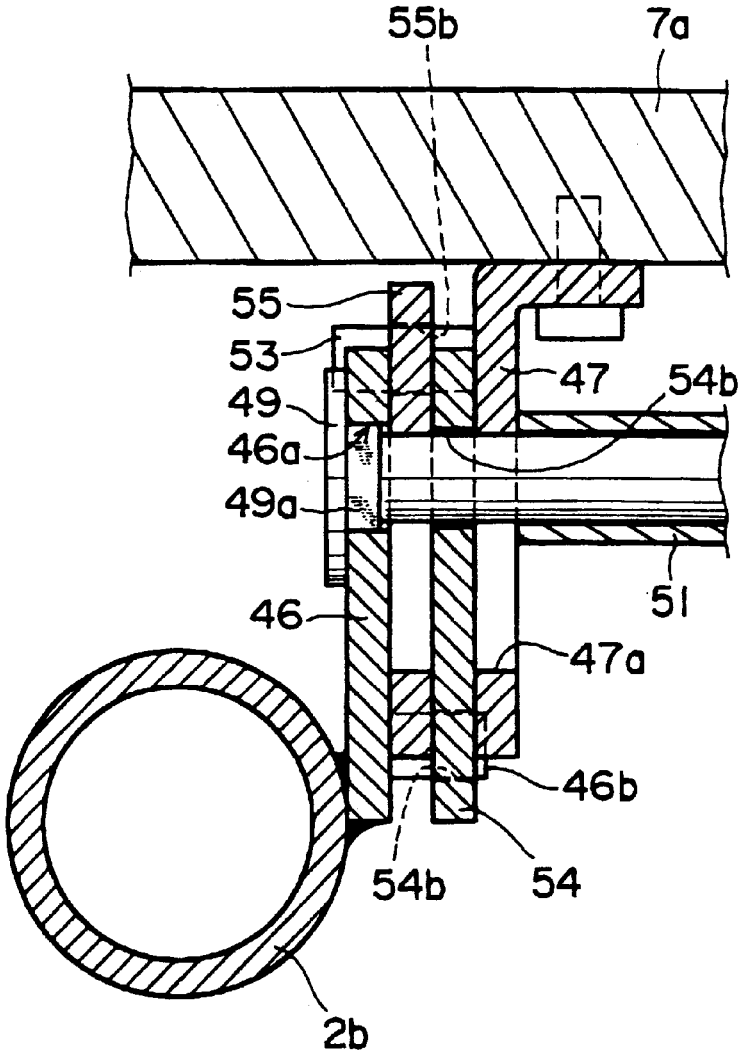
FIG. 28 is a transverse cross-sectional view showing the bracket structure for attaching the headrest to the frame.

The first brackets 46 and the second brackets 47 are so provided as to be positioned on the right and left sides of the headrest 7. The first brackets 46 symmetrically arranged on both of the sides as shown in FIG. 26 are welded on the inner side surface of the pipe 2*b* as shown in FIGS. 27 and 28. On the other hand, the second brackets 47 are symmetrically arranged on the inner sides of the right and left first brackets 46 as shown in FIG. 26. The second brackets 47 have two types of screw holes 47*a* and 47*b* such as shown in FIG. 27 and are fixed on the back side of the base 7*a* for the headrest 7 by screwing using the holes 47*a* and 47*b*.

Here, although the first bracket 46 and the second bracket 47 may be provided in the adjacent manner so that they directly come into contact with each other, it is preferable to increase the frictional force by provision of a friction plate or an elastomeric material between both brackets 46 and 47 in order to assuredly fix the headrest 7. For example, in this embodiment, as shown in FIG. 27, it is preferable that a pair of friction plates consisting of a frame side friction plate 54 and a headrest side friction plate 55 are provided between the first bracket 46 and the second bracket 47. Of course, a number of friction plates is not ,restricted to two, and more friction plates may be used. Further, the friction plates may be incorporated in at least one of the bracket pairs provided on right and left sides of the headrest 7. The frame side friction plate 54 is supported relative to the first bracket 46 so as not to rotate by inserting two pins 46*b* protruding from the bracket 46 into two engagement holes 54*b*. Additionally, a through hole 54*a* is formed at a position of the friction plate 54 which is on the same axis as a through hole 46*a* of the first bracket 46. Moreover, the headrest side friction plate 55 is supported relative to the second bracket 47 so as not to rotate by inserting two pins 53 protruding from the bracket 47 into two engagement holes 55*b*. Moreover, a through hole 55*a* is formed at a position of the friction plate 55 which is on the same axis as a through hole 47*a* of the second bracket 47. Here, the through holes 47*a* and 55*a* of the headrest side friction plate 55 and the second bracket 47 are constituted as long holes elongated in a direction vertical to the pipe 2*b* (a direction of the height of the headrest). In this manner, the pair of brackets 46 and 47 attached to the right and left pipes 2*b* and the headrest 7 and the two friction plates 54 and 55 are arranged in the order of, e.g., the bracket 46, the friction plate 55, the friction plate 54, and the bracket 47 as shown in FIG. 28, and they are then tightened by coupling means 48 consisting of one fastening bolt and a pipe 51. Here, a structure such that the headrest 7 can move close to or away from the pipe 2*b* can suffice the long hole 47*a*, and, for example, a long hole elongated in a direction oblique to the axial direction of the pipe 2*b* may be adopted.

The coupling means 48 has a function for sandwiching the first bracket 46 and the second bracket 47 to which the right and left frames 2*b* are respectively arranged and then allowing or preventing their relative rotation. In this embodiment, the coupling means 48, as shown in FIG. 26, includes: a fastening bolt 49 piercing the first and second brackets 46 and 47 on both sides; a fastening handle 50 which is fitted with a screw portion at an end of the fastening bolt 49 for fastening; the pressure pipe 51 which is provided between the right and left second brackets 47 through which the fastening bolt 49 is inserted to maintain a distance between these brackets constant; and whirl stopping means consisting of a rectangular neck portion 49*a* of the fastening bolt 49 and a rectangular whirl stopping hole (through hole 46*a*) of the first bracket 46. Therefore, the fastening bolt 49 pierces through the first and second brackets 46 and 47 on both sides, the friction plates 55, and the pressure pipe 51 as a spacer arranged between the right and left second brackets 47, and the neck portion 49*a* is then fitted to the rectangular through hole 46*a* of one first bracket 46 and set so as not to rotate. Subsequently, the handle 50 is screwed and tightened, the right and left bracket pairs can be firmly sandwiched through the pressure pipe 51, thereby fixing the headrest 7 to the pipe 2*b* of the back portion 2. When the handle 50 is slightly loosened, the frictional force generated between the first bracket 46 and the second bracket 47 is reduced so that the headrest 7 can be freely inclined around the bolt 49.

It is to be noted that the fastening bolt 49 may be rotatably provided to the first bracket 46 and the second bracket 47 and fasten the brackets 46 and 47 by turning thumbscrews from both of the ends. In addition, the flanges may be formed on both ends of the pressure pipe 51 to enlarge the contact area with the second bracket 47.

With the above-described structure, tilt of the headrest 7 can be adjusted, but this embodiment also has a mechanism for moving up and down the headrest 7 so as to be close to or away from the frame 1 as well as the tilt adjustment mechanism. The vertical movement mechanism can be formed by designing either the through hole 46*a* of the first bracket 46 or the through hole 47*a* of the second bracket 47 as a long hole elongated in a direction of the height of the headrest 7. In this embodiment, as shown in FIG. 27, the through hole 47*a* on the second bracket 47 side is determined as a long hole to allow vertical movement of the headrest 7 in the stroke range of this long through hole 47*a*. According to this vertical movement mechanism, the headrest 7 is provided with the tilt adjustment function as well as the height adjustment function, and the tilt adjustment is enabled at any height.

Figure 29:
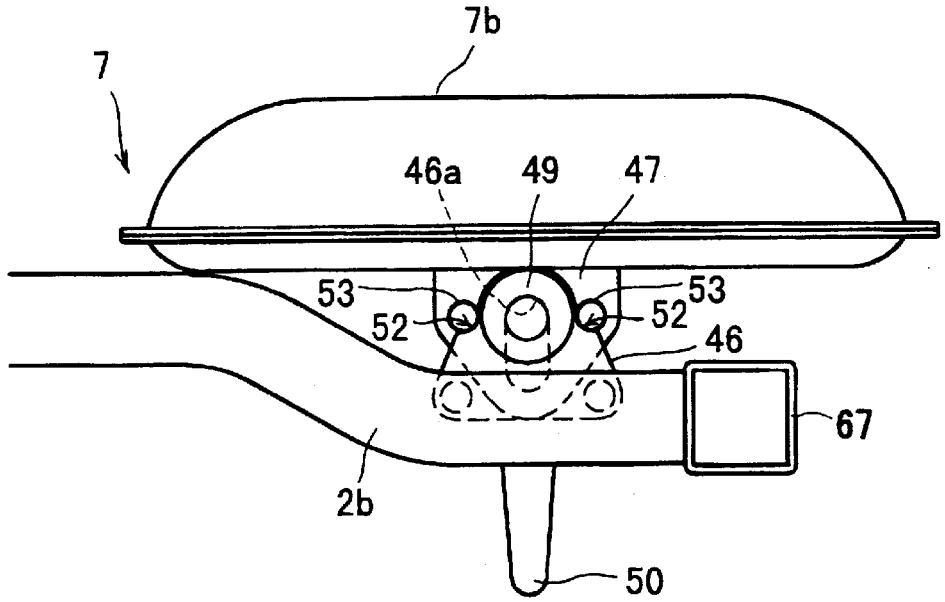
FIG. 29 is a partial side view showing the headrest placed at a headrest retracted position.

In addition, it is preferable that the height of the headrest 7 becomes equal to that of the mat surface 112 when the headrest 7 is returned to the headrest retracted position to provide a structure such that the tilt is unchanged depending on transfer of a patient. Such a mechanism can be realized by providing the structure that, for example, the first bracket 46 and the second bracket 47 which relatively rotate are engaged with each other to avoid rotation when the first bracket 46 and the second bracket 47 are placed at the retracted positions (the state shown in FIG. 25). For example, in this embodiment, shoulder portions 52 such as shown in FIGS. 25 and 27 are formed to the first bracket 46, and restriction pins 53 of the second bracket 47 come into contact with the shoulder portions 52 to prevent the second bracket 47 from rotating. The shoulder portion 52 is not limited to a specific shape only if it can come into contact with the restriction pin 53 at the headrest retracted position. In this embodiment, however, the shoulder portions 52 have a symmetrical shape as shown in FIG. 29 in accordance with the cylindrical restriction pins 53 to intend the bearing dispersion.

Figure 30:
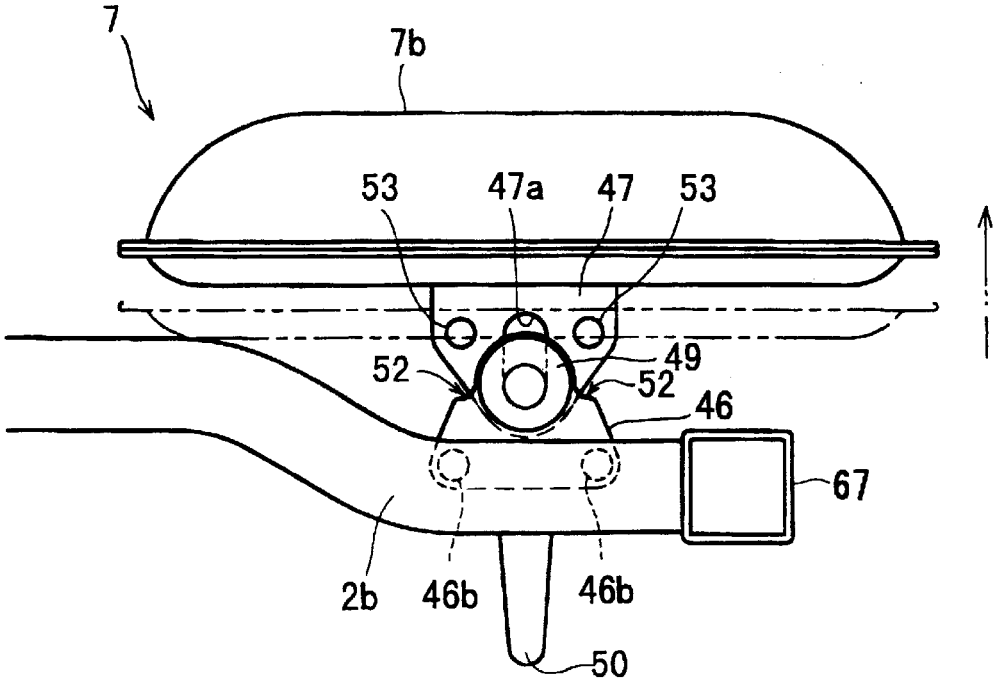
FIG. 30 is a partial side view showing the headrest moved to the upper portion.
Figure 31:
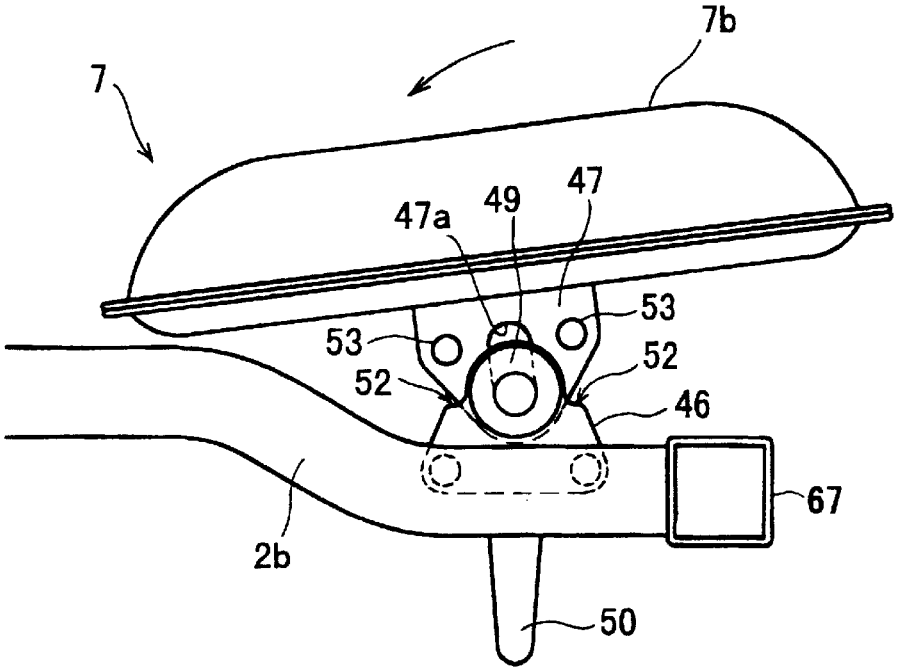
FIG. 31 is a partial side view showing the headrest tilted toward a patient from the state illustrated in FIG. 30.
Figure 32:
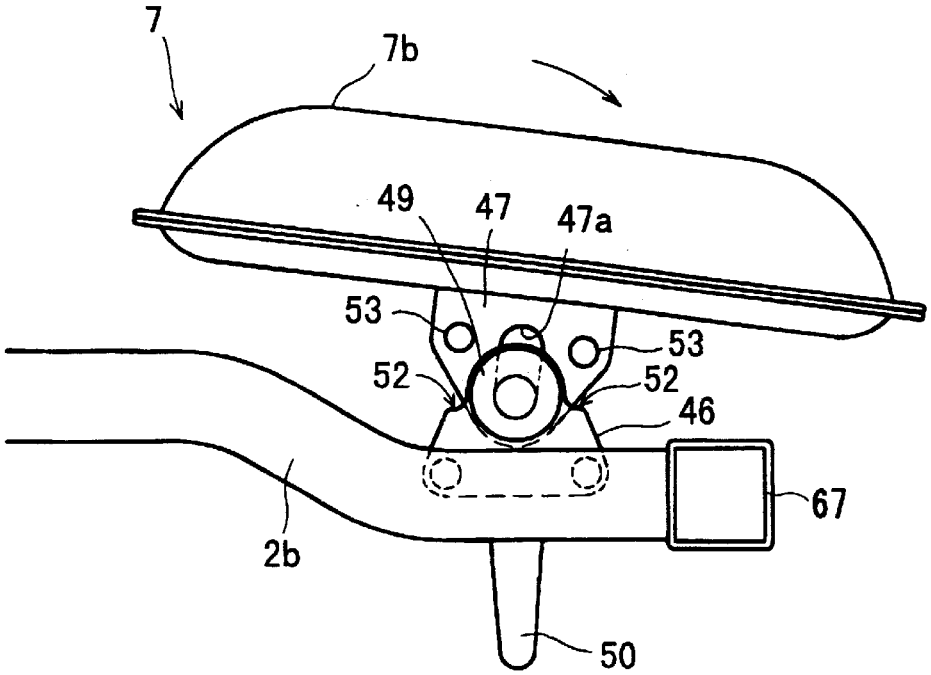
FIG. 32 is a partial side view showing a headrest tilted toward a side opposed to the patient from the state illustrated in FIG. 30.

Further, the first bracket 46 is designed to have an outside form such that the first bracket 46 comes into contact with the restriction pins 53 only at the headrest retracted position and, when the headrest 7 is lifted up away from the pipe 2*b*, swiveling of the second bracket 47, i.e., movement of the restriction pins 53 is not obstructed. In this embodiment, for example, as shown in FIG. 26 and others, the central upper portion of the first bracket 46 is formed into a semicircular shape with the through hole 46*a* as the center. In this case, when the headrest 7 is lifted up as shown in FIG. 30, the shoulder portions 52 of the first bracket 46 do not come into contact with the restriction pins 53 of the second bracket 47 when the tilt adjustment is carried out as shown in FIGS. 31 and 32. The tilt of the second bracket 47, i.e., the tilt of the headrest 7 can not be hence obstructed. It is to be noted that the tilt adjustment is enabled at all the positions except the headrest retracted position even though the headrest 7 does not reach the upper stroke end of the long through hole 47*a*. In addition, a position in the long through hole 47*a* at which the tilt is performed and an amount of tilt of the headrest 7 are determined depending on the shape of the shoulder portion 52 or the relative position of the restriction pin 53.

When transformed in the stretcher configuration as shown in FIGS. 1 and 3, the headrest 7 having the above-described structure forms one flat surface with the mat 27 by moving down to the headrest retracted position. Alternatively, when transformed into the wheelchair configuration shown in FIG. 2, the headrest 7 is flush with the surface of the back portion 2. Here, the headrest 7 is horizontally maintained at the same height as another mat surface 112 by bringing the restriction pins 53 of the second bracket 47 into contact with the shoulder portions 52 of the first bracket 46, which can not be an obstacle for transfer of a patient between the stretcher and a bed. In this case, an unexpected movement of the headrest 7 can be avoided by fastening the coupling means 48.

When the height and the angle of the headrest 7 must be adjusted, the fastening bolt 49 is loosened by turning the handle 50 to allow relative-movement/rotation between the first bracket 46 and the second bracket 47, and the headrest 7 is lifted up to a desired height as shown in FIG. 30. When the headrest 7 is raised, since the restriction pins 53 move away from the shoulder portions 52, the headrest 7 can be inclined as shown in FIG. 31 or 32. When the desired height and angle are obtained, the handle 50 can be tightened to fix a part between the first and second brackets 46 and 47 by the frictional force. When the headrest 7 is inclined toward a patient as shown in FIG. 31, a large holding surface can be obtained along the back of a head. Whilst, when the headrest 7 is inclined toward the opposed side, an area for holding the back of a head is reduced but the height can be easily assured. Incidentally, it is needless to say that the headrest 7 moves in the front-and-back direction when transformed into the wheelchair.

Moreover, in the stretcher configuration for example, the headrest 7 is returned to the original headrest retracted position by its own weight when loosening the handle 50. In this case, since the restriction pins 53 come into contact with the shoulder portions 52 to enter the positioning state, the headrest 7 automatically becomes horizontal to be flush with the mat surface 112. Therefore, under such a condition that the rapid and safe movement of a patient is demanded for example, the headrest 7 can be rapidly and assuredly returned to the headrest retracted position to get prepared for transfer or movement of a patient.

Although the headrest 7 is positioned by bringing the restriction pins 53 provided to the second bracket 47 into contact with the shoulder portions 52 provided to the first bracket 46 in this embodiment, the mode for carrying out positioning is not restricted thereto. For example, as shown in FIG. 27, the headrest 7 can be positioned by utilizing the engagement pins 46*b* provided for engaging the frame side friction plate 54 with the first bracket 46. In this case, the shoulder portions which simultaneously come into contact with the two engagement pins 46*b* only when the headrest 7 is placed at the headrest retracted position may be provided to the second bracket 47, and to the headrest side friction plate 55 if necessary. By doing so, the headrest 7 can be positioned as similar to the foregoing embodiment.

Here, although description has been mainly given as to the embodiment in which the above-mentioned headrest 7 is constituted by one plate-like material which can not be transformed, the headrest itself may adopt the bendable structure in some cases.

Figure 33:
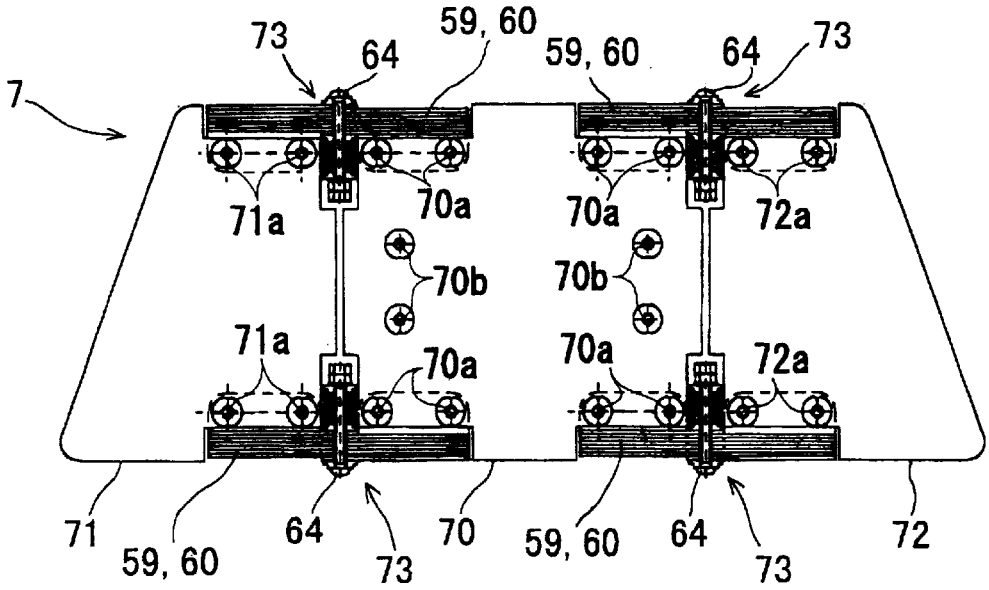
FIG. 33 is a plane view showing headrest provided with a support mechanism.
Figure 36:
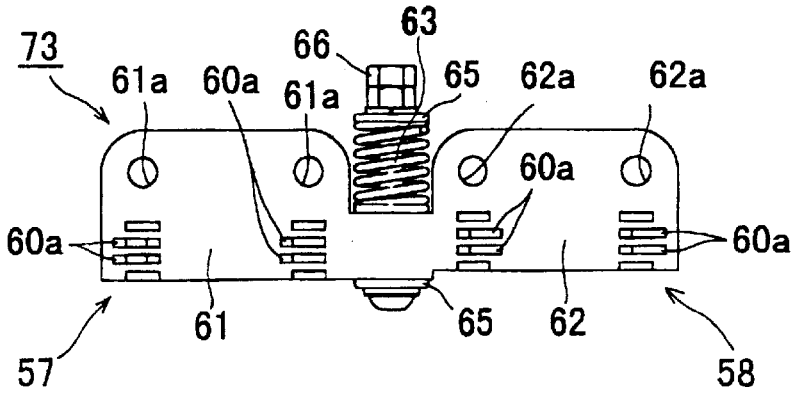
FIG. 36 is a plane view showing a flexible mechanism.

For example, as shown in FIG. 33, the head of a patient may be held on one side or both sides by dividing the core material of the headrest 7 into a central fixed core material 70 fixed to the pipe 2*b* and movable core materials 71 and 72 on both of the sides which are movably connected to the fixed core material 70 and by coupling the left side movable core material 71 and the right side movable core material 72 with each other through the flexible mechanisms 73 in the bendable manner.

Incidentally, in the headrest 7 according to this embodiment, the fixed core material 70 has a substantially rectangular shape, and the left side movable core material 71 and the right side movable core material 72 forms a symmetrical trapezoidal shape. Further, through holes 70*a*, 71*a* and 72*a*, for attaching a fixed side member 57 or a movable side member 58 of the flexible mechanism 73 are formed to the respective core materials 70 to 72, and through holes 70*b* for attaching the headrest 7 to the pipe 2*b* of the frame 1 are formed to the fixed core material 70.

The flexible mechanism 73, as shown in FIGS. 36 to 43, couples the fixed side member 57 attached to the fixed core material 70 with the movable side member 58 attached to the movable core material 71 or 72 by a hinge structure in the bendable manner. Incidentally, although one of these members is referred to as the fixed side and the other is referred to as the movable side in the specification of the present application for the convenience sake, the concept of the fixed side/movable side is only relative, and they can be considered to be reversed when only two members, i.e., the fixed side member and the movable side member are used for example.

Figure 37:
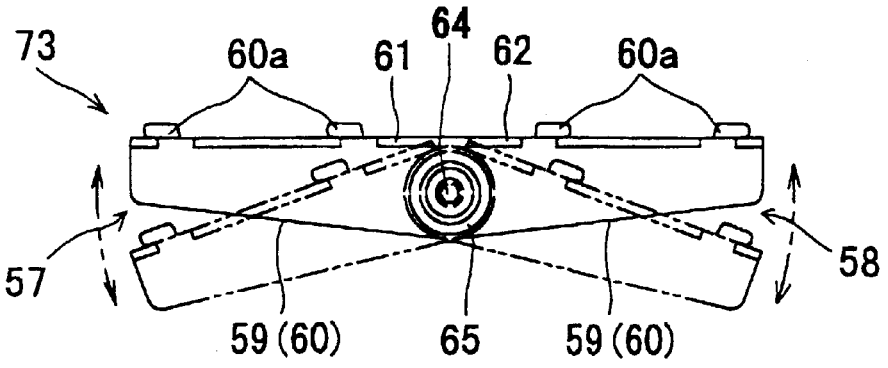
FIG. 37 is a front view of the flexible mechanism depicted in FIG. 36.
Figure 38:
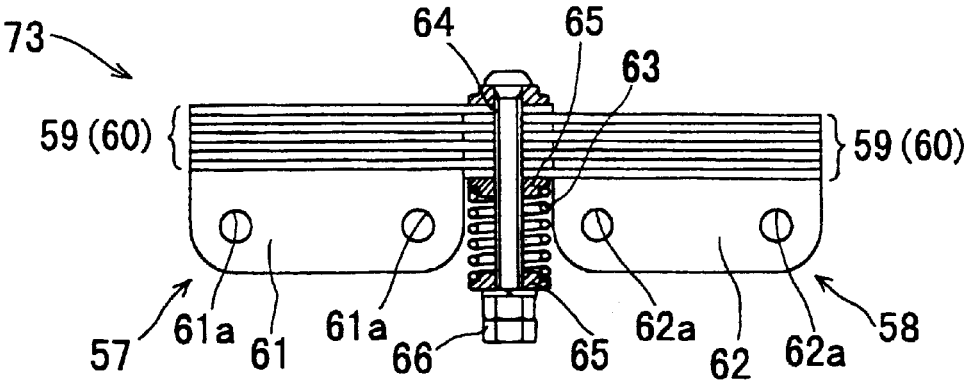
FIG. 38 is a back side view of the flexible mechanism illustrated in FIG. 36.
Figure 39:
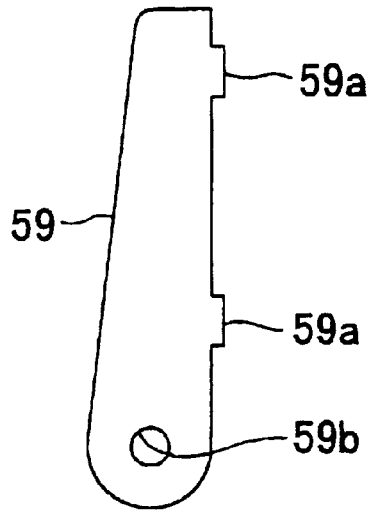
FIG. 39 is a view showing a shape of a fixed overlapping plate.
Figure 40:
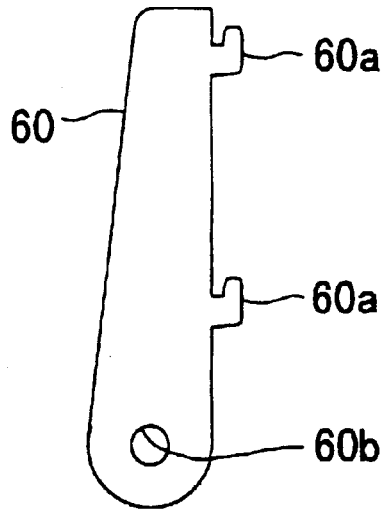
FIG. 40 is a view showing a shape of a movable overlapping plate.
Figure 41:
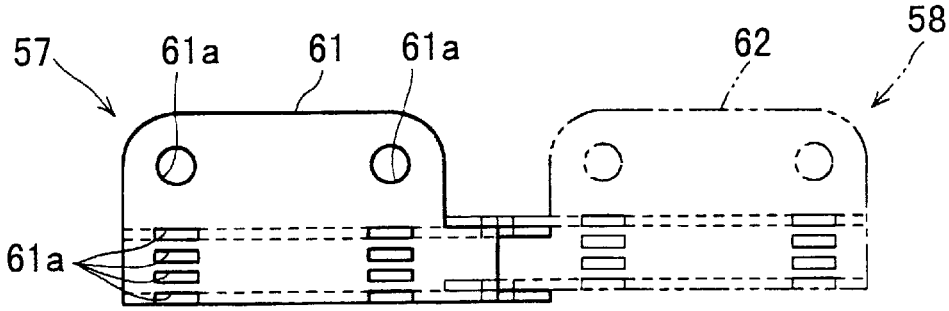
FIG. 41 is a plane view showing the state where a fixed side member and a tilted side member to both of which the fixed overlapping plate is fixed are combined.

The fixed side member 57 is, as shown in FIG. 38, constituted by one base plate 61 and a plurality of overlapping plates 59 and 60 attached on the base plate 61. A number of the overlapping plates 59 and 60 is not limited to a specific number, and a total of four plates are used as shown in the drawing in this embodiment for example. The number may be, however, reduced or increased. As shown in FIGS. 39 and 40, claws 59*a* and 60*a* for attaching the plates to the base plate 61 are provided to the respective overlapping plates 59 and 60, and attachment holes 61 a associated with these claws 59*a* and 60*a* are provided to the base plate 61. As shown in FIG. 37, among the plurality of attachment holes 61*a*, one provided to the end of the base plate 61 may be an attachment groove.

Figure 43:
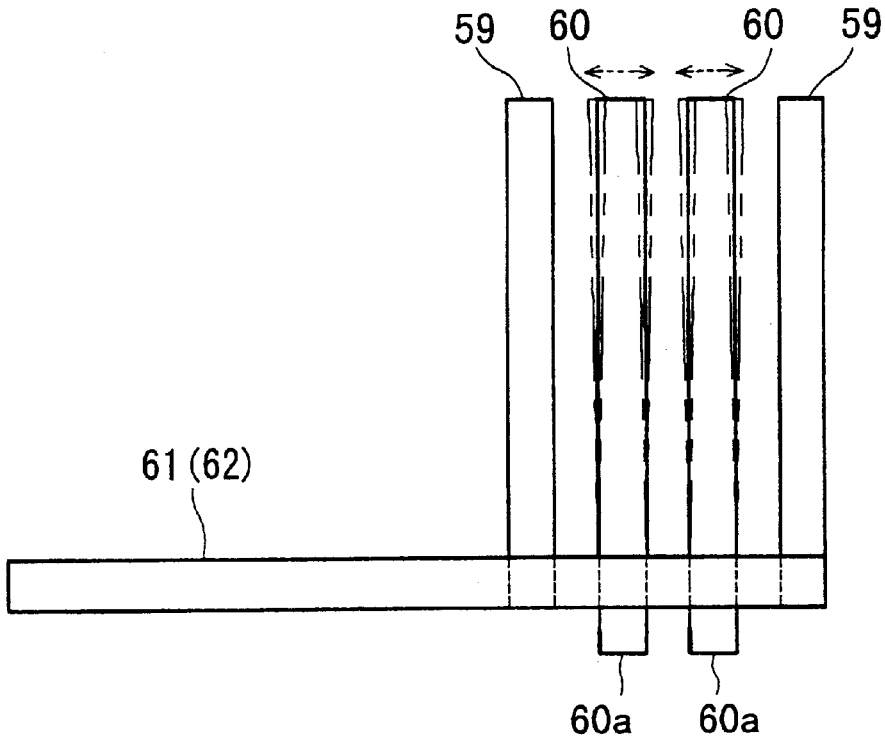
FIG. 43 is a view showing the attachment relationship between the fixed overlapping plate and the movable overlapping plate on a base plate.

The plurality of overlapping plates 59 and 60 are arranged in parallel on the fixed side base plate 61 at desired intervals. In this embodiment, the arrangement intervals have a fixed pitch, and the pitch interval coincides with the thicknesses of the overlapping plates 59 and 60. All of these overlapping plates 59 and 60 may be fixed to the base plate 61. However, it is preferable that, among the four plates, two plates positioned on the inner side can be slightly inclined as shown in FIG. 43. By doing so, when the four overlapping plates 59 and 60 for each of the fixed side member 57 and the movable side member 58 are alternately inserted to overlap each other, the respective plates 59 and 60 can readily get into under the mutual gaps.

In this embodiment, since the two overlapping plates 59 arranged on the outer side are fixed to the base plate 61 as shown in FIG. 39, these plates have projecting claws 59*a* which are suitable for being fitted into the attachment holes (attachment grooves) 61*a* of the base plate 61 to be positioned and further fixed to the base plate 61 by welding or any other fixing means. On the other hand, the two overlapping plates 60 arranged on the inner side are not fixed to the base plate 61 by welding in order that they are movable relative to the base plate 61, and engagement claws 60*a* are engaged to the attachment holes 61*a* of the base plate 61 so as to be hooked. This engagement claw 60*a* is engaged so as to allow the overlapping plate 60 to be tilted in the overlapping direction as shown in FIG. 43 but prevent the overlapping plate from coming off the fixed side base plate 61. For example, as shown in FIG. 40, the engagement claw 60*a* consists of two hooks curved in the uncinate form in the same direction. Incidentally, in this case, when the respective claws 60*a* of the respective movable overlapping plates 60 of the fixed side member 57 and the movable side member 58 are arranged to face outwards, the engagement claw 60*a* can be slid in reverse to hardly come off the attachment hole 61*a* even if the flexible mechanism 73 is repeatedly bent.

Figure 44:
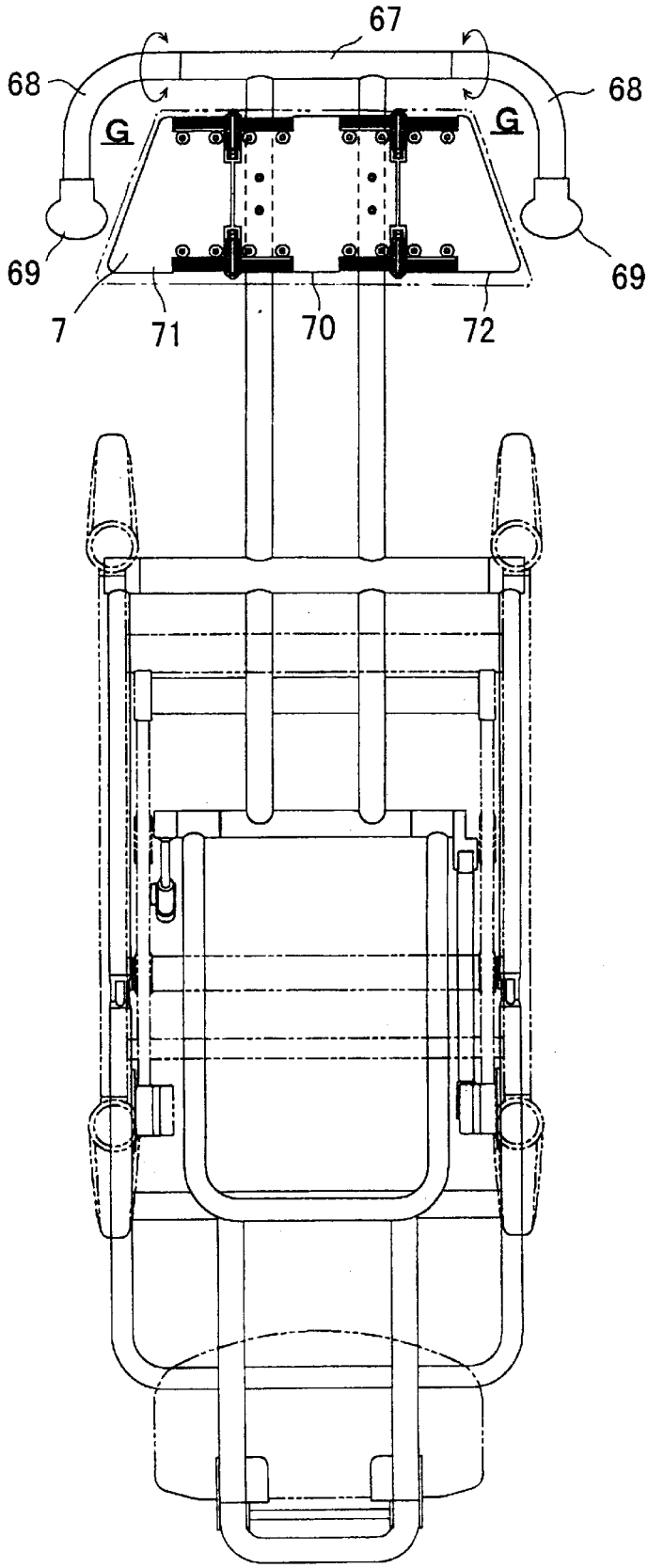
FIG. 44 is a plane view showing the stretcher having only the frame and the headrest.
Figure 45:
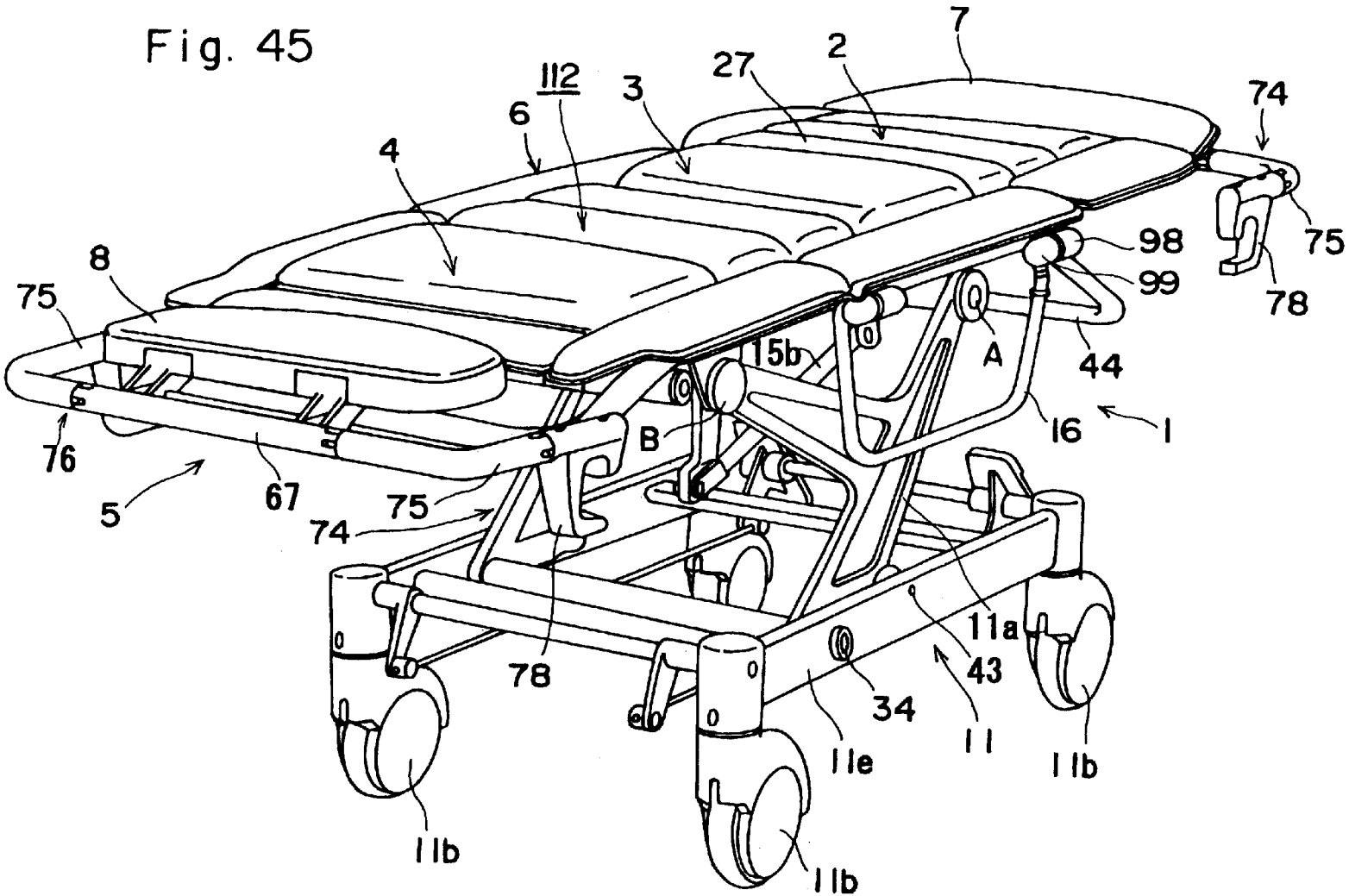
FIG. 45 is a perspective view of the stretcher having a lever device mounted thereon in the stretcher configuration.

Illustrating attachment of these overlapping plates 59 and 60 to the fixed side base plate 61, when the fixed overlapping plates 59 on the outer side are first fixed to the base plate 61, the state shown in FIGS. 43 to 45 can be obtained. Further, the movable overlapping plates 60 are attached to the gap between the fixed overlapping plates 59 by inserting and sliding the hook-like engagement claws 60*a* into the attachment holes 61*a* as shown in FIG. 43. The movable overlapping plates 60 can be slightly tilted toward any of the fixed overlapping plates 59.

Figure 42:
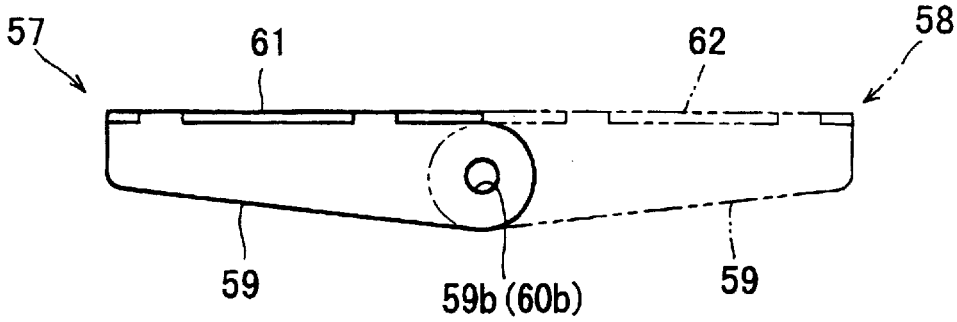
FIG. 42 is a front view of the fixed side member and the tilted side member illustrated in FIG. 41.

Further, as shown in FIGS. 39 and 40, through holes 59*b* and 60*b* are formed to the overlapping plates 59 and 60. The through holes 59*b* and 60*b* are formed for inserting a coupling shaft 64 which is a center of tilting therethrough as shown in FIG. 42. After overlapping the fixed side member 57 and the movable side member 58 such that the respective through holes 59*b* and 60*b* are matched with each other, the coupling shaft 64 is inserted and fastened by a nut 66, thereby coupling the fixed side member 57 and the movable side member 58 with each other so as to be capable of swiveling.

Figure 34:
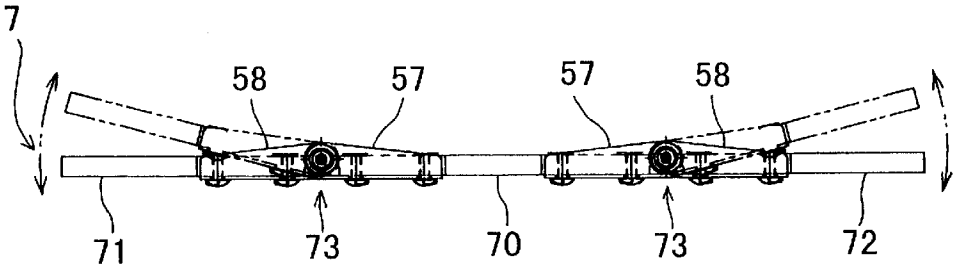
FIG. 34 is a front view of the headrest illustrated in FIG. 33.
Figure 35:
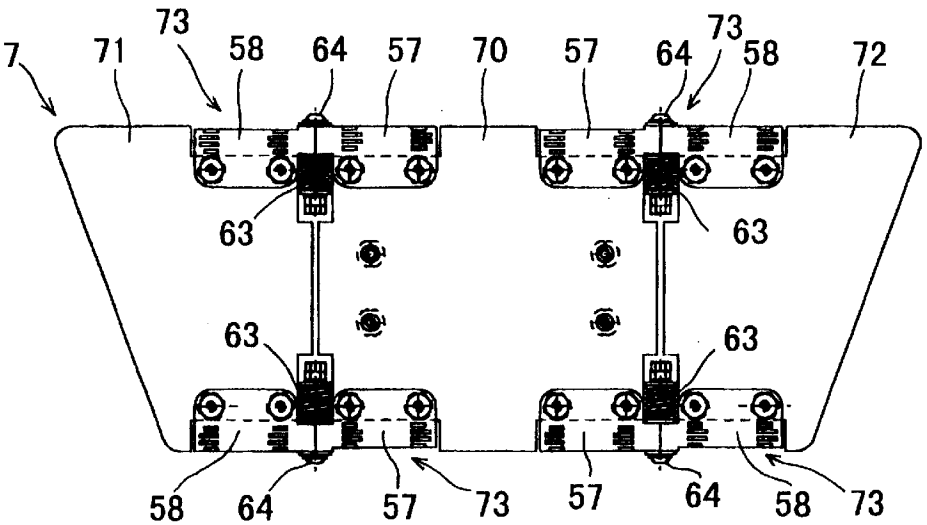
FIG. 35 is a back side view of the headrest illustrated in FIG. 33.

As described above, although the overlapping plates 59 and 60 are attached to the base plate 61 to constitute the fixed side member 57, the other movable member 58 is also constituted as similar to the fixed side member 57. For example, in this embodiment, as shown in FIG. 37, the overlapping plates 59 and 60 have the same shape as the fixed side member 57 are attached to a movable side base plate 62 having attachment holes (attachment grooves) 62*a* as similar to the fixed side base plate 61 to form the movable side member 58. It is to be noted that, as shown in FIGS. 33 to 35, through holes 61*b* and 62*b* on the base plates 61 and 62 are used for screwing the fixed side member 57 and the movable side member 58 to the headrest 7.

The fixed side member 57 and the movable side member 58 formed as described above constitute the bendable hinge-like flexible mechanism 73 by alternately overlapping the fixed overlapping plate 59 and the movable overlapping plate 60 as shown in FIG. 40 and pining them to be coupled with each other by the coupling shaft 64. In this embodiment, as shown in FIGS. 38 and 39, when the fixed side member 57 and the movable side member 58 are opened 180 degrees, the inner edges of both base plates 61 and 62 come into contact with each other to prevent the opening angle from being further increased. Therefore, the bendable flexible mechanism 73 can adjust the tilt in a range up to the maximum opening angle of 180 degrees. If the flexible mechanism 73 is used as a support mechanism for the headrest 7 as in this embodiment, the flat state can be obtained when both movable core materials 71 and 72 of the headrest 7 are opened to the maximum level.

As described above, when the fixed overlapping plate 59 and the movable overlapping plate 60 are alternately overlapped, a desired angle can be held by utilizing the contact frictional force at the overlapping portion. However, since the flexible mechanism 73 constituting the headrest 7 is adopted, it is preferable that adjustment can be easily carried out to obtain a desired angle and the obtained angle can not be readily changed with respect to an external force after adjustment. Thus, in this embodiment, impetus giving means 63 for giving an impetus to the overlapping plates 59 and 60 in the overlapping direction is provided.

As shown in FIG. 38, the impetus giving means 63 is composed of, e.g., a coil spring arranged around the coupling shaft 64 on the same axis as the coupling shaft 64. The impetus giving means 63 has washers 65 on both ends thereof and is arranged between the nut 66 and plate 59 to constantly give an impetus to the overlapping plates 59 and 60, thereby pressing them. In this case, an impetus can be changed by adjusting a compression length of the coil spring 63 to control the frictional force. In this embodiment, although one end of the coupling shaft 64 is fastened by a double nut 66 having less looseness, adjustment of an impetus can be facilitated by providing means capable of manually adjusting an impetus such as a lever instead. It is to be noted that the coil spring described herein is a preferred example of the impetus giving means 63, but this means is not restricted to a specific type only if it can adjust a fastening force and press the overlapping plates 59 and 60. For example, a conical spring or rubber having an elastic force can be applied.

Furthermore, the headrest 7 having this flexible mechanism 73 can, as shown in FIG. 34, independently incline the left movable core material 71 and the right movable core material 72 with respect to the fixed core material 70 of the headrest 7. In this embodiment, as shown in the drawing, although the left movable core material 71 and the right movable core material 72 are connected to the central fixed core material 70 by the two flexible mechanisms 73, a single flexible mechanism 73 may be used to connect them. In addition, although the fastening force is independently adjusted in accordance with each flexible mechanism 73, adjustments for both mechanisms 73 can be simultaneously conducted by, e.g., coupling the coupling shaft 64. The headrest 7 may be divided into two parts so that inclination can be adjusted in the V form.

According to the headrest 7 having the above-described configuration, since either or both of the headrest side portions can be bent by a necessary amount, the head of a patient can be appropriately supported. Further, since the left movable core material 71 and the right movable core material 72 can be independently tilted, a desired shape can be easily obtained, and the head can not fall off because both of the sides do not become lower than the central portion. Also, since the impetus giving means 63 fastens the overlapping plates 59 and 60, adjusting an impetus to obtain a desired frictional force can facilitate adjustment of a fastening force by a user and the like, i.e., so-called customization (acquiring a bending strength in accordance with a difference in the weight/physical constitution of patients). In addition, an external force exceeding a frictional force between the overlapping plates 59 and 60 can be used to bend the movable member 71 or 72 at a desired tilt angle, and eliminating that external force can maintain that state, which enables rapid adjustment after transfer of a patient.

It is to be noted that the shape of the headrest 7 is appropriately determined in accordance with needs of design or function and is not restricted to a specific type. In this embodiment, however, as shown in FIG. 33 and others, the headrest 7 is formed into such a trapezoidal shape as that the right and left movable core materials 71 and 72 are narrowed toward a parietal region of a patient. In this case, as shown in FIG. 44, when a lever 68 having the grip portion 69 at the top thereof is equipped around the headrest 7, it is possible to form a space G between the lever 68 and the sides of the headrest 7 for allowing a caregiver and the like to grip the lever 68.

Figure 61:
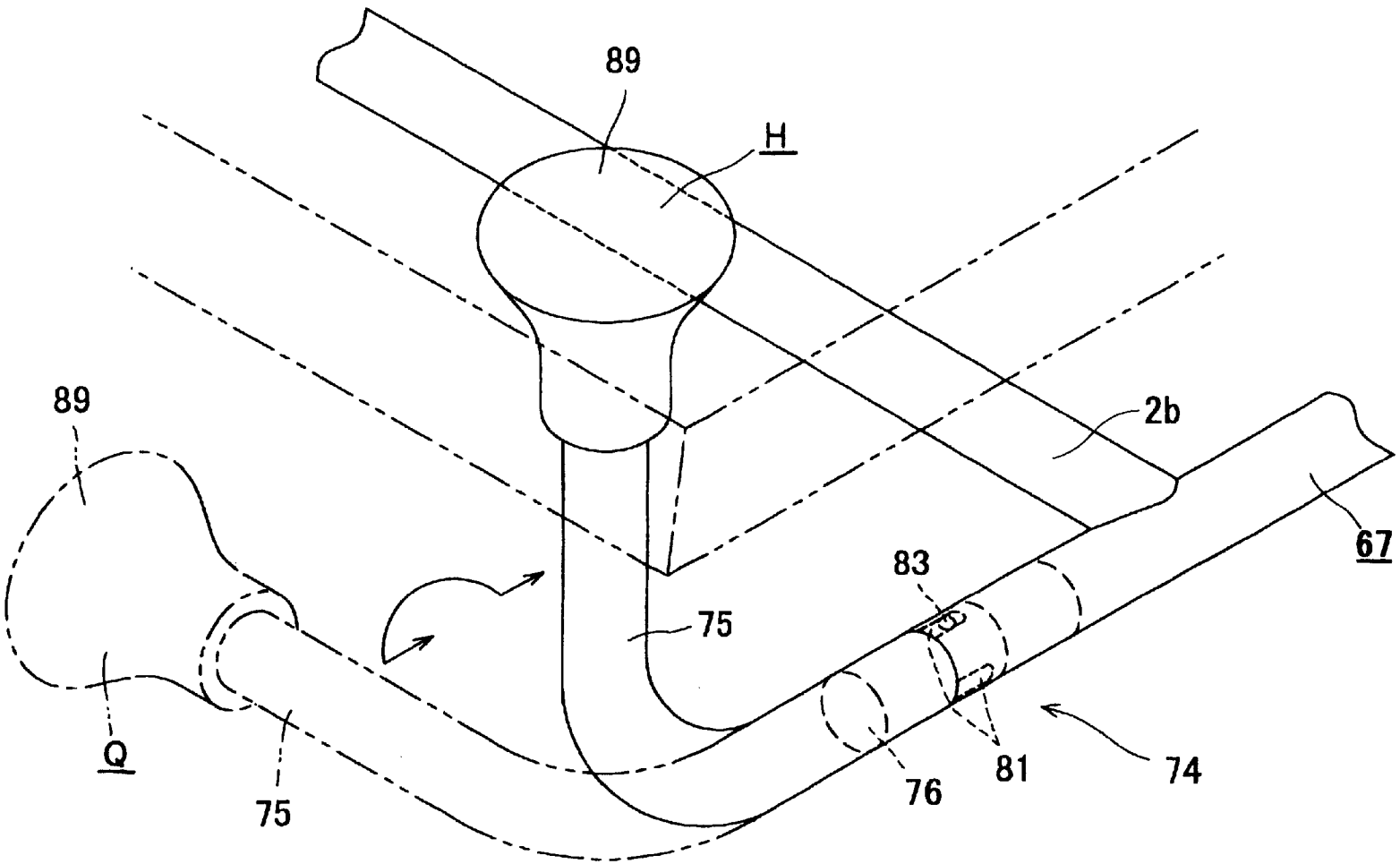
FIG. 61 is a perspective view showing still another embodiment of the lever device.

Here, the lever 68 has a bent L form as shown in the drawing and is provided at each end of he a handle bar 67 so as to rotate around the handle bar 67 though displacement fixing means 76, as shown in FIG. 61. When this lever 68 is raised 90 degrees and the grip portion 69 is gripped to push or pull the stretcher, a user can perform carriage in a comfortable posture without bending his/her body forward. It is to be noted that the handle bar 67 is a horizontal pipe provided at the head portion of the stretcher or the end of the footrest 8 and functions as a handle portion for subserving carriage of the stretcher.

As described above, since the headrest 7 has a trapezoidal shape, the grip portion 69 does not come into contact with the headrest 7 even if the lever 68 faces sideways. Therefore, when the lever 68 and the grip portion 69 are not used, they can be accommodated in the side part of the headrest 7. Additionally, the space G formed between the lever 68 and the headrest 7 can prevent a gripping hand from interfering the headrest 7 when gripping the lever 68 facing sideways. Moreover, it is possible to prevent the grip portion 69 from interfering the headrest 7 when the lever 68 is turned down. The headrest 7 has a trapezoidal shape in order to enable sufficient support for the head of a patient and accommodation of the lever 68. Further, it is only a preferred example for forming the space, and it is not restricted to this shape.

Incidentally, although both side portions of the headrest 7 can be continuously tilted in this embodiment, they may be tilted in the graded manner. As an example of gradual tilting, there are radial irregularities provided around the coupling shaft 64 in the contact area of the overlapping plates 59 and 60, and the gradual tilting width can be freely set at intervals of these irregularities. Further, at least convex parts in the irregularities can be made to have an angle shape, thereby assuring the smooth tilting.

Although the foregoing embodiment has described as to the case where all the overlapping plates 59 and 60 have the same thickness and are arranged to the base plates 61 and 62 at fixed intervals, the plate thickness or the arrangement interval does not have to be fixed. Even if the plate thickness is made uneven, when the plate intervals at which the respective plates 59 and 60 are overlapped are associated with each other, they can be overlapped to form the flexible mechanism 73, resulting in no problem.

This embodiment has mainly described as to the case where the core material of the headrest 7 is divided into three parts to be coupled with each other by the flexible mechanisms 73 and the cushion material or the cover arranged thereon is integrated to constitute one headrest as a whole, but the application range of this present invention is not restricted thereto. The present invention can be naturally applied to the case such that three independent support members are coupled with each other by two or more flexible mechanisms 73 to be capable of tilting in order to constitute one support mechanism as a whole.

The above has explained one mode in which the support mechanism consisting of a plurality of the flexible mechanisms 73, the fixed core material 70 and both movable core materials 71 and 72 is utilized in the headrest 7 in this embodiment. However, it is needless to say that this support mechanism can be also used for partially supporting a body of a patient in any other body holding/moving equipment. Briefly describing any other mode than the headrest 7, it can serve as a side support for holding both sides of a back in the wheelchair. In such a case, a pair of support mechanisms capable of adjusting the support width are provided on both sides of the backrest. Further, by appropriately changing a set part or conformation, it can also function as a mechanism for supporting a neck region, a head or a breech. Although a number of divided parts where deformation of the support surface is required varies depending on an applied equipment or part, the present invention can be applied if there is at least one member capable of tilting with respect to the fixed member.

An embodiment of the stretcher in which the transfer bar can be used shown in FIGS. 45 to 66 will now be described. The stretcher according to this embodiment has on the side portion thereof a handle device 74 including: a bracket 78 for taking up a sheet on which a patient is lying and rotatably attaching a transfer bar for transferring the patient on a bed and the like onto the stretcher together with the sheet; and a lever portion 75 for enabling a caregiver and the like to push the stretcher without bending his/her body forward.

Figure 48:
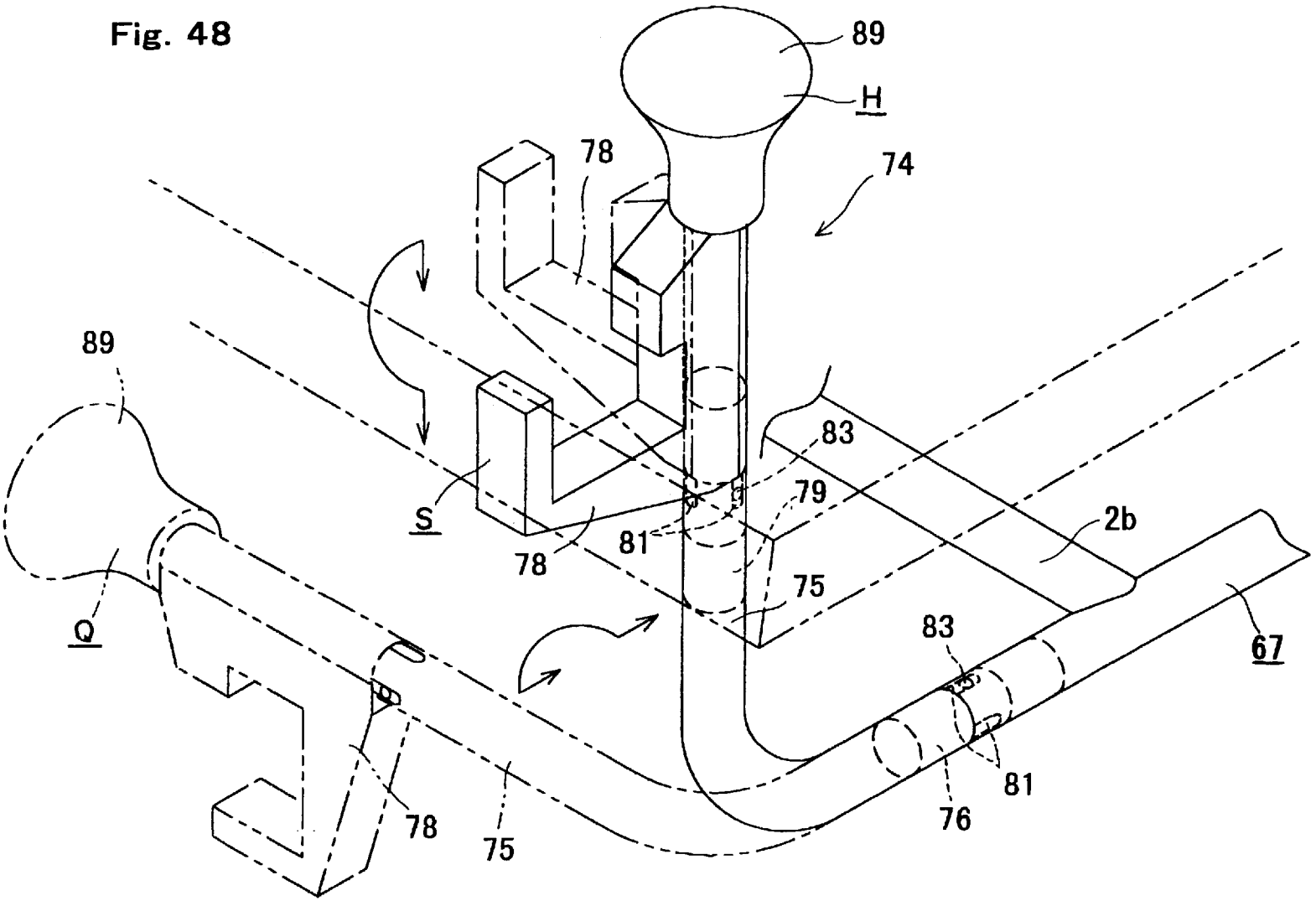
FIG. 48 is a perspective view showing the lever device.
Figure 49:
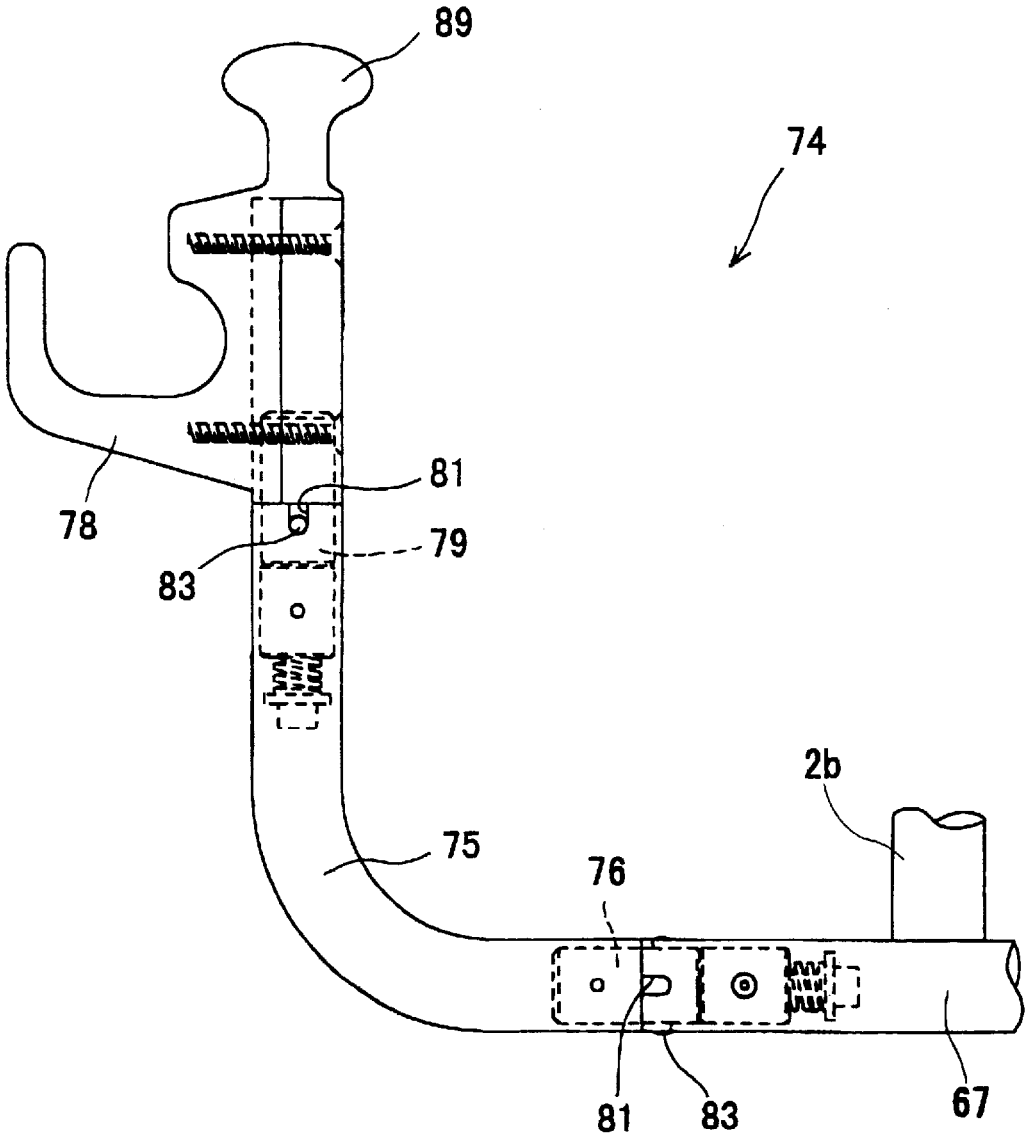
FIG. 49 is a front view showing the lever device.

The lever portion 75 is composed of an L-shaped pipe bent at approximately 90 degrees as shown in FIGS. 48 and 49. One end of the lever portion 75 is attached by first displacement fixing means 76 to the handle bar 67 which is provided to a part of the frame 1, e.g., the end of pipe 2*b* or the end of the pipe 5*b*, and rotating this end around the shaft center causes the other end to be horizontal or vertical, or to be displaced between these states. That is, the first displacement fixing means 76, as shown in FIG. 48, enables displacement of the L-shaped lever portion 75 at a handle position H where the L-shaped lever portion 75 is set upright and a lever retracted position Q where the lever portion 75 is horizontally laid (it may be set downwards in the vertical direction in some cases) and, at the same time, fixes it at the respective positions H and Q. Accordingly, since a caregiver can push or pull the stretcher by holding the lever portion 75 without bending his/her body forward by fixing the lever portion 75 at the handle position H, movement can be facilitated. When the lever portion 75 is fixed at the lever retracted position Q, it is possible to prevent the lever portion 75 from being an obstacle for a patient getting on and off the stretcher.

Figure 50:
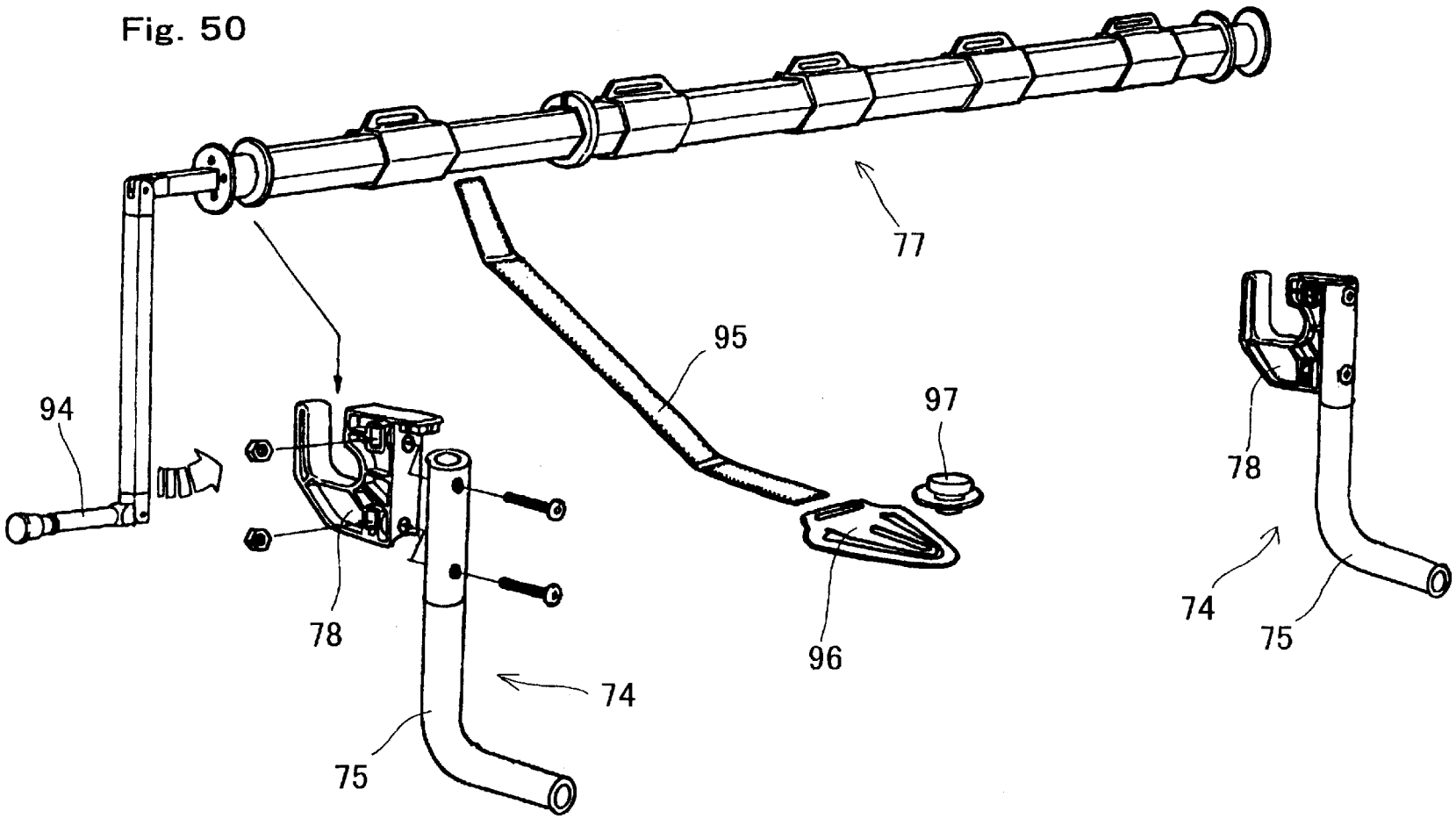
FIG. 50 is a perspective view showing a transfer bar.

Further, a bracket portion 78 which can rotatably support a transfer bar 77, such as shown in FIG. 50, is provided to the lever portion 75 through a second displacement fixing means 79. Incidentally, the transfer bar 77 includes: a handle 94; a plurality of straps 95 each of which is a Hook-and-Loop fastener such as a Velcro fastener and has a base end fixed to the transfer bar 77; a clip 96 which is provided to the end of the strap 95 to clip on the sheet; and a plug 97. The transfer bar 77 holds the sheet on which a patient is lying so as to sandwich the sheet between clips 96 of the straps 95 and the plugs 97 and then takes up the straps 95 by rotation of the transfer bar 77, thereby transferring the patient from a bed to the stretcher together with the sheet (see FIG. 50).

The second displacement fixing means 79 allows rotation of the bracket portion 78 at the end of the lever portion 75 on the same axis and prohibits rotation of the same by being fixed at a selected position in the rotating direction. For example, the bracket portion 78 in this embodiment can position the transfer bar 77 at a bar support position S enabling support of the transfer bar 77 by rotating the lever portion 75 being set at the handle position H, and can enable downward rotation when the lever portion 75 is set at the lever retracted position Q. At the same time, it can fix the lever portion 75 at the respective positions S and Q. Therefore, the transfer bar 77 can be attached to the bracket portion 78 to enable transfer of a patient by positioning the lever portion 75 at the handle position H and also positioning the bracket portion 78 at the bar support position S (indicated by the solid line in FIG. 48). In addition, when the bracket portion 78 is turned to the original position to set the lever portion 75 to the lever retracted position Q (indicated by the linkage double-dashed line in FIG. 48), the bracket portion 78 and the lever portion 75 are turned over on the side of the stretcher, and it is hence possible to prevent these portions from being an obstacle for a patient who is transferred to the stretcher or getting on and off the stretcher. Further, the bracket portion 78 is retracted at a position which can not be an obstacle while being attached to the lever device 74 when the bracket portion 78 is not used, which can prevent the bracket portion 78 from being lost or being damaged after removal.

The first and second displacement fixing means 76 and 79 rotatably couples the two members with each other on the same axis and fixes the two members so as to disable rotation by fitting at predetermined rotating positions. Each of these means is constituted by a first member having a notch which is so formed as to be opened on the abutting end surface side of the two members; a second member having an engagement protrusion fitted to the notch; means for coupling these members so as to be close to or away from each other; and impetus giving means for constantly pulling these members toward each other, and couples the first member and the second member with each other so as to enable relative rotation.

Figure 56:
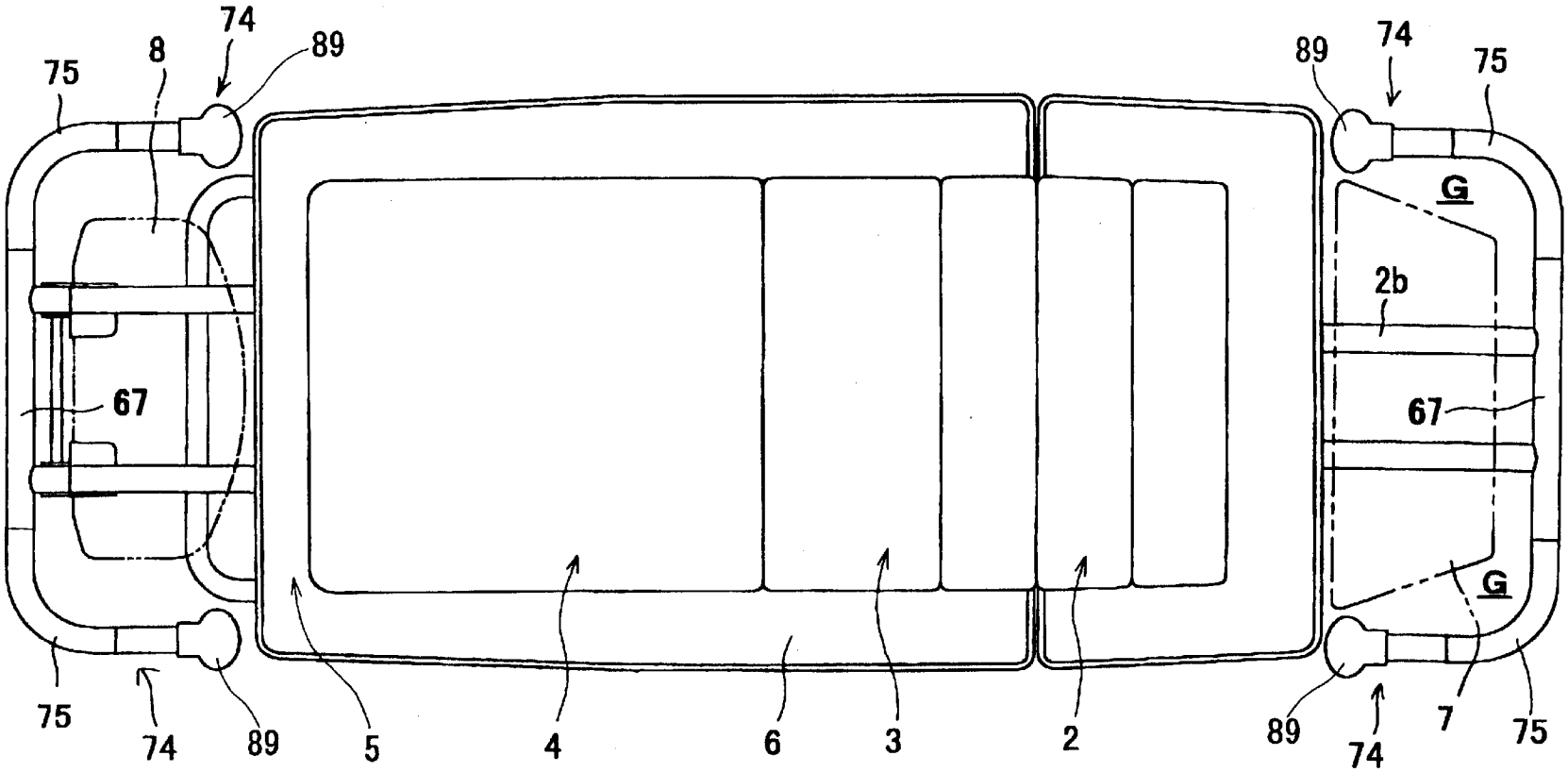
FIG. 56 is a plane view of the stretcher.
Figure 57:
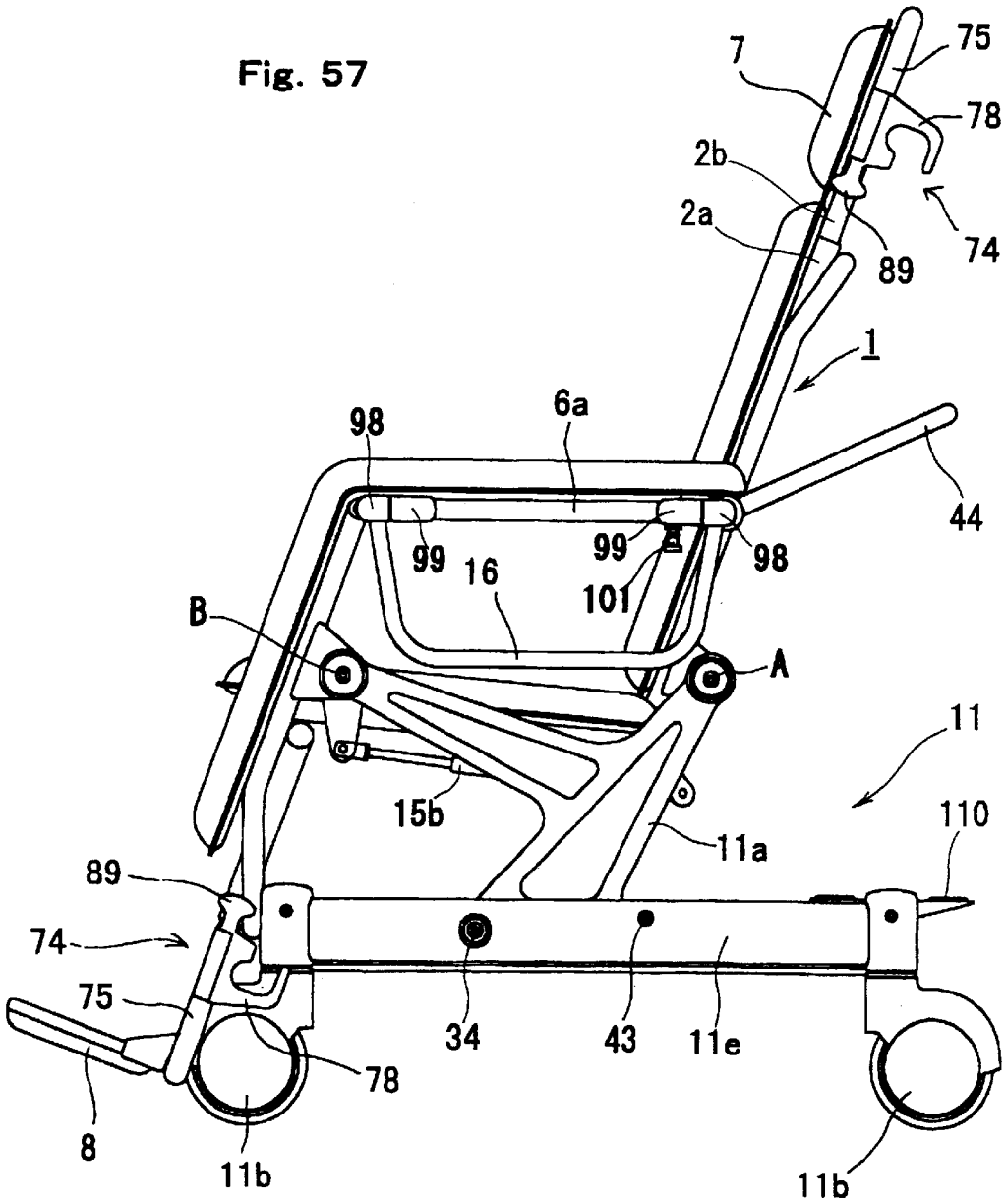
FIG. 57 is a side view of the stretcher.

In this embodiment, the respective displacement fixing means 76 and 79 are, as shown in FIGS. 56 and 57, formed as units independent from the lever portion 75 and the handle bar 67. That is, each of the displacement fixing means 76 and 79 is constituted by: a groove side sleeve 85 which is fixed to the handle bar 67 as the first member by vis shutting and the like and has a notch 81 so formed as to be opened on the end surface side; a protrusion holding member 87 which is fixed to the lever portion 75 as the second member and has an engagement protrusion 83 fitted to the notch 81; a protrusion side sleeve 88 fixed to the protrusion holding member 87 by vis shutting and the like; a spring bearing cylinder 84 which is fixed to the groove side sleeve 85 by vis shutting and the like and accommodates therein impetus giving means 80; a bolt 86 which pierces the spring bearing cylinder 84 so as to be capable of being slid and is screwed and fixed to the protrusion holding member 87; and a helical compression coil 80 as impetus giving means accommodated between a head portion 86*a* of the bolt 86 and a bottom portion 84*a* of the spring bearing cylinder 84 with a washer 91. It is to be noted that the protrusion holding member 87 and the protrusion side sleeve 88 may be integrally molded without being separated from each other.

Figure 55:
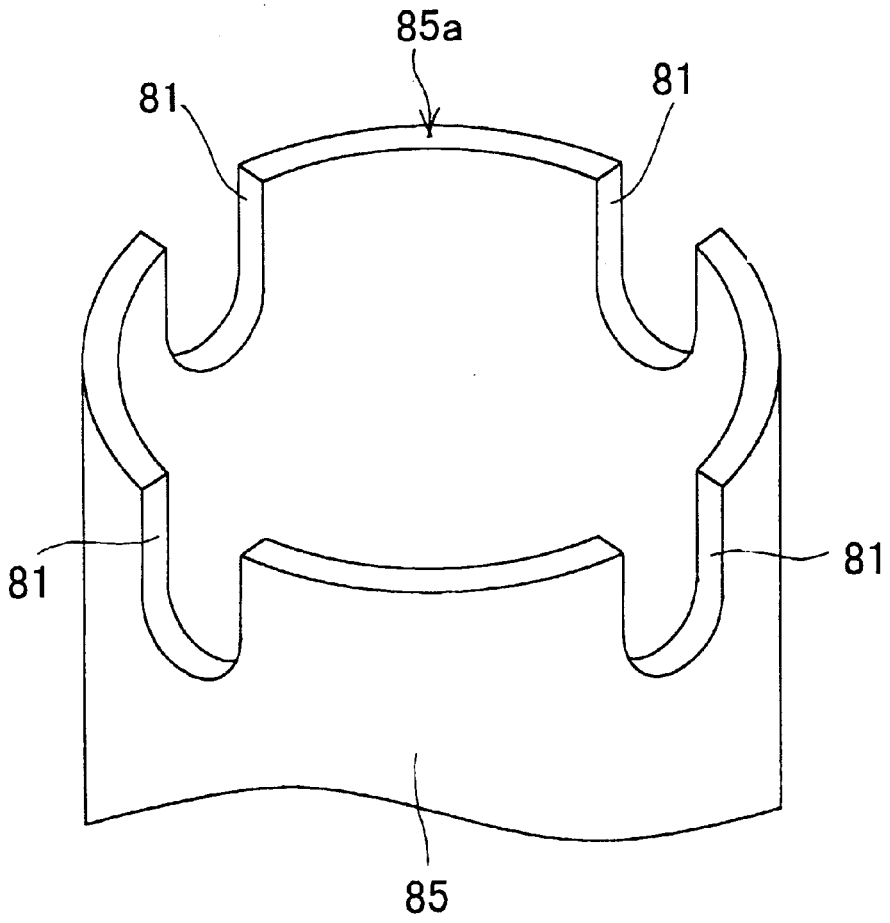
FIG. 55 is a perspective view showing a notch.

Here, the notches 81 are, as shown in FIG. 55, made into a shape obtained by being notched from an end surface 85*a* of the groove side sleeve 85 and formed at four positions at every 90 degrees. Therefore, the groove side sleeve 85 having the notch 81 and the protrusion side sleeve 88 having the engagement protrusion 83 can be fixed at every 90 degrees.

The engagement protrusion 83 is constituted by a pin piercing the protrusion holding member 87 in the radial direction, and the two engagement protrusions 83 are so provided as to be fitted to the notches 81 distanced at 180 degrees. Therefore, as compared with the case where the engagement protrusions 83 is provided at one position, the first members (spring bearing cylinder 84 and groove side sleeve 85) on the notch 81 side and the second members (protrusion holding member 87 and protrusion side sleeve 88) on the engagement protrusion side 83 can be further firmly fixed in the rotating direction of the second members 87 and 88.

Figure 51:
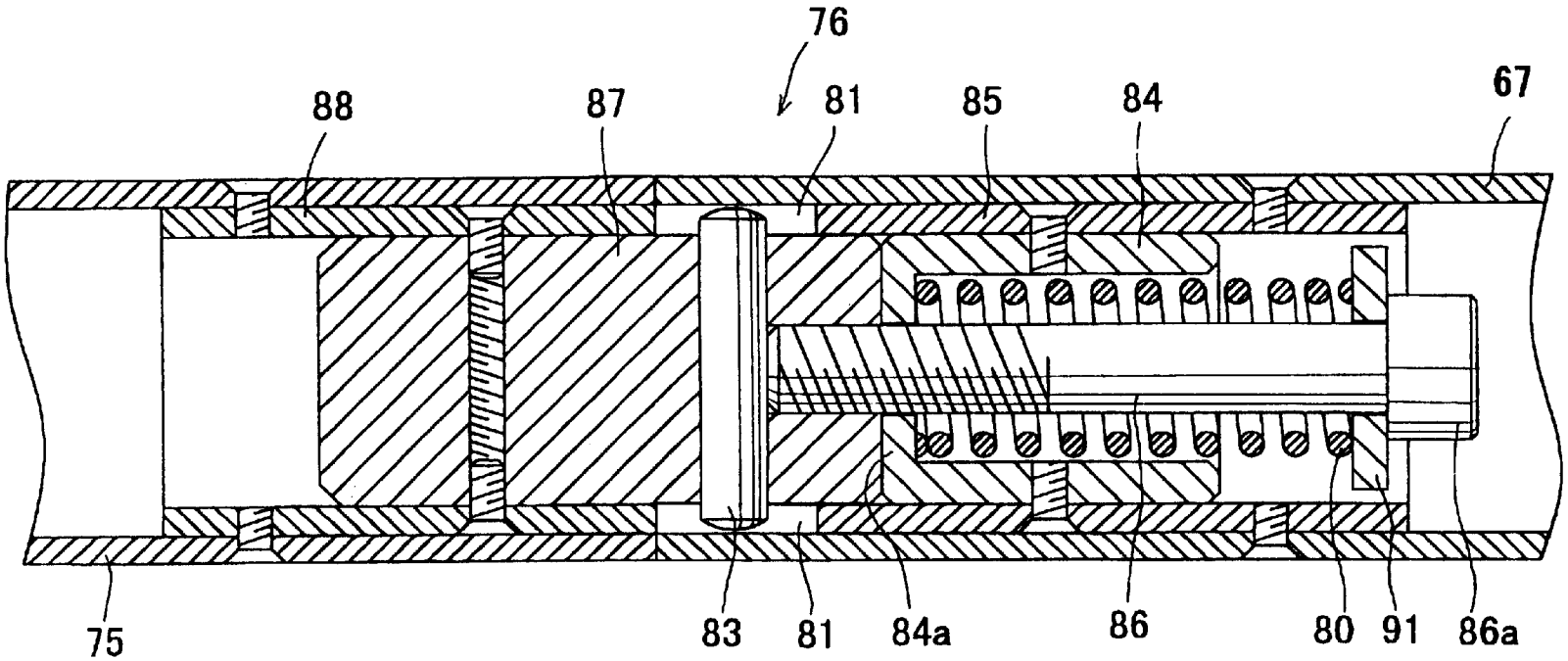
FIG. 51 is a side view of a central vertical section of displacement fixing means which can not rotate.
Figure 52:
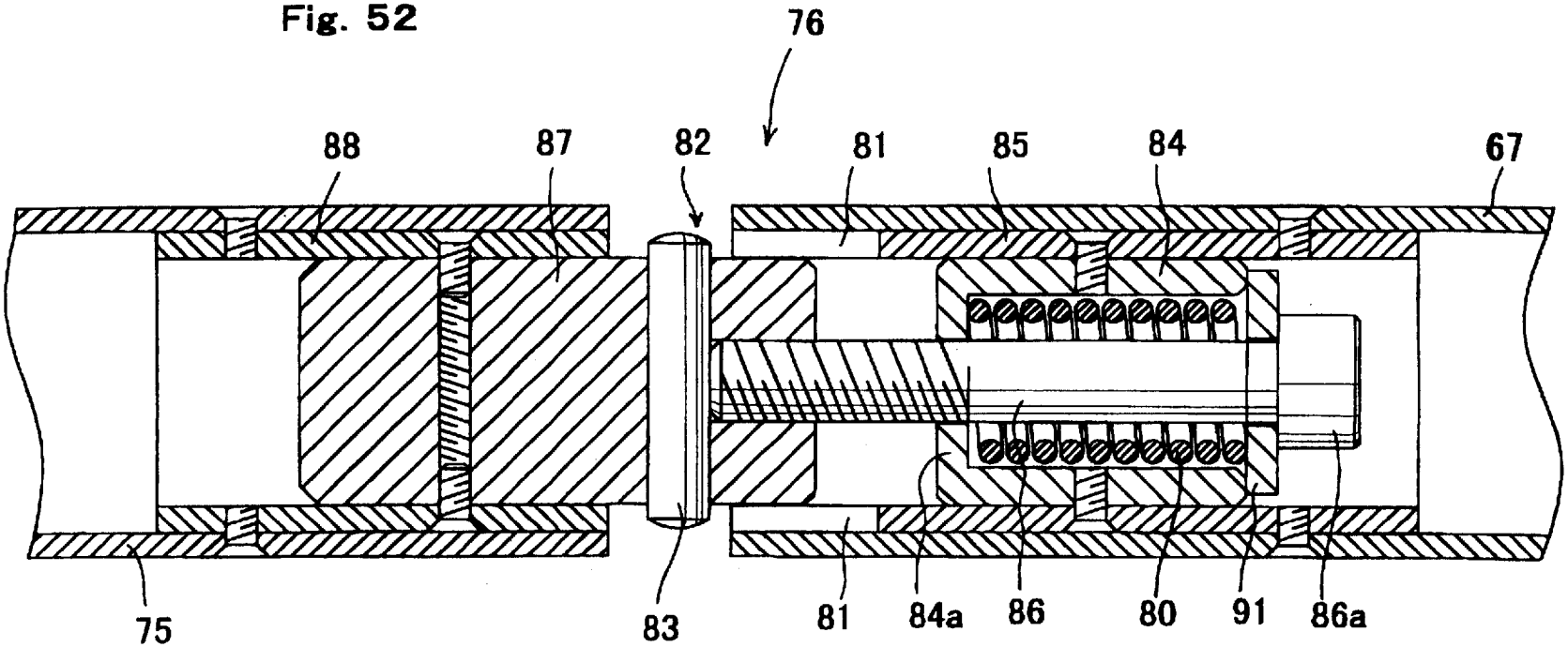
FIG. 52 is a side view of a central vertical section of the displacement fixing means which can rotate.
Figure 53:
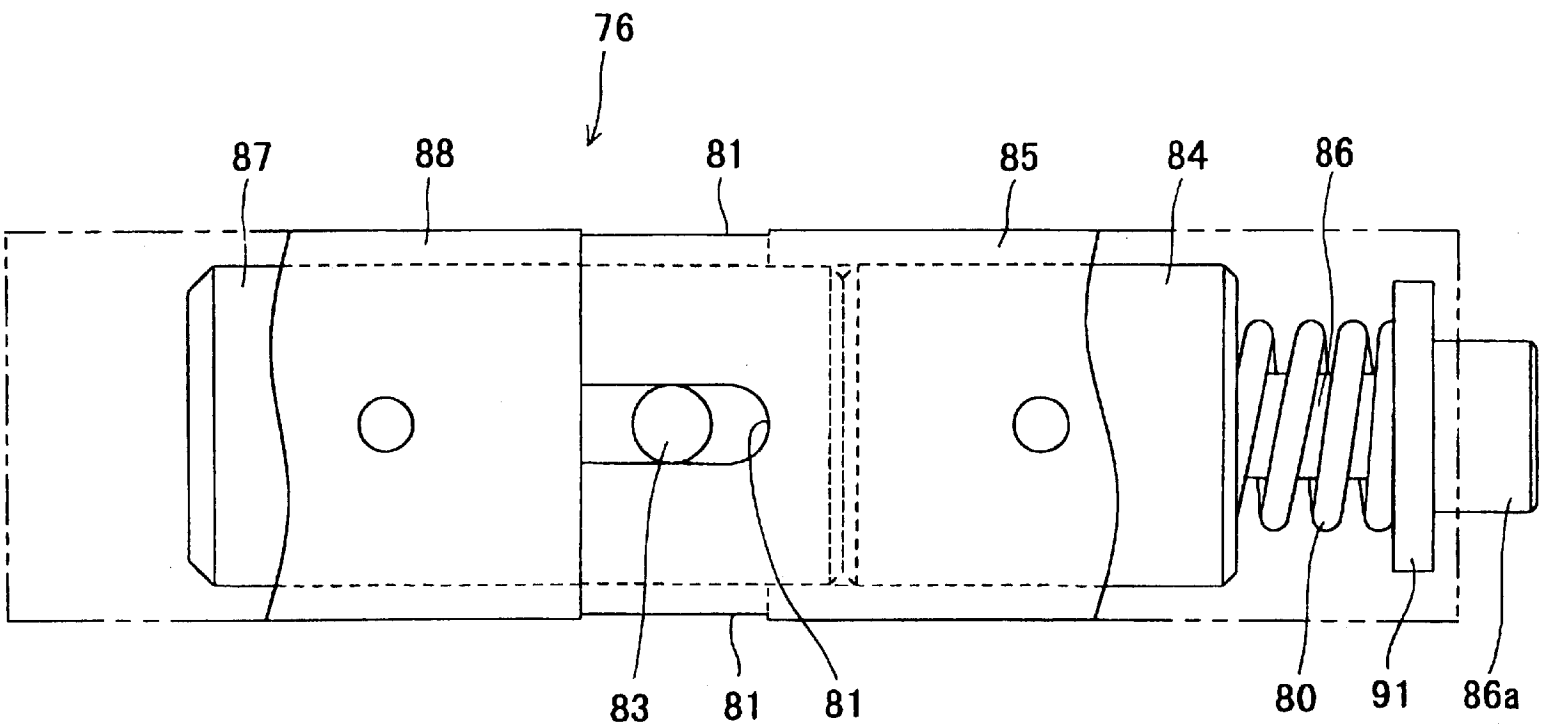
FIG. 53 is a side view showing the displacement fixing means which can not rotate.
Figure 54:
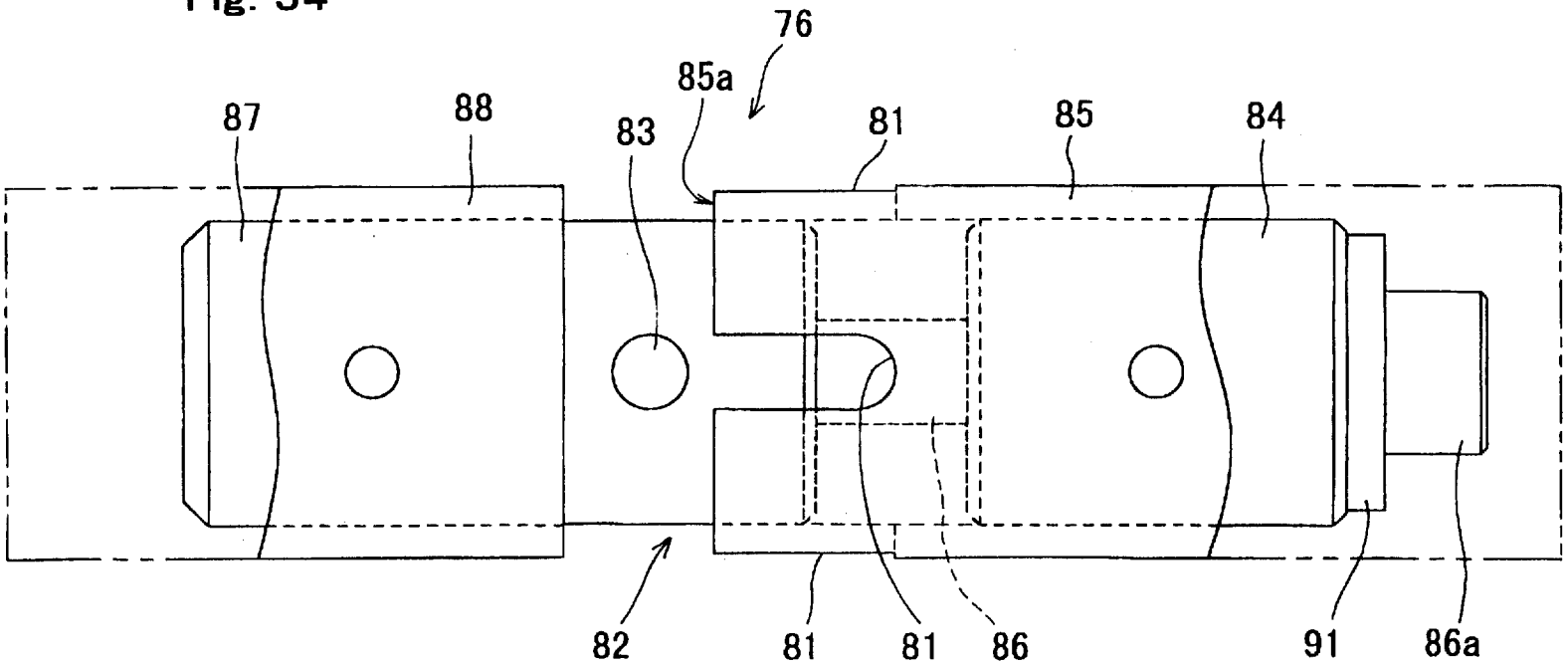
FIG. 54 is a side view showing the displacement fixing means which can rotate.

By attaching the groove side sleeve 85 and the protrusion side sleeve 88 to the handle bar 67 and the lever portion 75 or the lever portion 75 and the bracket portion 78 by screwing and the like, the units of the first and second displacement fixing means 76 and 79 can have a function such that each means relatively rotates between these two members and performs fixation at a selected position. For example, as shown in FIGS. 51 and 52, giving the description on the first displacement fixing means in which the lever portion 75 is applied as the first member and the handle bar 67 on the frame 1 side as the second member, the first displacement fixing means 76 is constituted by inserting the groove side sleeve 85 into the handle bar 67 to be fixed and inserting the protrusion side sleeve 88 into the lever portion 75 to be fixed.

The first displacement fixing means 76 fixes the lever portion 75 and the handle bar 67 so as not to allow relative rotation by causing the engagement protrusion 83 to be fitted to the notch 81, and the state that the engagement protrusion 83 is being fitted to the notch 81 is maintained by the impetus giving means 80. Further, relative rotation of the lever portion 75 and the handle bar 67 is allowed by pulling apart the lever portion 75 and the handle bar 67 against the impetus giving means 80 to remove the engagement protrusion 83 from the notch 81 and enabling rotation in a space 82 formed between end surfaces of the lever portion 75 and the handle bar 67. When the lever portion 75 is again released at an arbitrarily selected notch 81, for example, a notch 81 which can be reached after 90° rotation, the engagement protrusion 83 can be fitted in the notch 81 to fix the lever portion 75 and the handle bar 67. At this time, since the notch 81 is formed on the inner periphery side of the handle bar 67 by the groove side sleeve 85 inserted into the handle bar 67, the notch 81 and the engagement protrusion 83 fitted thereto can not be exposed on the surface, and clothes or fingers of a user can be prevented from accidentally being caught between these members.

In the lever device 74, a grip portion 89 is formed at an end of the bracket portion 78. Therefore, since the grip portion 89 is arranged at a highest position when the lever portion 75 is placed at the handle position H, a caregiver and the like can grab the grip portion 89 to push the stretcher. As shown in FIGS. 48 and 49, the grip portion 89 is designed to have a size and a shape facilitating grab, for example, a flat spherical shape. This grip portion 89 is made of, e.g., plastic and integrally formed with the bracket portion 78. By making the grip portion 89 into a size and a shape facilitating grab, a caregiver and the like can readily apply a force when pushing the stretcher.

The operation of the above-described lever device 74 of the stretcher will now be explained.

When moving in the stretcher configuration, the lever portion 75 which is on the side where a caregiver stands, i.e., the head side or the leg side of the stretcher is pulled up to the handle position H. Here, in order to pull up the lever portion 75 set at the lever retracted position Q to the handle position H to be fixed, the lever portion 75 may be temporarily pulled out to be turned 90° and then released. A caregiver and the like appropriately grabs the grip portion 89 or the lever portion 75 in accordance with circumstances to push or pull the stretcher. In this manner, the lever portion 75 protrudes above the frame 1 and the grip portion 89 at the upper end further projects above the lever portion 75. Accordingly, a caregiver and the like can manually move the stretcher in an upright comfortable posture without bending his/her body forward. Thus, a burden on the caregiver and the like can be reduced. It is to be noted that the right and left safety bars 16 are raised when moving the stretcher. This can prevent a patient from falling off due to an impetus at the time of moving the stretcher.

Further, when the stretcher is stopped to cause a patient to get on and off, the lever portion 75 at least on the side where the patient gets on and off is set at the lever retracted position Q. In addition, the safety bar 16 on the side where the patient gets on and off is moved down. This can prevent the lever portion 75 and the safety bar 16 from being an obstacle for a patient getting on and off.

Moreover, when transferring a patient on the bed to the stretcher in the recumbent state by utilizing the transfer bar 77, the lever portion 75 on the side opposite from the bed is set at the handle position H and the bracket portion 78 is set at the bar support position S. The transfer bar 77 is supported by these bracket portions 78 to take up a sheet on the bed. The sheet is fixed by utilizing the plug 97 at the clip 96 provided to the end of the strap 95 attached to the transfer bar 77. By rotating the handle 94 to take up the strap 95 by the transfer bar 77, a patient can be slid and transferred to the stretcher together with the sheet. At this time, although the transfer bar 77 is pulled toward the bed, the bracket portion 78 positioned at the bar support position S faces the outer side of the stretcher, and the transfer bar 77 is hence necessarily brought into contact with the lever portion 75, thereby preventing the transfer bar 77 from coming off the bracket portion 78.

Figure 46:
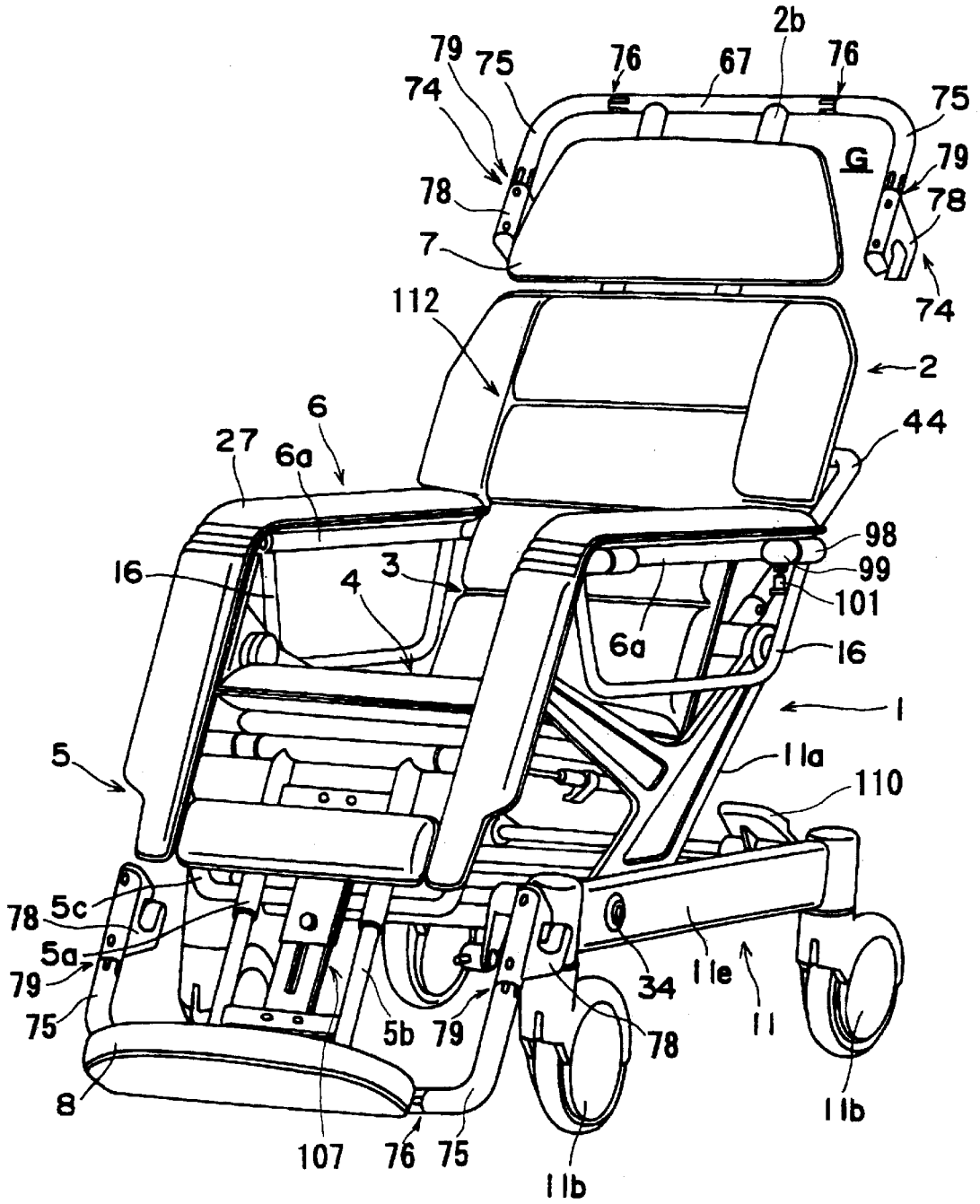
FIG. 46 is a perspective view of the stretcher having the lever device mounted thereon in the wheelchair configuration.

Additionally, when using the stretcher in the wheelchair configuration, as shown in FIGS. 46 and 57, each lever portion 75 is placed at the lever retracted position Q, and the bracket portion 78 is arranged in the front-and-back direction so that they can not be an obstacle for a patient getting on and off.

Figure 58:
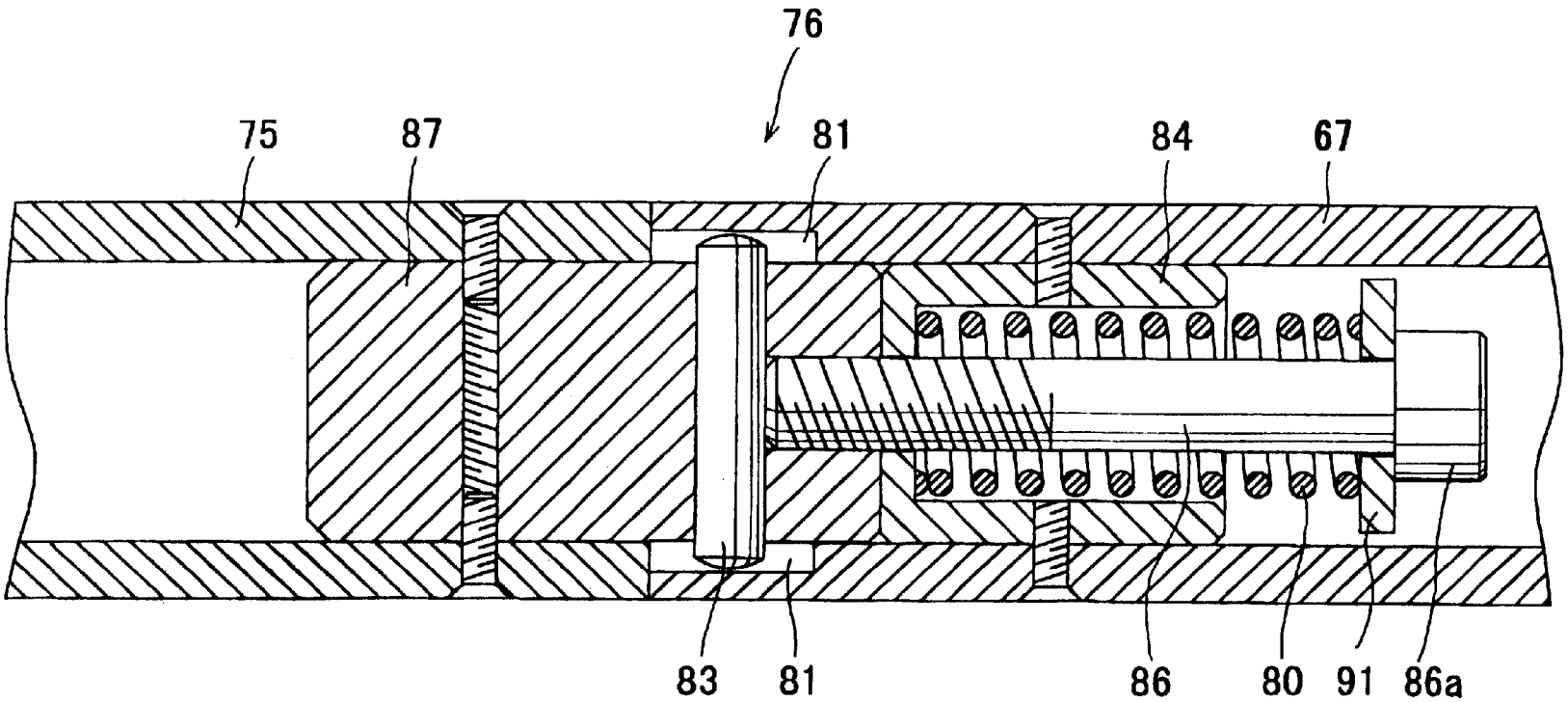
FIG. 58 is a side view of a central vertical section showing another embodiment of the displacement fixing means.

As shown in FIG. 58, the spring bearing cylinder 84 and the protrusion holding member 87 may be directly fixed to the handle bar or the lever portion 75 as the first and the second members, and the notch 81 may be directly formed on the inner peripheral surface of the handle bar 67 or the lever portion 75. Likewise, since the notch 81 is not exposed in this case, fingers of a caregiver and the like can be prevented from being caught between the notch 81 and the engagement protrusion 83.

Figure 59:
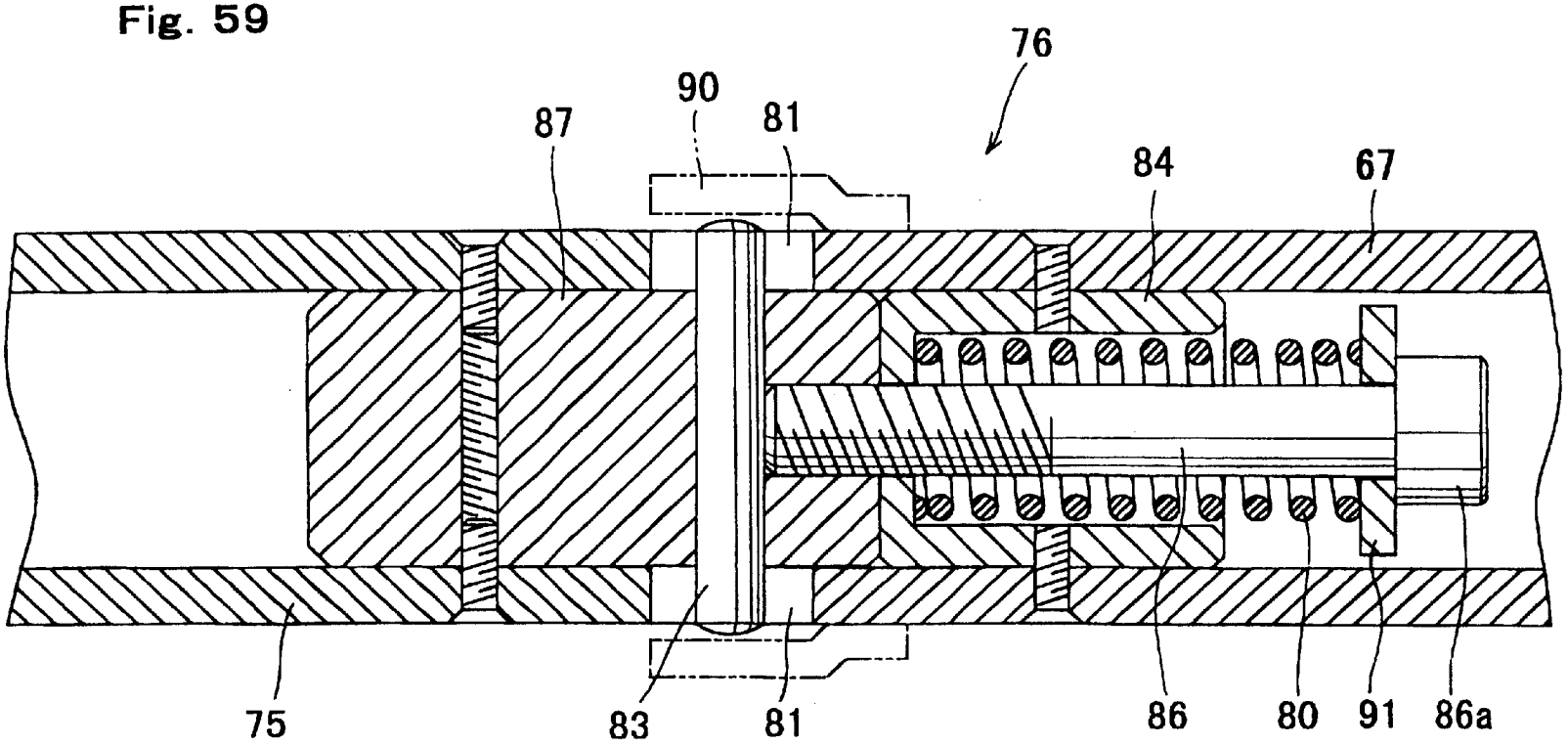
FIG. 59 is a side view of a central vertical section showing still another embodiment of the displacement fixing means.

In addition, as shown in FIG. 59, the notch 81 may be so formed as to pierce the first or second member such as the handle bar 67 or the lever portion 75 in the radial direction. In this case, it is preferable that a sleeve-like cover 90 for covering the circumference of the notch 81 is provided as shown in the drawing. This avoids exposure of the notch 81 to the outside, and fingers of a caregiver and the like can be hence prevented from being caught between the notch 81 and the engagement protrusion 83.

Furthermore, the notches 81 which are provided at two positions in the axial direction and a circumferential space for rotating the engagement protrusion 83 may be continuously formed by one groove piercing the peripheral surface of either the first member or the second member in the radial direction. In such a case, among the four notches 81 formed at every 90°, two grooves for connecting two pairs of the adjacent notches may be preferably symmetrically formed at every 180°. Here, the engagement protrusions which are provided at two positions every 180° respectively rotate in the circumferential direction in a range of 90° and they are engaged with the notches 81 at both stroke ends. As a result, these engagement protrusions are fixed so as to disable rotation.

Although the grip portion 89 is formed in the above-described respective embodiments, this grip portion 89 may be eliminated according to circumstances. In this case, since the lever portion 75 similarly protrudes above the stretcher, a caregiver and the like can move the stretcher without being his/her body forward by grabbing the lever portion 75 at a high position.

Figure 60:
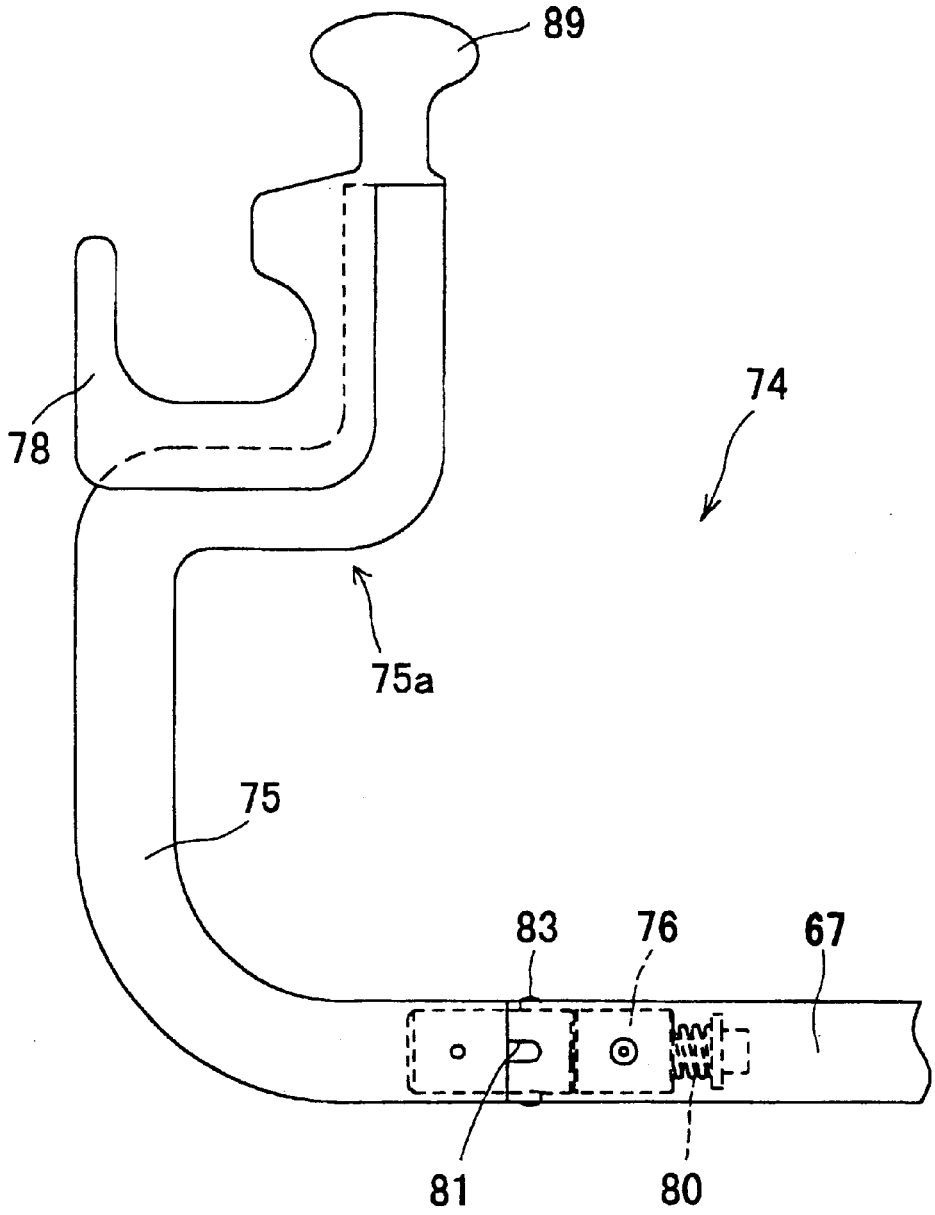
FIG. 60 is a front view showing another embodiment of the lever device.

Further, although the bracket portion 78 in the foregoing embodiments is rotatably coupled with the end of the L-shaped lever portion 75 through the displacement fixing means, the structure is not restricted thereto. As shown in FIG. 60, the end part of the lever portion 75 may be bent toward the inside of the stretcher to form a shoulder portion 75*a*, and the bracket 78 may be fixedly attached to the shoulder portion 75*a*. In this case, when the lever portion 75 is rotated to be set upright, the bracket portion 78 can support the transfer bar 77 upwards. In addition, since the bracket portion 78 is formed at more inner part than the lever portion 75, the bracket portion 78 does not protrude to the outer side of the stretcher or above the mat surface 112 even if the lever portion 75 is directly inclined to the lever retracted position Q when the bracket portion 78 is set at the bar support position S. Therefore, the displacement fixing means 79 for displacing the bracket portion 78 with respect to the lever portion 75 can be eliminated. It is to be noted that the grip portion 89 which is placed at a highest position when the lever portion 75 is set upright is integrally formed to the bracket 78.

In each of the foregoing embodiments, description has been give on the example where both the bracket portion 78 and the lever portion 75 are provided, the structure is not restricted thereto, and only the lever portion 75 may be provided without the bracket portion 78 as shown in FIG. 61. In this case, it is preferable that a single grip portion 89 is provided to the end of the lever portion 75. With this lever device 74, the lever portion 75 also protrudes above the stretcher, and a caregiver and the like can hence push or pull the stretcher without bending his/her body forward by grabbing the lever portion 75 at a high position.

Moreover, in each of the foregoing embodiments, although description has been given on the case where the present invention is applied to the stretcher capable of transforming into the wheelchair, the invention is not restricted thereto. The present invention may be applied to the stretcher which does not transform into the wheelchair, or to a light vehicle other than the stretcher, e.g., general light vehicles having a relatively low frame such as a mobile bath or a bed having casters in some cases.

In addition, the handle device 74 having the bracket portion 78 or having the bracket portion 78 with the lever portion 75 can be attached to a fixed or movable bed to be utilized as a support device for the transfer bar 77. In this case, the bracket portion 78 is attached to the frame of the bed and the like through at least one displacement fixing means so as to be capable of swiveling, or more preferably the bracket portion 78 is attached to the frame with the two displacement fixing means for coupling the bracket portion 78, the bed frame and the lever portion being provided between the bracket portion 78 and the bed frame. It is used for transferring a patient lying on the stretcher and the like to the bed together with the sheet. According to this handle device 74, since the bracket portion 78 can be retracted to a position which does obstruct transfer while being attached to the, bed even if the bracket portion 78 is not used, it is possible to prevent the bracket portion 78 from being lost or damaged after removal.

The support structure for the safety bar 16 of the stretcher will now be described with reference to FIGS. 62 to 68.

Figure 4:
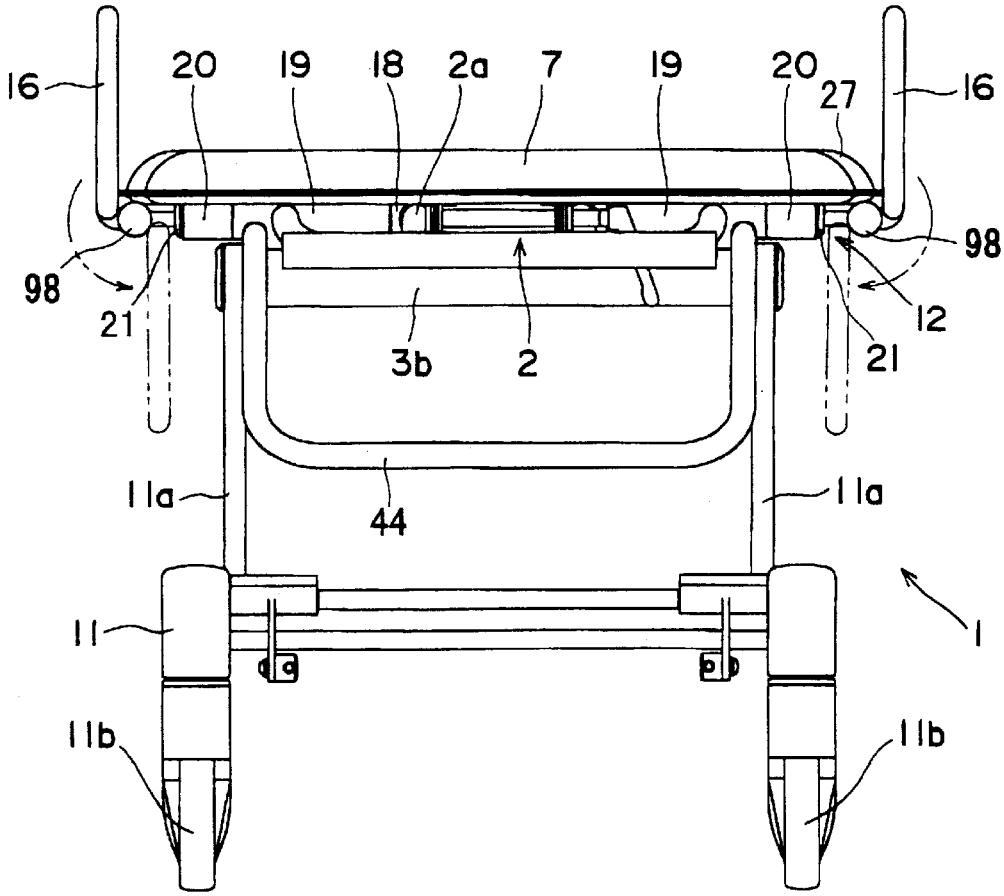
FIG. 4 is a front view of the stretcher configuration seen from a headrest side.
Figure 5:
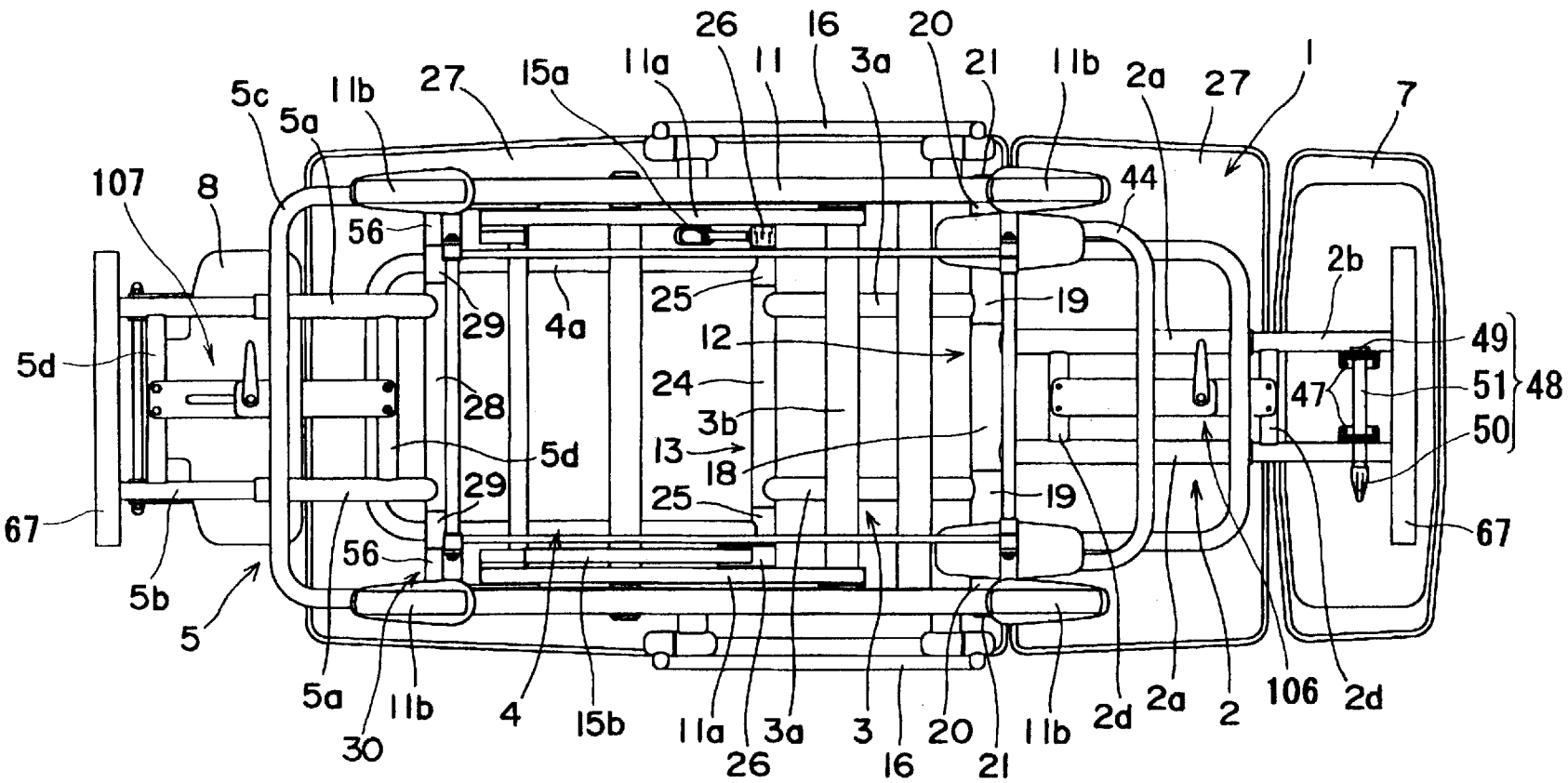
FIG. 5 is a bottom view of the stretcher.
Figure 47:
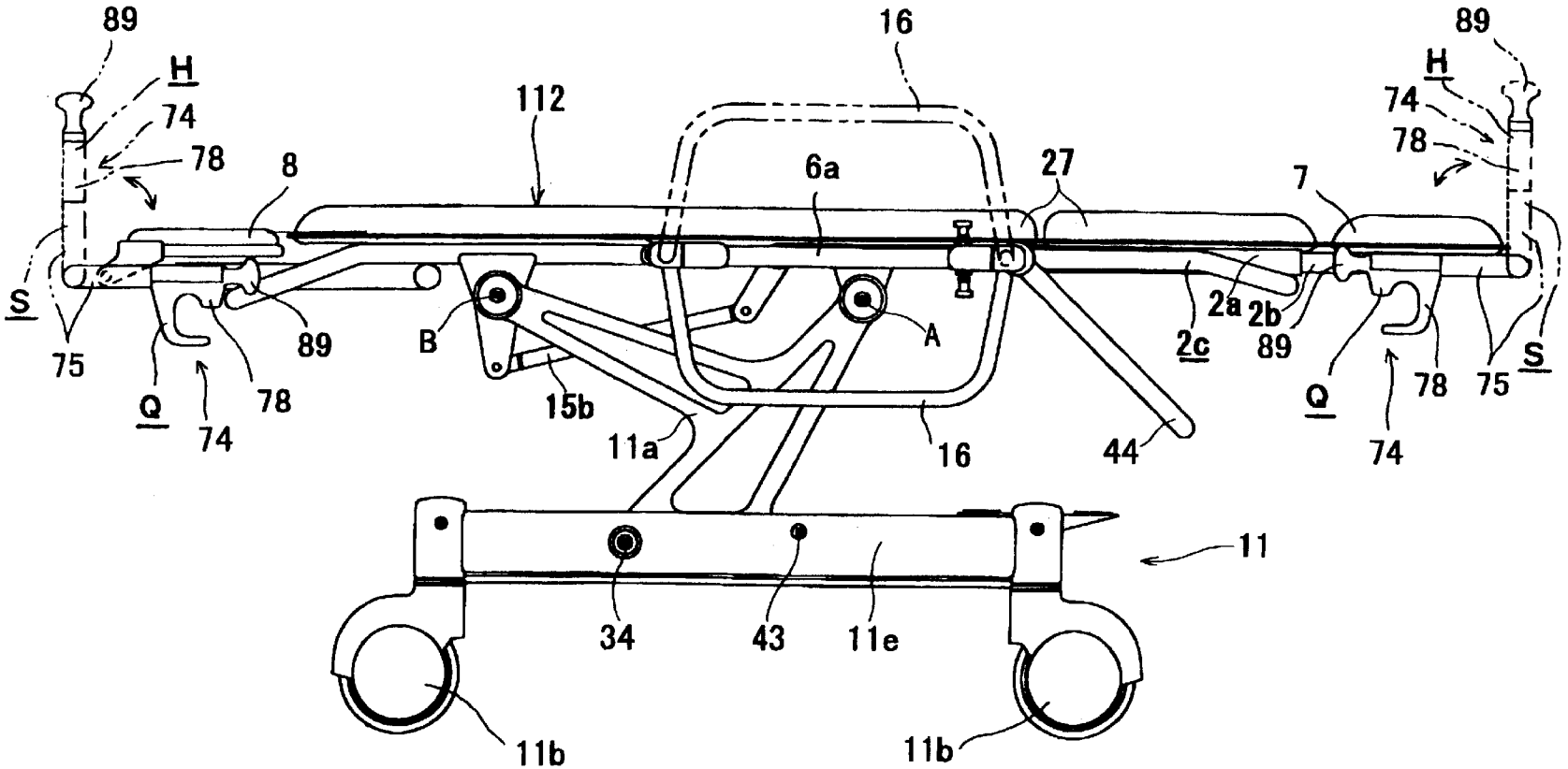
FIG. 47 is a side view showing the stretcher having the lever device mounted thereon.

The stretcher according to the present invention includes the safety bar 16 which can turn to the frame (vertical pipes 6*a*) of the armrest portion 6 on each of the right and left sides. This safety bar 16 can be, as shown in FIG. 3 or 4, raised to a use position to prevent a patient from falling off when the patient is lying on the stretcher, and it can be switched to the safety bar retracted position by moving down, as shown in FIG. 47, when it is not-necessary, e.g., when transferring the patient to the stretcher.

The safety bar 16 which can be switched between the use position and the safety bar retracted position by turning can be directly assembled to the pipe 6*a* of the frame 1 but, in this embodiment, it is rotatably assembled to the pipe 6*a* through a pair of brackets 99 with a shaft connecting both brackets 99 as a center of rotation (turning).

Figure 63:
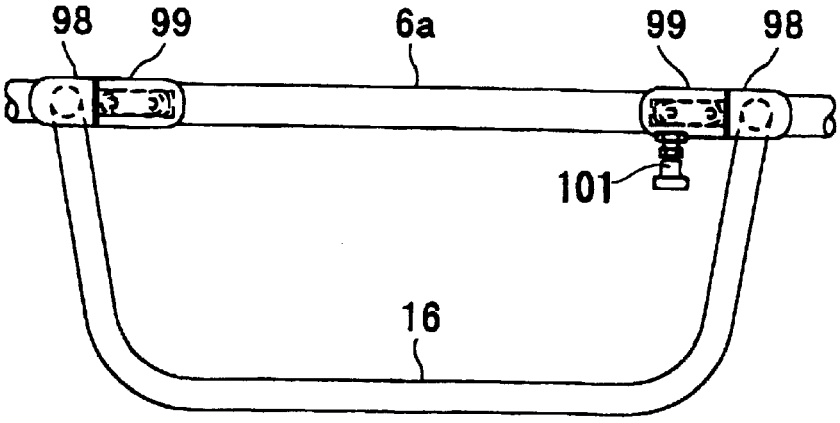
FIG. 63 is a partial side view showing the safety bar support mechanism.

The shape of the safety bar 16 is not restricted to a specific type, and any shape capable of preventing a patient from falling off or slippage of a patient's body at the use position can be used. In this embodiment, a trapezoidal shape is used as shown in FIG. 63 and others, and the width of the bar is narrowed from the center of rotation toward the end of rotation. This shape is, however, only an example, and any other shape may be employed. In this embodiment, although the bar is formed by a hollow member, e.g., a round pipe, the member is not restricted thereto.

Figure 65:
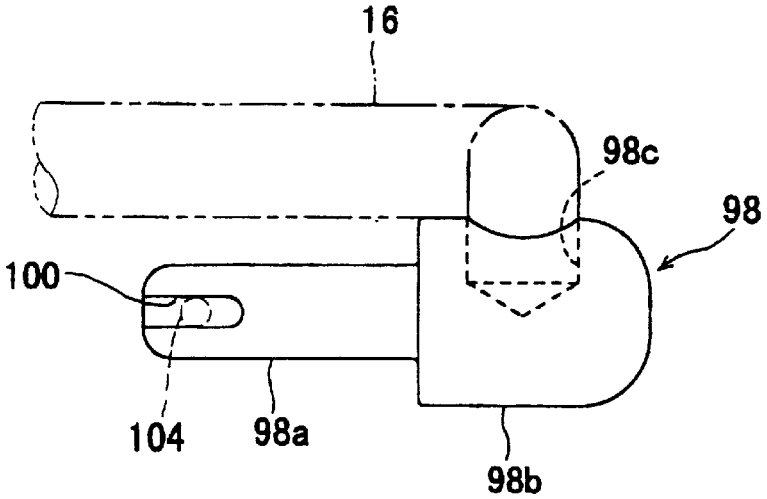
FIG. 65 is a plane view showing the structure of a rotation shaft.

A rotating shaft 98 fitted to the bracket 99 is provided to the center of rotation of the safety bar 16. For example, in this embodiment, as shown in FIGS. 63 and 65, although a pair of rotating shafts 98 having each shaft portion 98*a* opposed to the inner side are provided on the-same axis, these shaft portions 98*a* may face to the outer side or the two shafts do not have to form a pair. In brief, the structure appropriate for the shape of the safety bar 16 can be adopted. For example, if the safety bar 16 has a substantially trapezoidal shape for attachment to the pipe 6*a* at both ends of the bar as in this embodiment, one safety bar 16 is provided to each of both ends. The rotating shaft 98 is, as shown in FIG. 65, made up of: a shaft portion 98*a* fitted to the bracket 99; and a base portion 98*b* which supports the shaft portion 98*a* and abuts on the end surface of the bracket 99.

Although the rotating shaft 98 can be integrally molded as a part of the safety bar 16, it is assembled for facilitating formation/production and the like in this embodiment. Specifically, a round hole 98*c* is formed to the base portion 98*b* of the rotating shaft 98, and the end of the safety bar 16 is inserted into this hole by press fitting and the like to enable unification. Further, unification of the safety bar 16 and the rotating shaft 98 can be facilitated by making the round hole 98*c* as a groove or making the end of the safety bar 16 sharp, which further enhances the strength after unification.

Figure 62:
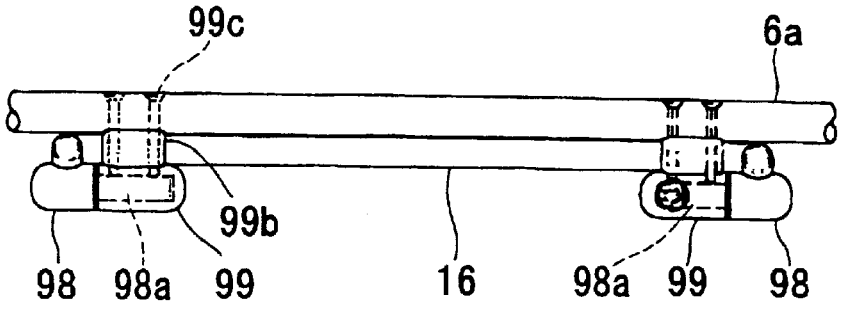
FIG. 62 is a partial plane view showing a safety bar support structure.

The bracket 99 is supporting means which assembles the safety bar 16 to the side part of the stretcher and rotatably supports it. In this embodiment, as shown in FIGS. 62 and 63, both ends of one safety bar 16 are rotatably supported by two brackets 99. The bracket 99 is assembled to the pipe 6*a* constituting the armrest portion and rotatably supports the safety bar 16 with the horizontal axis as the center. In this embodiment, the bracket 99 is attached through a spacer 99*b* by using a vis 99*c* in order to facilitate attachment and the like.

As shown in FIGS. 62 and 63, the bracket 99 includes: a blind hole to which the shaft portion 98*a* of the rotating shaft 98 is fitted and which rotatably supports this shaft portion 98*a*; an attachment screw hole 99*d* for attachment to the pipe 6*a* through the spacer 99*b*; and a screw hole 99*a* for attaching a pushing pin 101. The end surface of the bracket 99 abuts on the base portion 98*b* of the rotating shaft 98 on the safety bar 16 side and positions the safety bar 16 in the axial direction.

Figure 66:
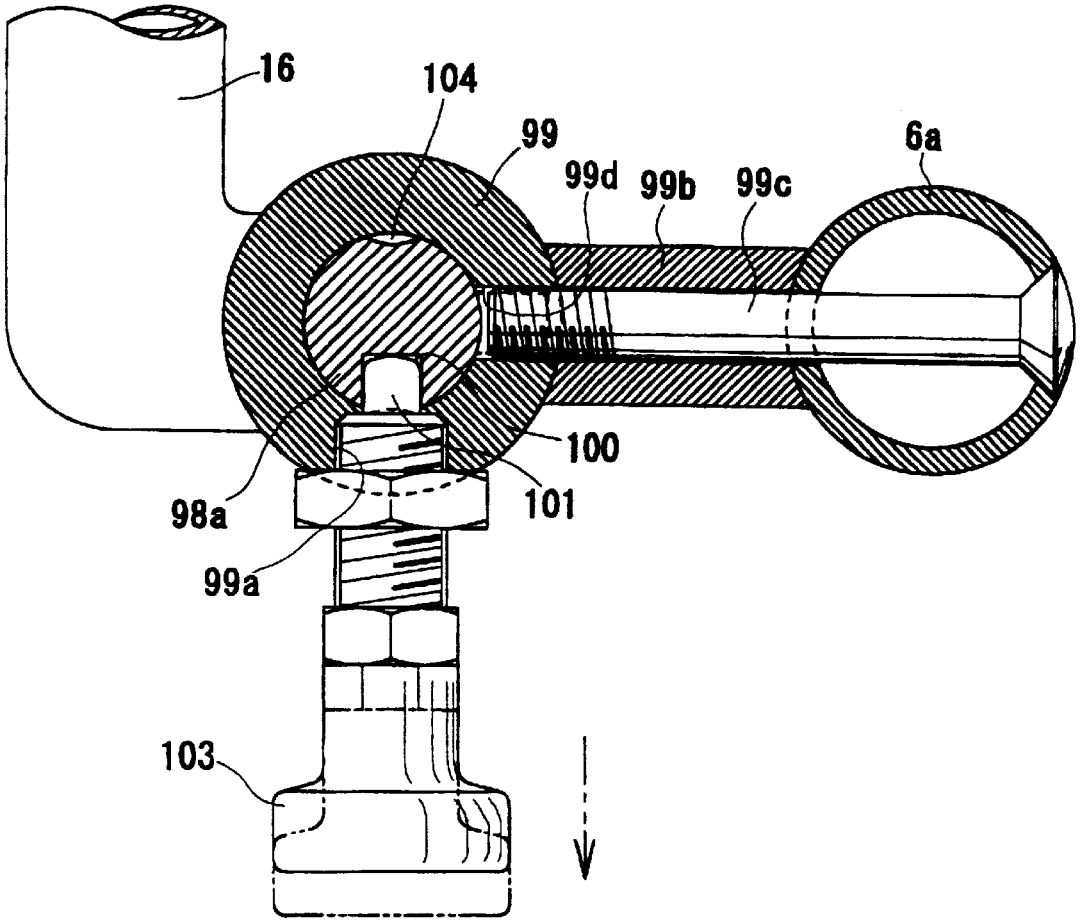
FIG. 66 is a transverse cross-sectional view showing the structure of a frame attachment portion of the bracket.

On the other hand, the spacer 99*b*, as shown in FIGS. 62 and 66, has two holes through which the vises 99*c* are inserted to assemble the bracket 99 to the pipe 6*a*. In addition, as shown in FIG. 66, the surface of both ends of the spacer 99*b* is a curved surface which can be brought into contact with the pipe 6*a* having a circular cross section and the outer peripheral surface of the bracket 99 without a gap formed therebetween.

Figure 64:
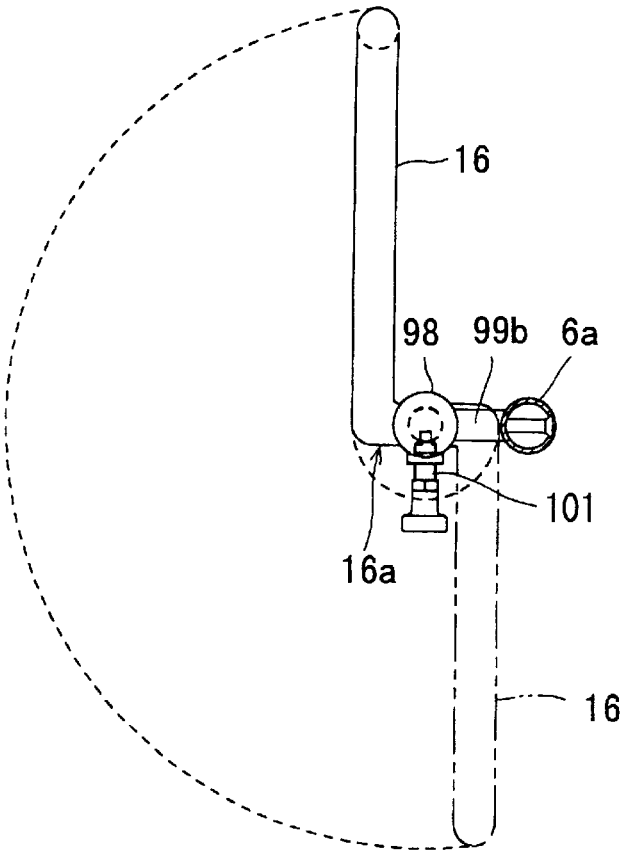
FIG. 64 is a view showing the state of rotation of the safety bar.

With the above-described rotating shaft 98 and the bracket 99, the safety bar 16 can be assembled to the pipe 6*a* constituting the armrest portion 6 as shown in FIGS. 62 and 63 and reciprocate between the use position and the safety bar retracted position with the rotating (turning) axis connecting both rotating shafts 98 as the center as shown in FIG. 64.

Here, when the safety bar 16 is provided with means for locking so as to disable rotation in at least the use position, the safety bar 16 can maintain its upright state without coming down even if an external force is applied. For example, in this embodiment, a concave portion 100 provided at the shaft portion 98*a* of the rotating shaft 98 and the pushing pin 101 engaged with this concave portion 100 form the locking means. It is to be noted that providing the locking means to at least one bracket 99 can suffice the structure, and this means is provided on the side close to the headrest 7 as shown in the drawing in this embodiment.

The concave portion 100 is a groove partially provided to the shaft portion 98*a*, as shown in FIGS. 65 and 66, and engaged with the end of the pushing pin 101 to disable rotation of the rotating shaft 98. In this embodiment, in accordance with the structure in which the pushing pin 101 is provided to the lower surface of the bracket 99 as shown in FIG. 64 and the like, the concave portion 100 is formed at a position which is turned down when the safety bar 16 is set upright. Here, impetus giving means (not shown) such as a spring included in the pushing pin 101 gives an impetus to the pushing pin 101 such that the end of the pin protrudes, and a knob 103 which can be held by hand to facilitate pulling is provided to the base end side. The knob 103 is so provided as to be screwed in a screw hole 99*a* provided to the lower portion of the bracket 99 so that the end of the pin 101 is turned up. It is further fixed by fastening of a fastening nut. It is to be noted that the positional relationship or individual arrangements of the concave portion 100 and the pushing pin 101 are not restricted to those described above if they can lock the safety bar 16 to disable rotation in the upright state.

With this locking means, when the safety bar 16 is placed at the safety bar retracted position, the pushing pin 101 is in contact with the peripheral surface of the rotating shaft 98 and retracted, and the pin 101 hence freely rotates when raising the safety bar 16. As shown in FIG. 64, when the safety bar 16 reaches the use portion to be set upright, the pushing pin 101 protrudes toward and is automatically engaged with the concave portion 100. Therefore, even if an external force is applied to the safety bar 16, the safety bar 16 does not move. It can turn the other way round only when a caregiver and the like pulls the knob 103 downward to retract the pushing pin 101. Further, the safety bar 16 is not only used in the stretcher mode as shown in FIG. 45 and the like, but it can be also used in the wheelchair mode shown in FIG. 46 and the like. In this case, when a patient is sitting and can not keep his/her posture, it is possible to prevent the patient from falling off from the side part.

Incidentally, it is preferable that a groove portion 104 to which only a semispherical portion of an end of the pushing pin 101 is fitted and which is shallower and smaller than the concave portion 100 is provided at a position on the back side of the concave portion 100 of the shaft portion 98*a*. Since this groove portion 104 is slightly engaged with the end of the pushing pin 101 only when the safety bar 16 is placed at the safety bar retracted position as shown in FIG. 64, the safety bar 16 set at the safety bar retracted position can be prevented from unnecessarily oscillating. On the other hand, engagement can be readily released when a force for pulling up the safety bar 16 is given. Therefore, the operation for raising the safety bar 16 is easy and the safety is high. Also, the usability is excellent.

Further, the safety bar 16 of this embodiment is attached to the bracket 99 with an offset as shown in FIG. 64. That is, the part 16*a* of the safety bar 16 attached to the bracket 99 is formed into an L shape so that it protrudes in parallel with and apart from a tangent line relative to the outer peripheral surface of the bracket 99 to be deviated from the shaft portion 98*a*. Consequently, as shown in FIG. 64, the safety bar 16 is placed below the stretcher at the safety bar retracted position (the state indicated by the linkage double-dashed line). Therefore, the stretcher can be appressed against the bed or any other device, or a space required for aligning the stretchers can be omitted. Further, the safety bar 16 can be set upright so as to protrude toward the outer side of the stretcher at the use position (the state indicated by the solid line), a stretcher surface can be widely used.

Moreover, in the safety bar support structure in this embodiment, it is possible to reduce looseness of attachment of the safety bar 16 in the axial direction by assembling the safety bar 16 in the fixed state. That is, either the brackets 99 or the shaft portions 98*a* of the rotating shafts 98 of the safety bar 16 are set so as to be opposed to each other, and the remaining members are arranged to turn the back on each other. When both brackets 99 are fixed to the pipe 6*a* of the armrest portion 6 by the vis 99*c* in the state where the brackets 99 are attached to both ends of the safety bar 16 in advance, it is possible to prevent the safety bar 16 after assembling from moving in the axial direction and the safety bar 16 can be maintained in the fixed state in which the safety bar 16 can not be released as long as the brackets 99 are removed.

Although the above is only the preferred embodiments according to the present invention, the invention is not restricted thereto, and various modifications are possible without departing from a scope of the present invention. For example, the frame coupling structure, the headrest structure and its support structure, the frame tilt structure, the safety bar support structure and its assembling method, and others according to the present invention have been described mainly based on the examples where the present invention is applied to the stretcher. However, the present invention can be applied to any other device, e.g., a hospital bed, a general bed or a wheelchair. In these devices, the rigidity of the frame structure and the torsion rigidity can be increased, and it is possible to improve maintenance of a head of a user, maintenance of a posture, assurance of a comfortable posture, safety and others, thereby realizing health welfare devices with the excellent usability.

What is claimed is:

1. A stretcher comprising:

a cart; and a frame mounted on said cart to support a mat for getting a patient thereon, wherein said frame is divided into at least four parts, said at least four parts including an above knee portion constituting a seat portion for supporting a femoral region of said patient, a lumbar portion included in a backrest for supporting an upper part of a body of said patient, an armrest portion constituting an armrest, and a below knee portion capable of supporting a lower limb region of said patient;

rotatably coupling said above knee portion, said lumbar portion, said armrest portion and said below knee portion with each other and changing their positional relationship enables transformation into a stretcher configuration in which a flat mat surface including said armrest portion and said below knee portion is formed and a wheelchair configuration in which said mat is bent and said armrest portion is raised up;

said patient can be mounted to be moved in either posture of said stretcher configuration or said wheelchair configuration; and an angle adjustment mechanism, wherein said frame is mounted on said cart through said angle adjustment mechanism, said angle adjustment mechanism includes a support member which is provided between said frame and said cart to support said frame and is coupled with said cart so as to be capable of oscillating, and a tilt angle variable mechanism capable of fixing said support member to said cart at an arbitrary position, wherein said entire frame can tilt to said cart without changing each angle between said above knee portion and said lumbar portion, said lumbar portion and said armrest portion, said armrest portion and said below knee portion, and said below knee portion and said above knee portion, wherein said portions constitute said frame, and wherein said frame couples said cart so as to be capable of oscillating by coupling a middle part of said lumbar portion and a middle part of said below knee portion with said support member at two coupling positions, said above knee portion of said frame couples said below knee portion so as to be capable of rotating and sliding, a four-node rotation linkage of a parallelogram with a coupling position between said lumbar portion and said armrest portion, a coupling position between said armrest portion and said below knee portion, one of said coupling positions between said below knee portion and said support member of said cart, and the other of said coupling positions between said lumbar portion and said support member of said cart as four apexes being constituted in profile, said parallelogram being crushed and said four respective portions being arranged on the same plane by rotating said lumbar portion so as to be reclined rearward around said coupling position with said cart, said parallelogram being restored and said armrest portion being upheaved by rotating said lumbar portion so as to be raised forward.

2. A stretcher according to claim 1, wherein each of said respective coupling positions on right and left sides of said frame is constituted by one core material piercing one coupling position and the other coupling position associated therewith, and a sleeve which is rotatably fitted to said core material and to which said frame is fixed, said frame being bent by rotating said sleeve around said core material.

3. A stretcher according to claim 2, wherein a total length of the sleeve fitted in said core material has substantially the same value as an entire length of said core material, a flange member for preventing said sleeve from coming off being attached to an end surface of said core material.

4. A stretcher according to claim 1, wherein a lock mechanism for making said four-node rotation linkage of said parallelogram as a fixed linkage is provided.

5. A stretcher according to claim 4, wherein a plurality of said lock mechanisms are provided and attached at installation angles different from each other.

6. A stretcher according to claim 4, wherein a part of said cart which rotatably supports said frame of said cart and said lock mechanism are arranged against both right and left sides of said cart and a bag accommodating space is formed between said frame and said cart.

7. A stretcher according to claim 1, wherein said tilt angle variable mechanism is a gas spring with a lock mechanism.

8. A stretcher according to claim 1, wherein a headrest is provided to a part of said frame supporting a head of said patient.

9. A stretcher according to claim 8, wherein said headrest has a shape such that the width is narrowed toward a parietal region.

10. A stretcher according to claim 1, wherein a bracket is provided on a side of said armrest portion of said frame, a safety bar includes a rotating shaft portion, is capable of rotating between a use position where said safety bar is raised up above said mat to prevent said patient from falling off and a retracted position where said safety bar is retracted under said mat so as not to obstruct transfer of said patients and being rotatably attached to said bracket, and locking means for disabling rotation of said safety bar at said use position being provided between said bracket and said safety bar.

11. A stretcher according to claim 10, wherein said locking means is a concave portion provided to either said safety bar or said bracket and a pushing pin which is provided to the other engaged with said concave portion and constantly receives an impetus.

12. A stretcher according to claim 10, wherein an offset is given to said rotating shaft portion of said safety bar supported by said bracket, and said offset causing said safety bar in said use position to protrude from the side portion of said stretcher to be set upright on the outer side and causing said safety bar in said retracted position to be retracted from the side portion of said stretcher to the inner side.

13. A stretcher according to claim 10, wherein a pair of said brackets and a pair of said rotating shaft portions are provided, either said brackets or said rotating shaft portions of said safety bar fitted to said brackets are so set as to be opposed to each other and the other members are arranged in a back-to-back manner, said safety bar being supported in a fixed state with its movement in an axial direction disabled after fitting said safety bar to said bracket.

14. A stretcher according to claim 10, wherein, after attaching said bracket to said rotating shaft portion of said safety bar, said safety bar is assembled to said frame by attaching said bracket to said frame.

15. A stretcher, comprising:

a cart; and a frame mounted on said cart to support a mat for getting a patient thereon, wherein said frame is divided into at least four parts, said at least four parts including an above knee portion constituting a seat portion for supporting a femoral region of said patient, a lumbar portion included in a backrest for supporting an upper part of a body of said patient, an armrest portion constituting an armrest, and a below knee portion capable of supporting a lower limb region of said patient;

rotatably coupling said above knee portion, said lumbar portion, said armrest portion and said below knee portion with each other and changing their positional relationship enables transformation into a stretcher configuration in which a flat mat surface including said armrest portion and said below knee portion is formed and a wheelchair configuration in which said mat is bent and said armrest portion is raised up;

said patient can be mounted to be moved in either posture of said stretcher configuration or said wheelchair configuration; and an angle adjustment mechanism, wherein said frame is mounted on said cart through said angle adjustment mechanism, said angle adjustment mechanism includes a support member which is provided between said frame and said cart to support said frame and is coupled with said cart so as to be capable of oscillating, and a tilt angle variable mechanism capable of fixing said support member to said cart at an arbitrary position, wherein said entire frame can tilt to said cart without changing each angle between said above knee portion and said lumbar portion, said lumbar portion and said armrest portion, said armrest portion and said below knee portion, and said below knee portion and said above knee portion, wherein said portions constitute said frame, and wherein each of said respective coupling positions on right and left sides of said frame is constituted by one core material piercing one coupling position and the other coupling position associated therewith, and a sleeve which is rotatably fitted to said core material and to which said frame is fixed, said frame being bent by rotating said sleeve around said core material.

16. A stretcher according to claim 15, wherein a total length of the sleeve fitted in said core material has substantially the same value as an entire length of said core material, a flange member for preventing said sleeve from coming off being attached to an end surface of said core material.

17. A stretcher according to claim 15, wherein a lock mechanism for making said four-node rotation linkage of said parallelogram as a fixed linkage is provided.

18. A stretcher according to claim 17, wherein a plurality of said lock mechanisms are provided and attached at installation angles different from each other.

19. A stretcher according to claim 17, wherein a part of said cart which rotatably supports said frame of said cart and said lock mechanism are arranged against both right and left sides of said cart and a bag accommodating space is formed between said frame and said cart.

20. A stretcher according to claim 15, wherein said tilt angle variable mechanism is a gas spring with a lock mechanism.

21. A stretcher according to claim 15, wherein a headrest is provided to a part of said frame supporting a head of said patient.

22. A stretcher according to claim 21, wherein said headrest has a shape such that the width is narrowed toward a parietal region.

23. A stretcher according to claim 15, wherein a bracket is provided on a side of said armrest portion of said frame, a safety bar includes a rotating shaft portion, is capable of rotating between a use position where said safety bar is raised up above said mat to prevent said patient from falling off and a retracted position where said safety bar is retracted under said mat so as not to obstruct transfer of said patient, and being rotatably attached to said bracket, and locking means for disabling rotation of said safety bar at said use position being provided between said bracket and said safety bar.

24. A stretcher according to claim 23, wherein said locking means is a concave portion provided to either said safety bar or said bracket and a pushing pin which is provided to the other engaged with said concave portion and constantly receives an impetus.

25. A stretcher according to claim 23, wherein an offset is given to said rotating shaft portion of said safety bar supported by said bracket, and said offset causing said safety bar in said use position to protrude from the side portion of said stretcher to be set upright on the outer side and causing said safety bar in said retracted position to be retracted from the side portion of said stretcher to the inner side.

26. A stretcher according to claim 23, wherein a pair of said brackets and a pair of said rotating shaft portions are provided, either said brackets or said rotating shaft portions of said safety bar fitted to said brackets are so set as to be opposed to each other and the other members are arranged in a back-to-back manner, said safety bar being supported in a fixed state with its movement in an axial direction disabled after fitting said safety bar to said bracket.

27. A stretcher according to claim 23, wherein, after attaching said bracket to said rotating shaft portion of said safety bar, said safety bar is assembled to said frame by attaching said bracket to said frame.

* * * * *

UNITED STATES PATENT AND TRADEMARK OFFICE

CERTIFICATE OF CORRECTION

PATENT NO. : 6,792,633 B1
DATED : September 21, 2004
INVENTOR(S) : Ito

It is certified that error appears in the above-identified patent and that said Letters Patent is hereby corrected as shown below:

Column 13,
Line 60, "supporting a the" should read -- supporting the --.
Line 61, "are, separated" should read -- are separated --.

Column 14,
Line 60, "member 11 a" should read -- member 11a --.
Line 61, "on the cart 1" should read -- on the cart 11 --.

Column 15,
Line 9, "relative to We a" should read -- relative to a --.
Line 24, "points rearnvards" should read -- points rearwards --.

Column 18,
Line 40, "rotatably A attached" should read -- rotatably attached --.
Line 43, "to a the sleeve" should read -- to the sleeve --.
Lines 46-47, "formed to a the sleeve" should read -- formed to the sleeve --.
Line 59, "device 1b" should read -- device 15b --.

Signed and Sealed this

Fifth Day of April, 2005

JON W. DUDAS
*Director of the United States Patent and Trademark Office*